US010974956B2

(12) United States Patent
Berreklouw

(10) Patent No.: US 10,974,956 B2
(45) Date of Patent: Apr. 13, 2021

(54) HORSEMAN-SECURING DEVICE, SADDLE, AND SADDLE SECURING DEVICE FOR PREVENTING A HORSEMAN FROM FALLING OFF A FOUR-LEGGED ANIMAL

(71) Applicant: Daidalos Solutions B.V., Amsterdam (NL)

(72) Inventor: Eric Berreklouw, Son (NL)

(73) Assignee: Daidalos Solutions B.V., Amsterdam (NL)

( * ) Notice: Subject to any disclaimer, the term of this patent is extended or adjusted under 35 U.S.C. 154(b) by 555 days.

(21) Appl. No.: 15/326,394

(22) PCT Filed: Jul. 15, 2015

(86) PCT No.: PCT/NL2015/050521
§ 371 (c)(1),
(2) Date: Jan. 13, 2017

(87) PCT Pub. No.: WO2016/010430
PCT Pub. Date: Jan. 21, 2016

(65) Prior Publication Data

US 2017/0197818 A1 Jul. 13, 2017

(30) Foreign Application Priority Data

Jul. 16, 2014 (NL) ..... 2013196

(51) Int. Cl.
*B68C 1/00* (2006.01)
*B68C 1/14* (2006.01)
(Continued)

(52) U.S. Cl.
CPC ..... *B68C 1/147* (2013.01); *B68C 1/00* (2013.01); *B68C 1/04* (2013.01); *B68C 1/10* (2013.01); *B68C 2001/044* (2013.01)

(58) Field of Classification Search
CPC ..... B68C 1/00; B68C 1/02; B68C 2001/002; B68C 1/04; B68C 2001/044; B68C 1/10;
(Continued)

(56) References Cited

U.S. PATENT DOCUMENTS 297,486 A * 4/1884 Babcock ..... B68C 1/12 54/66
304,950 A * 9/1884 Nave et al. ..... B68C 1/12 54/66
(Continued)

FOREIGN PATENT DOCUMENTS

DE 193524 C 1/1907
EP 0860397 A1 8/1998
(Continued)

OTHER PUBLICATIONS

International Search Report and Written Opinion for International application No. PCT/NL2015/050521, dated Feb. 1, 2016.
(Continued)

*Primary Examiner* — Kathleen I Alker
(74) *Attorney, Agent, or Firm* — Westman, Champlin & Koehler, P.A.; Steven M. Koehler

(57) ABSTRACT

A horseman-securing device is configured in order to prevent a horseman sitting on the back of a four-legged animal from falling off, or being able to fall off the animal. It comprises securing device by means of which the horseman, in use, is releasably secured to the animal. The securing device is configured to secure the horseman secured to the animal in such a way that the horseman retains the freedom of movement to hinge his knee joints.

30 Claims, 50 Drawing Sheets

(51) Int. Cl.
*B68C 1/04* (2006.01)
*B68C 1/10* (2006.01)

(58) Field of Classification Search
CPC ..... B68C 1/147; B68C 1/18; A41D 1/086; A61B 5/702; A61B 5/70; B60R 22/00; B60R 22/02; B60R 22/18; B60R 22/28; B60R 22/286; B60R 22/287; B60R 22/001; B60R 2021/0053; B60R 2021/0051; A47C 1/036; A47C 1/037; A47C 7/50; A47C 7/503; A47C 16/00; A47C 16/02; A47C 16/025; A47C 16/04; A47C 20/021; A47C 20/022; A47C 23/34
See application file for complete search history.

(56) References Cited

U.S. PATENT DOCUMENTS 485,277 A * 11/1892 Hunter ..... A61G 5/10 297/466
558,029 A * 4/1896 Baur ..... B68C 1/02 54/44.1
909,385 A * 1/1909 Fachiri ..... B68C 1/02 54/44.1
1,397,128 A * 11/1921 Keithley ..... B68C 1/02 54/44.5
2,128,159 A * 8/1938 Morgan ..... A41D 1/086 2/62
2,407,646 A * 9/1946 Best ..... A47D 15/006 297/466
2,446,470 A * 8/1948 Godwin ..... A61G 13/12 128/878
2,492,880 A * 12/1949 Nichols ..... A47D 13/08 297/487
2,949,152 A * 8/1960 Hipps ..... A61G 5/10 297/410
3,764,180 A * 10/1973 Mulholland ..... A61G 5/12 297/400
4,192,546 A * 3/1980 Smith ..... A61G 5/10 297/423.17
4,359,200 A * 11/1982 Brevard ..... B64D 25/06 244/122 AG
4,579,191 A * 4/1986 Klee ..... B60J 5/0487 180/268
4,683,709 A * 8/1987 Vasko ..... B68C 1/12 54/66
4,732,381 A * 3/1988 Skowronski ..... A63B 23/0233 482/134
4,799,709 A * 1/1989 Francois ..... B60R 22/00 2/311
4,813,746 A * 3/1989 Mulholland ..... A61G 5/12 297/464
4,910,818 A * 3/1990 Grabill ..... A47C 20/021 297/423.17
5,040,522 A * 8/1991 Daniels ..... A61H 1/024 297/466
5,301,903 A * 4/1994 Aronne ..... B64D 25/02 244/122 AG
5,342,116 A * 8/1994 Walton ..... A47C 7/503 297/423.12
5,383,327 A 1/1995 Dohln
5,423,164 A * 6/1995 Schneider ..... A41D 1/086 54/44.1
5,685,133 A 11/1997 Travis
5,735,109 A 4/1998 Kojima
5,782,070 A * 7/1998 Knight ..... B32B 5/22 54/66
5,806,933 A * 9/1998 Tsui ..... A47C 7/38 297/391
5,901,531 A 5/1999 Rogers
6,120,099 A * 9/2000 Reikeras ..... B60N 2/809 297/391
6,123,392 A * 9/2000 Alfred ..... A47C 9/002 297/423.1
6,349,993 B1 * 2/2002 Walsh ..... A47C 7/50 297/284.11
6,419,321 B1 * 7/2002 Sack ..... A61G 5/12 297/405
6,422,512 B1 * 7/2002 Lewis ..... B64D 25/02 244/121
7,137,236 B2 * 11/2006 Brownlie ..... B68C 1/08 54/66
7,204,559 B2 * 4/2007 Berra ..... B60R 21/02 297/466
7,306,289 B2 * 12/2007 Kobayashi ..... A47C 7/503 297/313
7,677,671 B2 * 3/2010 Steininger ..... A63G 7/00 297/487
7,992,939 B2 * 8/2011 Pozzi ..... A47C 7/38 297/410
8,261,519 B2 * 9/2012 Woods ..... B68C 1/00 54/23
8,317,267 B2 * 11/2012 Wallace ..... A47C 7/029 297/423.12
9,254,815 B1 * 2/2016 Cantrell ..... B60R 22/00
2012/0235455 A1 * 9/2012 Maassarani ..... A47C 7/383 297/250.1
2014/0130465 A1 5/2014 Rodriguez

FOREIGN PATENT DOCUMENTS

EP 0974549 A1 1/2000
FR 2992868 A1 1/2014
WO 9852866 A1 11/1998
WO 2004074166 A2 9/2004
WO 2013001104 A1 1/2013

OTHER PUBLICATIONS

Hoe onveilig is Ruitersport [How unsafe is horse riding]. N. Nijland, P den Hertog. P. van Ommeren, Stichting Consument en Weiligheid, Amsterdam 1997m ISBN 90-6788-218-6.

* cited by examiner

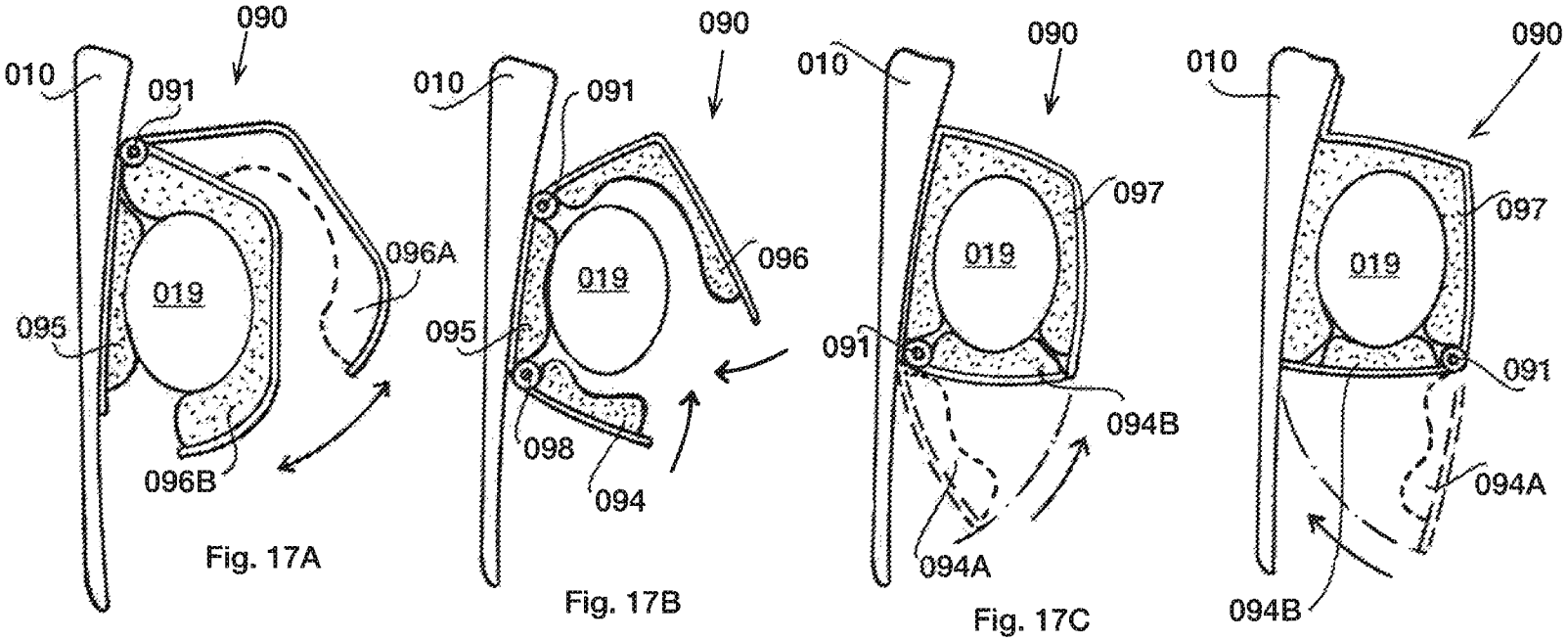
Fig. 17D
Fig. 17C
Fig. 17B
Fig. 17A
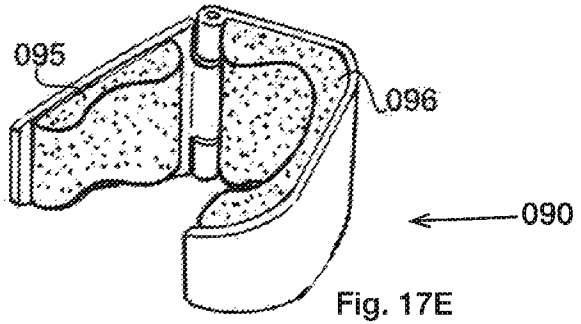
Fig. 17E

HORSEMAN-SECURING DEVICE, SADDLE, AND SADDLE SECURING DEVICE FOR PREVENTING A HORSEMAN FROM FALLING OFF A FOUR-LEGGED ANIMAL

CROSS-REFERENCE TO RELATED APPLICATION

The present application is a national stage of and claims priority of International patent application Serial No. PCT/NL2015/050521, filed Jul. 15, 2015, and published in English the content of which is hereby incorporated by reference in its entirety.

BACKGROUND

The discussion below is merely provided for general background information and is not intended to be used as an aid in determining the scope of the claimed subject matter.

The disclosure relates to a horseman-securing device configured in order to at any rate at least substantially prevent a horseman sitting on the back of a four-legged animal from falling off or at any rate from being able to fall off the animal, comprising securing device of which the horseman is releasably secured to the animal when the former are in use. The term "at any rate at least substantially prevent a horseman seated on the back of an animal from falling off the animal" is explained in detail in this document in order to clearly distinguish the securing device from known devices which secure a horseman to either an animal or saddle, but in which case the horseman is then no longer able to carry out all equestrian movements which are necessary or desired for riding. By contrast, the securing device is configured in such a way that the horseman remains able to carry out all the movements he desires or is required to perform in order to ride a horse. In addition, the securing device provides an improvement of the passive safety of the horseman and a so-called "high-tech" saddle.

The term releasability of the securing arrangement in this document is understood to mean that an average horseman has to be able to actively disconnect the securing arrangement while riding an animal by means of a respective action. As long as the horseman or another person does not perform such an action, the securing arrangement has to remain in place. To denote this, the term "semi-permanent" is used in this document. Thus, this is understood to mean permanent, in particular while riding, but intentionally releasable by means of a respective releasing activity. It is possible for a semi-permanent securing device to be attached permanently to the horseman (or at least to his gear) or to the animal (or at least its auxiliary means, such as a saddle) and semi-permanently to the animal or the horseman, respectively.

An animal which is ridden or at any rate to be ridden is usually or will usually be provided with a girth, to which for example a saddle is attached. A girth is a strip or any other aid which is or at any rate has to be fitted semi-permanently around the back and belly of an animal for fastening objects, such as a saddle and/or stirrups, to the animal. An aspect of the invention is based on, and is essentially described in the context of, riding a horse, but it is of course readily possible to use the securing device when riding other four-legged animals, such as donkeys, camels, elephants and other animals which are used for riding. Where mention is made in this document of a horse, this may be interpreted as any desired four-legged riding animal unless specifically mentioned otherwise. Where mention is made in this document of the horseman, this may be either a horseman or a horsewoman, adult or child, and where mention is made of "he" or "him", this may also be replaced by "she" or "her".

Riding four-legged animals, such as horses, is very popular. The risk of a horseman falling off a saddle on a horse is therefore a very real one. This is largely due to the unpredictable behavior of a ridden horse, for example caused by its reaction when it is startled. However, inexperience of a horseman may also cause a startled reaction. The behavior of the horse may for example result in the horse suddenly stopping or a sudden sideways movement or a sudden acceleration by the horse. Most of the known saddles do provide sufficient support and grip for a horseman during riding, but do not reduce the risk of falling to a sufficient degree. This is illustrated by the number of injuries which horsemen suffer from each year and which result from falling off a horse.

If we now analyse the reasons why a horseman usually falls off his horse, then in most cases this will turn out to be a movement in which the horseman's knees lose contact with the horse or saddle in an upward, lateral, forward or backward movement. In general, this will not be a downwardly directed force, since the movement of the horseman then stops at his backside. On the other hand, the horseman himself exerts a downwardly directed force when he raises his backside from the saddle, as he does, for example, when "light riding", where the horseman exerts a downward pressure on his legs and stirrups, provided he uses stirrups. If the horseman is attached to the saddle at, for example, knee level, he will exert a downward pressure on his knees during "light riding". Therefore, measures which are to ensure that the horseman does not fall from his horse or saddle will have to be focussed on restricting the movements of the horseman in at least a number of said directions, and in particular in directions which are not required for standard equestrian movements. However, in practice, the backwardly directed force exerted on the horseman will be the force which is least frequent, as this will only occur during a sudden acceleration or rearing of the horse, or when riding a steep slope. Usually, when the horse suddenly stands still, the force is directed forwards. While purely lateral forces which are exerted by the horse may lead to one limb coming away from the saddle, they will cause the other limb to be moved towards the saddle. It is therefore advantageous if the horseman moves into and out of a securing element via a substantially downwardly and/or rearwardly and/or sidewardly directed opening and exit.

Whereas, from the point of view of safety, the horseman should thus remain on the horse, this should, on the other hand, not hinder the freedom of movement of the horseman, which he requires in order to be able to perform all the movements which are necessary or desirable in most forms of horse riding. With regard to these movements, these can be distinguished into movements caused by the "gaits" of the horse, being the movements of the horse, the position of the horse, which is understood to be the angle at which the horse is with respect to an imaginary horizontal base surface, and the giving of "aids", being the cues given by the horseman to the horse, and in this context in particular by means of his lower legs and feet.

If we now analyse the seat and movements of the horseman during different ways of riding, which usually also involve different speeds (also referred to as "gaits") and positions of the horse, then we arrive at the following summary.

When the horse is on a horizontal surface and stands still, walks, trots, tölts or gallops, with the horseman continuing to remain on or in the saddle, also referred to as "riding a sitting trot", the horseman will be in direct contact with the saddle by means of his backside and the inside of his thighs and knees, and possibly also the cranial part of his lower legs. In this application, the terms "cranial" and "top" are understood to mean the direction of the head of a horseman who is seated upright on a horse situated on a horizontal surface. The terms "caudal" or "bottom" are understood to mean the direction of the feet of a horseman who is seated upright on a horse which is situated on a horizontal surface.

The term "inner side" is understood to mean that side which is turned towards the horse and the term "outer" is understood to mean the side which is directed away from the horse.

The saddle usually consists of a seat portion, referred to as saddle seat in this application, the top side of which is turned towards the backside of the horseman, and the bottom side of which is situated on the back of the horse, and one or two so-called saddle flaps on both sides of the horse, usually on both sides of the horse, directly connected to or starting from the saddle seat, situated on the back and/or rib cage of the horse. The saddle is held in place by the girth which runs around the belly and/or rib cage of the horse, from one side of the saddle seat to the other side of the saddle seat. In most cases, the stirrups are connected to the saddle seat on both sides by means of stirrup leathers, in which the feet of horsemen are situated during riding. In most cases, the saddle flaps can be lifted and are not directly connected to the girth in order to be able to manipulate the stirrup leathers situated underneath. A minority of saddles are designed in such a way that the flaps cannot be lifted and are fitted on the horse at the same time as the girth.

If we analyse the position of the horseman, viewed from the side, on a horse which is situated on a horizontal surface, in which case the front side is deemed to be the side where the head of the horse is situated, and the rear side is deemed to be the side where the tail of the horse is situated, and the right-hand side is deemed to be the right-hand side of the horse seen from the perspective of a horseman sitting on the horse and looking to the front of the horse, then we arrive at the following analysis. When the horseman is in the seated position and the horse is standing still, walking, trotting or galloping and situated on a horizontal surface, the upper body of the horseman will appear to be in an approximately perpendicular position with respect to the ground, i.e. will be at an angle of 90 degrees with respect to the horizontal baseline to an observer who is located on the right-hand side of the horse and horseman. Seen from the top to the bottom, a straight perpendicular line of 180 degrees can be drawn downwards through the body of the horseman. The thigh of the horseman pivots at the hip at an angle of approximately 135 degrees at the front and 225 degrees at the back with respect to the upper body, while the thighs pivot with respect to the lower leg in the knee joint, again at an angle of approximately 225 degrees at the front and 135 degrees at the back, with the lower leg in turn hanging down again at right angles, also with a perpendicular line of 180 degrees. All said degrees are approximations and may vary, depending on the build of horseman and horse, gaits of the horse, riding style of the horseman, and vertical position of the stirrups.

In this seated position, it still has to be possible for the horseman to give the horse cues by means of his lower legs, also referred to as "leg aids", which generally consists of moving one or both lower legs backwards. This movement thus comprises a pivoting movement of the lower leg with respect to the thigh, which takes place in the knee joint. This pivoting movement will generally not be more than 45 degrees, with the lower leg in the knee joint making an angle of approximately 90 degrees at most with respect to the thigh on the rear and an angle of approximately 270 degrees at the front.

This concludes the discussion of the position of the horseman in the seated position during said gaits of the horse which is situated on a horizontal surface. However, a horse may also go up or down a slope or jump over an obstacle. When the horse goes up a slope or jumps up to clear an obstacle and the horseman remains in the saddle, the stirrups will move relatively to the rear and the lower legs will generally make a smaller angle (90 degrees) at the rear of the knee with respect to the thighs, similar to that described above for giving leg aids. In case the horse goes down a slope or jumps down from an obstacle and the horseman remains seated, the stirrups will move relatively to the front and the horseman will generally want to extend his lower legs to the front, with the lower legs, at worst, assuming a position in which they are in line with the thighs. To an observer who is situated on the right-hand side of the horse and horseman, the lower leg will in that case make an angle of approximately 180 degrees with respect to the thigh. In all these situations, the lower leg of a horseman will thus at most be able to move approximately 45 degrees to the rear and 45 degrees to the front with respect to the thigh, resulting in a total pivoting movement in the knee of approximately 90 degrees.

This concludes the discussion of the position of the legs of the horseman in all cases where he remains completely seated in the saddle, in this context defined as all positions of the horseman in which his backside, including the cranial upper and inner part of his thighs, remains in direct contact with the saddle seat (strictly speaking the top side thereof) and optionally the cranial top part of the flaps of the saddle.

However, there are a number of gaits in which the horseman cannot remain completely seated in the saddle or does not want to. Thus, the horseman may want to "light ride", also referred to as "English trot", or come out of the saddle during a racing gallop or when jumping over obstacles. In all these cases, the horseman will move his upper body upwards and in many cases also forwards, that is to say he will perform a rising movement, while his backside and optionally also the cranial part of his thighs will completely or partly lose contact with the saddle seat and optionally the cranial upper part of the flaps. This rising movement by the horseman is made possible by the thighs of the horseman pivoting in the knee joint with respect to the lower legs. Although this pivoting movement will generally be limited in the case of light riding and a racing gallop, in the case of jumping it may eventually lead to a position of the horseman in which his upper body may be more or less parallel to the neck of the horse and the thighs may be in a completely straight position with respect to the lower leg, in which case these may form a straight line (180 degrees) with respect to each other.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the invention is to releasably secure the horseman to the horse and at the same time retain or enable all said equestrian movements. This is in contrast to the other methods known from the state of the art which secure the horseman to the horse and in which the abovementioned equestrian movements are no longer possible.

Embodiments of the invention enable the horseman to be secured temporarily to the horse, but also allows freedom to pivot his knees during light riding when trotting in such a way that that he can lift his backside from a position in which his backside is in complete contact with the back of the horse to a position in which his backside is no longer in complete contact with the back of the horse, and back again to the starting position. Whereas when the horse is going down a slope or jumps over an obstacle, the horseman will want to be able to pivot his knees in such a way that he can place his lower legs in line with his thighs, so that his lower legs are in a (virtually) straight position with respect to his thighs. Whereas, when the horseman wants to give his horse leg aids, such as spurring on, then the horseman wants to have the freedom to pivot his knee joints in such a way that he can move his lower legs to the rear with respect to the perpendicularly downwardly directed starting position and back again to the starting position.

Racing gallop is a separate form of horse riding and in particular in the way it is practised by jockeys during horse races. The jockey uses extremely short stirrups, on which he stands, in which case his lower legs make much more contact with (the flaps and optionally the seat of) the saddle than is the case with the other above-described forms of horse riding. A jockey therefore gives hardly any aids by means of his lower legs, if any, and makes more use of his whip. In the case of a jockey, the securing device described in this application will thus, possibly with some slight modifications, be more relevant to his lower legs, much more so than is the case with other horsemen.

The idea of being attached to a bolted horse, or at least a horse which could bolt, is not as unappealing as it may seem at first glance. Research has shown, that more than half the injuries sustained during horse riding are the result of a horseman falling off the back of a horse. In addition, the injuries resulting from such a fall are relatively severe (Hoe onveilig is Ruitersport [How unsafe is horse riding], N. Nijland, P den Hertog, P. van Ommeren, Stichting Consument en Veiligheid, Amsterdam 1997, ISBN 90-6788-218-6). In nearly half (47%) of the cases, the fall from a horse results in a fracture. Most of the injuries to the brain (56%) and the skull (57%) are the result of a fall from a horse. In only a small number (7%) of cases the injury is caused by a horseman becoming trapped under his horse. This may inter alia be explained by the fact that a horse hardly ever falls. Although it may not seem like a pleasant experience to be stuck on a bolted horse, it is not such a bad alternative from the point of view of the injury risk when compared to falling from a horse.

Various injury-limiting features are known for preventing or limiting injuries to a horseman when a horse makes an unexpected sudden movement or when the horseman loses control of a horse. These include among others caps, safety stirrups which open in emergencies and release the foot of a horseman, body protectors and even airbags.

According to a first aspect, a horseman-securing device according to the preamble, which, in use, can considerably reduce the risk of falling for a horseman, preferably to virtually zero and at the same time maintains the freedom of the horseman to make all riding movements which are desirable, necessary or possible. The securing device by means of which the horseman is releasably attached to the animal in use is configured to provide the horseman who is secured to the animal the freedom of movement to rise from a position in which his backside is in complete contact with the back of the animal, or indirectly via the saddle, to a position in which the backside of the horseman is not in contact with the back of the animal, at least not completely, or indirectly via the saddle, and back again to a position in which the backside of the horseman is in complete contact with the back of the animal, or indirectly via the saddle.

Since horsemen who light-ride a horse which moves along a horizontal surface will generally want to allow their lower legs to hang perpendicularly downwards, an aspect of the invention provides for the horseman who is releasably secured to the animal to retain the freedom of movement to be able to pivot the knee joints of his lower legs which hang straight down between a bent position of the knees, corresponding to a position in which the backside of the horseman is in complete contact with the back of the animal, or indirectly via the saddle, and a straighter position of the knees, corresponding to a position in which the backside of the horseman is not in contact with the back of the animal, at least not completely, or indirectly via the saddle, and back again to a position in which the backside of the horseman is again in complete contact with the back of the animal, or indirectly via the saddle.

Stated another way, the horseman to be able to contact the flanks of the animal with the inner side of his knees which faces the horse in a freely moving manner, or indirectly via the saddle or girth, and for the knee pivot joints of the horseman to retain the freedom of movement to allow the horseman to move between said first and second backside position, but also for the horseman to retain the freedom of movement to give the animal leg aids and to be able to move his lower legs from a first or bent lower leg position which is directed perpendicularly downwards to a second position of the lower leg which is directed still further to the rear compared to the first lower leg position, and back again to the perpendicularly downwardly directed first lower leg position. In addition, an aspect of the invention provides for the horseman to retain the freedom of movement to pivot his knee joint, for example when descending a slope or jumping over obstacles, in such a way that his lower legs can stretch with respect to his thighs (sometimes even in a forward direction), and back again to the perpendicularly downwardly directed starting position.

Thus, aspects of the invention can be summarized as follows:

A horseman-securing device configured to prevent a horseman who is sitting on the back of a four-legged animal from falling off the animal, comprising a securing device by means of which the horseman is releasably securable to the animal, wherein the securing device is configured to secure the horseman secured to the animal in such a way that the horseman retains the freedom of movement to pivot his knee joints in such a way that:

a) the horseman can rise from a first backside position in which the backside of the horseman is in complete contact with the back of the animal, or indirectly via the saddle or girth, to a second backside position in which the horseman has moved his backside upwards and forwards with respect to the first backside position, and in which the backside of the horseman is no longer in complete contact with the back of the animal, or indirectly via the saddle or girth, in order to move back to the first backside position, and b) the horseman can move his lower legs from a first lower leg position in which his lower legs hang perpendicularly downwards to a second lower leg position in which his legs are directed further to the rear compared to the first lower leg position, in order to move his lower legs back again to the first lower leg position.

Since the horseman cannot raise his backside without also raising his thighs, or at least the proximal part thereof, the invention also provides for the horseman who is releasably secured to the animal to retain the freedom of movement to rise between a position in which he contacts the back of the animal with his thighs, or indirectly via the saddle, corresponding to a position in which the backside of the horseman makes complete contact with the back of the animal, or indirectly via the saddle, and a position in which the horseman makes no contact, or at least no complete contact, with the back of the animal with his thighs, or indirectly via the saddle, corresponding to a position in which the backside of the horseman makes no contact, or at least no complete contact, with the back of the animal, or indirectly via the saddle, and back again to a position in which the backside of the horseman again makes complete contact with the back of the animal, or indirectly via the saddle.

The result to be achieved is a greater freedom of movement of a horseman who is secured to the animal than is the case with the fall-protection devices according to the prior art, which often limit the desired pivotability of the knees of a horseman.

According to another aspect of the invention, releasable fixation of the horseman while retaining maximum freedom of movement can be achieved with various embodiments by the securing device which makes such a freedom of movement possible. Due to the large number of alternative solutions, a number of which are described in this document, features cannot be more specifically defined without unnecessarily limiting its scope of protection.

In order to secure a horseman to a four-legged animal, such as a horse, an aid is usually required, such as a girth and optionally a saddle. As a horse to be ridden is generally saddled, aspects and features of the invention will be described below with reference to a saddled horse, in which case the horseman is (to be) secured to the saddle by means of the securing device. The scope of protection aims to extend this to situations, in which a horseman with such securing device is secured to a ridden animal directly via a girth or another aid. The term "saddle" can therefore also be replaced by "girth" or the like.

The securing device creates a semi-permanent securing arrangement between an animal and its horseman. It will be clear to the person skilled in the field of equestrian sport that man and animal cannot directly be releasably attached to one another in a reliable manner. In most cases therefore, the connection may equally well be made indirectly, that is to say that the securing device is not directly attached to an animal and/or a horseman. The securing device may be attached to the animal, for example via a girth and/or a saddle. Likewise, securing device may be attached to a horseman via the clothing or other gear of a horseman. However, the respective connection(s) will then have to be semi-permanent or be such that the connection(s) as well as the securing of/with the securing device will in principle remain intact in case of a great force due to the movement of the animal. The securing device can fall into one or more of the three categories below:

1) Firstly, according to a preferred embodiment of the invention, the horseman-securing device may completely or at least partly be provided on a saddle and/or girth which is attached to or at least attachable to the animal, at least in a situation in which the horseman is not secured to the four-legged animal, by means of which the saddle and/or girth are, in use, semi-permanently secured to the horseman or his gear, in which the horseman himself or his gear does not necessarily have to be specially configured for securing to a saddle. This type of securing device may be referred to as horseman-securing device in the narrow sense.

2) Secondly, according to a preferred embodiment of the invention, the horseman-securing device may completely or at least partly be attached to the horseman or at least to his gear, at least in a situation in which the horseman is not secured to the four-legged animal, by means of which the horseman or his gear is, in use, semi-permanently secured to a saddle which in itself does not necessarily have to be specially configured for securing a horseman. This type of horseman-securing device may also be referred to as saddle-securing device.

3) Thirdly, according to a preferred embodiment of the invention, there can be an assembly of mutually cooperating horseman-securing devices which, on the one hand, are partly located on the horse, the girth and/or saddle and, on the other hand, on the horseman and/or his gear, by means of which the horseman can be secured to the animal in a semi-permanent manner. This type of horseman-securing device may also be referred to as an assembly of a horseman-securing device.

The disclosure comprises each of these three starting points, that is to say that an embodiment may be based on one or more of said starting points.

In this case, it is preferred if the securing device is configured in order to provide the horseman secured to the animal the freedom of movement to pivot his knee joints, with his lower legs hanging straight down, between a bent position, corresponding to a position in which the backside of the horseman is in complete contact with the back of the animal, referred to as first backside position, and a straighter position of the knee joint, corresponding to a position in which the backside of the horseman does not make contact, or at least does not make complete contact, with the back of the animal, referred to as second backside position, at any rate not, at least substantially not, to impede this movement.

In addition, it is preferred if the securing device is configured such that the horseman secured to the animal is given the freedom of movement to move his lower legs by means of his knee pivot joints from a first perpendicularly downwardly directed lower leg position, referred to as first leg position, to a second lower leg position which is directed to the rear compared to the first lower leg position, referred to as second lower leg position, and back again to the first perpendicularly downwardly directed lower leg position, referred to as first lower leg position.

The position of the lower leg of the horseman with respect to the animal, saddle and girth depends in part on the position of the animal with respect to the ground. The lower leg of the horseman will generally hang perpendicularly downwards. Taking the position of the lower leg of the horseman on an animal on a horizontal surface as an initial neutral lower leg position, the lower leg of the horseman sitting on an animal which is situated on a rising slope or the upward part of a jump, will be situated further to the rear with respect to the animal, and sitting on an animal which is situated on a downward slope or downward part of a jump will be situated further to the front with respect to the animal. In all these positions of the animal, it is preferable, for the securing device to be configured in such a way that the horseman secured to the animal has the freedom of movement to move his lower legs by means of his knee pivot joints completely freely and unimpeded from a first perpendicularly downwardly directed lower leg position, referred to as first leg position, to a second lower leg position which is directed further to the back compared to the first lower leg position, referred to as second lower leg position, and back again to the first perpendicularly downwardly directed lower leg position, referred to as first lower leg position.

According to a preferred embodiment of the invention, the securing device is configured so as to fix the knee of the horseman secured to the animal with respect to the animal in the directions forwards and backwards, upwards and sideways, but to substantially not impede the pivoting movement of the knee joint in the knee.

The fixation helps to counteract a first movement of the body of a horseman during a sudden unexpected movement of the animal. This is due to the fact that a body of the horseman will, because of inertia, tend to continue to move away from at least the body of the animal. The fixation thus always keeps the animal and the horseman close together. Since the securing device however allows pivoting of the knee joint, the horseman is able to assume a desired position with respect to the animal and give the animal the desired aids using his lower legs, not only while riding the animal in normal circumstances, but also in emergencies.

It is furthermore preferred if the securing device is configured to allow a pivoting movement of the knee of the horseman with respect to the outer side of the saddle. Such a device gives the horseman the freedom to swing the lower legs backwards in order to thus give aids to. the animal.

In an embodiment, the horseman-securing device, at least in a non-secured position, is at least partly provided on a saddle and/or girth which is or at least can be attached to the animal. In this document, the expression (non-) secured position is understood to mean the position in which the horseman and the animal are (not) secured semi-permanently to each other by means of the securing device. Thus, the securing device is available to a horseman immediately after saddling an animal and no operations are required to attach the horseman-securing device to the saddle. According to this embodiment the horseman-securing device may be provided permanently or semi-permanently on the saddle or the girth.

In an embodiment, the securing device, at least in a non-securing position, is at least partly attached to the horseman or at least to his gear. Thus, the securing device, referred to as saddle-securing device earlier in this document, is available for securing to a saddle immediately after the horseman has put on his gear or his clothing and no operations are required to attach the saddle-securing device to the gear of the horseman. The securing device may in this case be provided permanently or semi-permanently on the gear or clothing of the horseman.

In an embodiment, the securing device, in use, comprises at least one securing element on either side of a horse, which grips around or at least can grip around a knee of a horseman. When a securing element has gripped around the knees of a horseman and this in such a way that the knees or at least legs cannot become detached from the securing element without an intentional action by the horseman or another person, a reliable securing device can thus be provided. The gripping securing device may be of the strip, clamp, open and close, or magnetic type.

In a preferred embodiment, the securing device, when used on either side of a horse, alternatively or additionally comprises at least one securing element which grips around or can grip around a thigh of a horseman. When a securing element has gripped around the thighs of a horseman and this in such a way that the thighs or at least legs cannot become detached from the securing element without an intentional action by the horseman or another person, a reliable securing device can thus be provided. The gripping securing device may also be of the strip, clamp, open and close, or magnetic type.

In a preferred embodiment, the securing arrangement of the securing device on the animal or a girth or saddle attached thereto, at least in use, is situated at the location of the pivot axle of the knee of the horseman. When the mutual securing arrangement of horseman and animal is realized virtually only at the location of the pivot axle of the knee of the horseman, the horseman is offered the possibility of pivoting his knee between a bent position when seated and a straight position when raised or standing up. Optionally, some play in the connection may be allowed, provided the play is situated in a location and to a degree which prevents the securing arrangement of the horseman on the animal from becoming detached in an undesirable manner, that is to say, without having intentionally acted thereupon.

In a preferred embodiment, the securing arrangement of the securing device, at least in use, is situated additionally or alternatively at the location of the thigh of the horseman, with additional features being provided to allow the knee to pivot. An advantage of a securing arrangement at the location of the thigh is that a relatively large engagement surface between horseman and animal is available, as a result of which a relatively strong securing arrangement can be achieved. A drawback of such a securing arrangement without additional features could be that the horseman might be limited in his raising movements between the seated and standing position. This is the case, for example, with the known hook and loop fastener between the thighs of a horseman and a saddle. This drawback can be overcome, by providing freedom of movement on the side of the animal, for example by fitting components to the animal which can be tilted and/or pivoted with respect to the animal, to which the thighs and/or the backside of a horseman can be attached.

Below, various types of horseman-securing devices are described. In these cases the type of semi-permanent connecting element is explained. The respective connecting element may on the other hand be attached permanently to either the (gear of a) horseman or animal. It is also possible for two identical or different types of (semi-permanent) securing elements to be combined in one securing device, for example two horseman-securing devices, two saddle-securing devices or a horseman-securing device and a saddle-securing device. The securing device may in this case be designed to be supplementary or complementary. If not specified in more detail, the securing device may serve for the complete or partial, separate or joint securing of the lower body, backside, thighs and knees of the horseman to the four-legged animal, but with features which give the horseman the freedom to raise his body from knee level and to pivot his knees. Securing the lower legs and optionally also the feet of the horseman to the four-legged animal is only possible if a movable feature is fitted which makes it possible for the horseman to give aids by means of his lower legs and feet. The applications of the securing device mentioned in this document for securing the lower body, backside, the thighs, knees and optionally also the lower legs of the horseman are in principle mutually exchangeable, albeit in some cases with slight modifications. Where mention is made in the text of a securing device of the knees, this may generally equally well be read as lower body, backside, thighs, and optionally also lower legs, and vice versa, unless this were for example physically impossible due to the position, shape or other characteristics of a securing device and the anatomy of the human body.

In an embodiment, the securing device comprises one or more strip-shaped securing elements which are configured in order to connect a girth and/or saddle and a horseman to each other. Such strip-shaped elements like straps, which may be provided with buckles, or ropes which are very suitable for a relatively simple and quickly releasable securing arrangement of a horseman to an animal, in which pivoting movements of the knee joint are not, or hardly, impeded, at least if such strip-shaped securing elements are only situated on the outer side of the knees of the horseman, and only have a limited height. Such strip-shaped securing device may optionally be connected (semi)permanently to the (gear of the) horseman or the animal and obviously have to be configured to make a semi-permanent securing arrangement possible. In this case, the securing arrangement can always be adapted to any different circumstances, such as the build of a horseman or animal, type of saddle, expected riding behavior.

In a preferred embodiment, the strip-shaped securing elements are, if they are configured for securing the knee of a horseman, be wider at the front side than on the rear side. A strip, or strips, can then cover the entire kneecap of the horseman on the front side or can be arranged above and below the kneecap, while a relatively narrow strip part is arranged in the hollow of the knee. This increases the comfort for a user. The strip-shaped elements, which by their nature are flexible, may be provided with stiff, for example metal or plastic, aids. A strip, or several strips, can then cover the entire kneecap of the horseman on the front side or can be arranged above and below the kneecap, while a relatively narrow strip part is arranged in the hollow of the knee, in the form of a small cylinder or cone. When using several strips, the spaces between the strips can be filled with filler materials, such as for example textile, leather, plastics or other materials. This increases the comfort of a user.

By way of example, strip-shaped securing elements may, in so far as they are used for securing the knee of the horseman, be situated around the entire knee, but according to the invention it is advantageous if the strip-shaped securing elements are only situated on the outer side of the knee without in this case impeding the pivoting movement of the knee. This is achieved by allowing the strip-shaped elements to enclose the knee only on the outer side, being all sides except the side facing the horse or saddle and only at a small height (at most a few centimetres), with the thigh and lower leg being left free as much as possible. The kneecap (patella), being a relatively stationary part of the knee, can in that case be enclosed on the outer side. If the strip-shaped elements are used on parts of the body other than the knee or are used to enclose the knee to a greater degree, additional aids, such as described in this application, are required to achieve the freedom of movement of the knee according to the invention. The term strip-shaped elements is understood to mean strips, straps, tapes, ropes, wires, cables, string, bands and the like, in general elongate structures having a movable shape. All these kinds of securing devices, optionally provided with a hook and loop fastener, are in this text referred to by the term "strips" or "strip-shaped elements". Such strip-shaped elements may be made of many kinds of material, such as metal, plastics, textile, natural products such as rope and leather, rubber, and the like, and combinations thereof. Such strip-shaped elements may be pulled tight and be fixed under tension, for example by configuring them as straps with buckles, or strips with clamps, or by providing the strips with a hook and loop fastener, as a result of which the strips are very suitable for a relatively simple and quick securing operation.

Such strips will generally be attached on one side of the body part to be fixed on the saddle and then run around, or preferably on the outer side of the body part to be fixed, in order to be attached on the other side of the body part to be fixed on the saddle, or to be passed through an optionally closed eyelet in order to be attached to itself. Securing the strips to the girth or saddle may be achieved in many ways, for example by attaching these to optionally closed, or open, or openable, hooks, eyelets, bayonet fastenings, rings and the like, or by connecting these in a fixed manner, at least on one side, to the girth or saddle. If the strip-shaped elements are connected to the deeper structures of the saddle or the girth, they can also be passed through openings or passages in the saddle seat or flaps of the saddle. The direction in which such a strip runs may be reversible. It is also possible for several strips to be used from either side of a body part.

In the case where the entire torso of the horseman is fixed with strips, this will often be a strip which is situated around the waist of the horseman, with this strip then for example being connected to the saddle at the front and/or rear side of the horseman. A safety harness, waistcoat or trousers and the like which are also fixed by strips, is in this context also deemed to be a strip-shaped securing element.

The strip-shaped elements which are flexible by their nature may be provided with semi-stiff, for example plastic, clamping aids, which may be arranged around the strip, with the strip thus extending through the aids, or they may be arranged on one side of the strip, preferably on the inner side which faces the horseman. If such aids are the mirror image of the outer side of the body part to be fixed, they can function as a clamping structure on the outer side of the body part to be fixed. By making these aids hollow or by making the outer side of the aid double-walled, the strip can be fitted through the aids, so that the clamping structure presses against the outer side of the body part to be fixed after the strip has been pulled tight.

Strip-shaped securing devices may equally well form part of an assembly which, on the one hand, is situated on the saddle and, on the other hand, on the horseman or his clothing. It can be advantageous if such clamping structures fixed with strips fit between a number of thickenings, for example two, which may be provided, for example, on the outer side of the clothing of the horseman. Thus, the horseman may, for example, wear a knee sock which comprises thickenings at the top and bottom side of the knee, in any case on the outer side thereof, which run more or less horizontal or slightly obliquely, between which the strip-shaped securing device, which may itself also have been thickened, then fits exactly. It is also possible for there to be a thickening externally on the clothing of the horseman which runs more or less horizontal or slightly obliquely, with two strip-shaped securing devices being provided on either side of this thickening, for example from the saddle. It is also possible for a strip to be provided from the saddle over such a thickening on the clothing of the horseman on the outer side of the body part of the horseman to be fixed, which strip has a (length) opening which fits exactly over the thickening which the horseman is wearing.

It is also possible for a thickening with a cavity, groove, recess or an optionally closed ring to be present on the clothing of the horseman into which the strip-shaped securing element fits and/or passes through exactly.

When a strip-shaped hook and loop fastener is used on the outer side of the knee or in combination with other measures mentioned in this application which fulfil the invention, then the hook and loop fastener has the advantage that it does not per se require additional closing and opening mechanisms, because the two types of hook and loop fastener, when used in the correct manner, make closing and opening of the strip according to the invention possible. In addition, a hook and loop fastener may be used as a closing and opening mechanism and as an additional securing material with many of the other securing techniques, such as mentioned in this document. Thus, for example, the inner side of a tubular securing element, to be discussed below, may be provided with a type of hook and loop fastener, and a limb of the horseman or his clothing with the other type of hook and loop fastener, so that, when the limb is in the tube, it is connected thereto in a strong and releasable manner.

In a preferred embodiment, the securing device comprises annular or tubular securing elements in which, in use, a limb and/or the lower body of a horseman is accommodated. Tubular elements are very suitable for accommodating, for example, a leg or a leg part of a horseman. In addition, tubular elements of a flexible type can be modified to be closely fitting to a leg of a user, so that they are comfortable. If the tubular elements are of a (relatively) stiff type, they may also serve as a so-called passive protection against bumping into objects during riding.

When used for securing the knee, it will be sufficient if the annular or tubular securing element is only provided over a limited height at the location of the knee, as has been described above for the strip-shaped securing elements. If the annular or tubular securing elements are used over a greater height around the knee, or around the entire or part of the thighs, then further features will have to be used to maintain the pivoting movement of the knee. Such a hinge may consist of a transverse pin, which, at knee level, allows the annular or tubular securing element to pivot with the saddle. In this case, it is possible to additionally or alternatively use several, more cranially positioned additional transverse pins between the annular or tubular securing element and the saddle, or the flaps thereof, in which case either the pin(s) start from the saddle and one or more optionally adjustable radial opening(s) or recesses are present in the annular or tubular securing element, or the pin(s) start from the annular or tubular securing element and optionally adjustable radially formed openings or recesses are present in the saddle inside which the pins move. It is also possible to retain the freedom of movement of the horseman by combining the annular or tubular securing elements with the pivotable or tiltable saddle to be described below.

For use with the invention, tubular elements in which an arc at the front and/or rear side of the horseman can connect the tubular elements which are present on both sides to each other are very suitable for accommodating, for example, a leg or a leg part of a horseman. These tubular elements may also be extended downwards and/or upwards by extension parts which are optionally telescopic and are optionally adjustable in the forward and backward direction. If these extension parts are directed upwards, the (lower) back and/or the abdomen or belly of the horseman can be accommodated therein. Once such (lower) back and abdomen or belly parts have been connected around the legs of the horseman by means of the tubular elements, essentially a pivoting pair of trousers or pivoting body clamp is created, between which the lower body of the horseman is clamped at the front and rear side with his lower body and limbs in annular or tubular securing elements. The horseman can then, for example, step into and out of these pivoting trousers or this body clamp via lateral longitudinal openings, while the freedom of movement of the equestrian movements remains ensured by means of the above-described pivots at knee level or slightly above.

Annular or tubular securing elements may be configured as a completely closed ring or tube, or as an interrupted ring or tube, in which for example the ring or tube contains an opening on the outer side in the length direction, as a result of which the horseman can step in and out laterally. With such tubular elements, it is also possible for the free walls of the tube to overlap each other, so that the outer wall of a tube part is covered by the inner wall of the other tube part. In this case, there may be one or more interruptions, in which case it is possible, to regard the lateral side of the saddle as a part of the ring or tube. Such an embodiment will be able to ensure the optimum contact between the inner side of the knee and/or thigh of the horseman and the lateral or outer side of the saddle or the flaps thereof. Such an embodiment may consist, for example, of the lateral side of the saddle with, at the front and rear side thereof, more pronounced annular or tubular parts, with, at the lateral side thereof, a length opening, which can be opened and closed. Combinations of different materials which together form the tube or ring are possible according to the invention. The ring or tube itself may serve as closing and opening mechanism of such securing elements, for example if the former is configured to be bendable, deformable and/or spring-mountable and/or pivotable, but an additional strip-shaped securing device, including a hook and loop fastener, or other generally known opening and closing mechanisms may serve as closing and opening mechanism.

In a preferred embodiment, the securing device alternatively or additionally comprises at least a securing element which grips around or can grip around all of or part of the thigh of a horseman. When a securing element has gripped around the thighs of a horseman and this in such a way that the thighs or at least legs cannot become detached from the securing element without an intentional action by the horseman or another person, a reliable securing device is thus provided. The gripping securing device may also be any type of securing element described in one of the paragraphs above, or combinations thereof.

In a preferred embodiment, the securing arrangement of the securing device, at least in use, is additionally or alternatively at the location of the thigh of the horseman, with additional features being provided to enable the knee to be pivoted.

The advantage with a securing arrangement at the location of the thigh is that a relatively large engagement surface is available between the horseman and the animal, as a result of which a relatively strong securing arrangement can be achieved.

In a further embodiment, the securing device comprises fixing devices which are configured to fix to a thigh of a horseman. The thigh is a strong body part which can relatively easily be gripped and which requires less freedom of movement in order to give aids. In addition, the thighs of a horseman of an animal are relatively close to the sturdy seat of a saddle, so that a strong securing arrangement is possible.

In a preferred embodiment, the fixing device comprises a tubular element which, in use, grips around a thigh of a user. A tubular element can easily be fitted around at least the thigh of a horseman as a trouser leg by putting it on. If desired, it can alternatively or in addition be pulled tight around a thigh.

In an embodiment, the tubular element runs slightly conically, with the diameter of the part turned to the knee being smaller than the diameter of the part turned away from the knee. Thus, the tubular element adapts well to the shape of a thigh.

In an embodiment, the tube element has an uninterrupted diameter, thus resulting in an integral sturdiness.

In an alternative embodiment, the tube element has an interrupted diameter. Thus, the tubular element may be configured as an element which can be pivoted open, zipped open, folded open or tilted open or opened and closed in another manner, as a result of which it can be fitted around a leg from the side and can then be closed and locked. This provides the possibility of providing an unlocking means, by means of which the securing arrangement between horseman and saddle can be released in a relatively simple manner. With this embodiment, as well as in other embodiments, the release may take place separately from the tubular element.

In an embodiment, pivoting element is provided in order to open and close the tube element by pivoting.

In a preferred embodiment, two such tube elements are provided, one for each thigh, and both tube elements are connected to each other, preferably on the top side of the tube elements.

One such connection between the two tube elements on the top side may be configured as a direct continuation of the tube elements, but also as an adjustable and fixable telescopic part or telescopic parts of the two tube elements. The adjustability will then not only be in the longitudinal direction, but could also be in front backward direction, so that the upper part or the upper parts fit(s) closely around the lower body of the horseman.

In a preferred embodiment, an apron is provided which, in use, extends in front of the hip of the horseman. An apron may serve only as a connecting means, but may (also) provide passive protection against impact on the lower body.

The horseman may, if desired by means of additional techniques, be attached closer to such an apron, for example by making use of strip-shaped securing elements, hook and loop fastener or safety belts and the like.

In a preferred embodiment, the saddle-securing device comprises an abdominal support. The support may serve to counteract an abrupt forward movement of a horseman, but according to the invention also to offer passive protection of the lower body.

In a preferred embodiment, the saddle-securing device comprises a support for the lower back. The support may serve to counteract an abrupt backward movement of a horseman and to provide passive protection of the back according to the invention.

If such tubular securing elements enclose thighs and lower body of the horseman, optionally including the knees, and if these tube types are then configured so that they are open or can be opened and closed in the longitudinal direction on both sides, a kind of clamping trousers or body clamp are/is created. If, moreover, such an embodiment is also configured to pivot, for example by fitting a pivot axle at the location of both knees, a kind of pivotable or clampable trousers or pivoting body clamp are/is created.

In an embodiment, the securing device comprises securing elements of the hook-and-eyelet type which can be brought into engagement with each other, in which case, in contrast to the hook and loop fastener, one or a few hook-eyelet connections suffice to produce a releasable securing arrangement according to the principle of the invention. Securing elements of the hook-and-eyelet type can easily be configured as quick-action securing arrangement and may also be used, if desired, quickly releasing the securing arrangement.

In another embodiment, the securing device comprises securing elements of the clamping type, which, in use, clamp around a limb of a horseman. A clamping connection may be configured as a quick-action connection, so that it is possible to secure a horseman quickly to an animal.

In this case, the pivoting movement of the knee can generally be retained if the clamping securing element is arranged at only a limited height on the outer side of the knee, such as for example described above for the strip-shaped securing elements. In sofar as the clamping securing element is used at the location of the entire or part of the thigh, further measures will have to be used to ensure that the knee pivot movement can be performed, as described above for the annular or tubular securing elements or for the pivotable or tiltable saddle described below. A clamping securing element may have several embodiments. Essentially, the above-described securing device such as the strip-shaped securing elements, optionally in combination with a (clamping) aid, the annular or tubular securing elements, and the securing elements of the hook-and-eyelet type, may all in a certain sense be configured as clamping securing elements. Clamping securing elements can actually clamp a body part completely or partly by means of a pivotable or deformable clamping structure, a bendable bar-shaped clamping structure or a displaceable clamping structure. The axis of such a hinge will generally extend in the longitudinal direction or parallel to the longitudinal axis of the body part to be clamped.

The clamping structure may comprise a pivotable clamping structure, configured, for example, as a securing element consisting of a more or less fixed shape of the clamping structure, which can be closed and opened by means of a hinge. Such a securing element of the clamping type may be situated, for example, on the front side of the knee of the horseman and may close around the front side, lateral side and rear side of the knee. Such a pivotable embodiment of the invention may have the characteristics of a ski binding and be provided with similar techniques, in which the hinge, in use, remains closed, but can intentionally be opened actively by the horseman or another person.

The clamping structure may comprise a deformable clamping structure, for example configured as a securing element consisting of a more or less fixed shape of the clamping structure, which can be closed and opened by means of deformation. Deformable materials may be made of deformable, optionally flexible, materials, such as bendable metal alloys, memory metal, such as Nitinol, bendable plastics, and the like.

If, such a pivotable or deformable clamping structure is situated at only a small height on the outer side of the knee, the pivot function of the knee can be retained.

The clamping structure may comprise a bendable bar-shaped clamping structure, for example configured with deformable bars, tubes, thick wires or pipes or the like, which can be fitted around or on the outer side of all of or part of a body part of the horseman by being deformable into an open and closed position. For the sake of convenience, such embodiments are referred to in this document as "rods", which are generally made of bendable, optionally flexible, materials, such as bendable metal alloys, such as tin, memory metal, such as Nitinol, bendable plastics, or the like. Such a clamping structure may consist of one or more such bars and may be fitted on one or more sides of the body part of the horseman, thus forming one bar or a cage. Such a bendable bar may also consist of a number of separate elements which are connected with each other in such a way that they are movable with respect to each other, but in which the elements can be fixed with respect to each other in a certain position, for example by tightening a steel wire which has been passed through these elements and locking it, as a result of which the elements move towards each other. In order to retain the pivot function of the knee, only a single bar may be fitted on the outer side of the knee, or one or more bars, as long as these only cover a limited height of the knee. A single bar may have extensions made of other materials which cover or comprise a larger part of the body part than the diameter of the bar. Such extensions may also be present between several bars or start from several bars. The bendable bar-shaped clamping structure may be bent by the horseman or someone else using a different force to the one which has to retain the bending structure to prevent the horseman from falling off his horse.

The clamping structure may be configured in the form of securing elements consisting of thickenings or pressure points which are situated on either side of the body part to be clamped, which thickenings can be moved from and to the body part in order thus to clamp the body part. At least two thickenings or pressure points are thus required, with the shape of the thickening or the pressure point depending on the body to be clamped. Thus, for example, when clamping the knee, this clamping may be effected between two round thickenings or pressure points, one at the front and one at the rear side of the knee. But it is also possible to use a concave structure on the front side against the kneecap (patella) and a more conical structure on the rear side in the hollow of the knee. In this case, it is possible for both clamping structures employed to be displaceable, but it is likewise possible for only one of the two clamping structures to be displaceable, for example only that one which is situated in the hollow of the knee, while the structure at the front side has a fixed location on the saddle. A combination of more than two clamping structures is also possible. Thus, in the case of the knee, it is readily conceivable to use separate clamping structures on the front side above and below the kneecap (patella) and one clamping structure on the rear side. Displacing, and thus closing and opening, of one or more clamping structures may be effected according to the invention by means of, for example, adjustable guide rails, but the control of several clamping structures simultaneously could also be effected very well by means of a system of cogwheels which is controlled by a turning knob or key.

The securing device may comprise securing elements comprising an assembly of fixed protrusions and recesses. In this case, the securing system comprises, on the one hand, ancillary means with recesses and, on the other hand, ancillary means with protrusions, in which the one kind of ancillary means is situated at the location of the saddle and the other kind at the location of the horseman, or are fitted on the clothing of the horseman. Thus, for example, "female" structures may be arranged on the saddle at the front side and rear side of the knee of the horseman to be fixed, which structures are hollow in the direction of the knee and are open on the lateral side, such as an open hand, or cavities in or on the saddle. If a "male" thickening is arranged on the knee of the horseman or the clothing of the horseman, either in a fixed manner or in a removable manner, in the form of a knee supporter or stocking on the front and rear side of the knee, the shape of which fills the open space exactly as the above-described female part on or in the saddle, then the horseman, approaching laterally, can slide his knees into the receiving parts, thereby securing his knees to the saddle. In this case, closing and opening techniques may optionally be used, but in many cases this will not be necessary, provided it has been well executed. It is in this case again important that the securing arrangement is preferably situated on the outer side of the knees and over a limited knee height in order not to impede the pivoting movement of the knee. The "female" and "male" parts may of course also be fitted and used the other way around. The shape of the "male" part and the respective "female" part may vary and does not always have to be round. Also, the "entry" of the connection does not always have to be oriented exactly laterally and may, for example, also be used in another direction, although a laterally and/or rearwardly directed entry seems attractive. This is due to the fact that a horse jumping sideways may possibly release one limb of the horseman in the lateral direction, but not two limbs simultaneously.

An advantage of such a securing device is that the horseman can slide the male parts into the female parts from, for example, one side, for example from the lateral side, with all other directions of movement being limited, whereas the horseman is able to free himself from the securing arrangement in a relatively simple way by performing the movement in the reverse direction. Since, in principle, no additional closing mechanisms are necessary with such a securing device and this embodiment still satisfies the securing arrangement and releasability of the invention, the horseman will have less of a feeling of being "locked up", as he can set himself free from the securing device at any moment without having to perform any further actions with his hands by performing the opposite movement to that by means of which he connected the assembly together.

In a preferred embodiment, the securing device comprises securing elements with an assembly of movable protrusions and recesses. Such an embodiment can best be compared to the workings of a ski binding. The securing system in this case consists of, on the one hand, thickenings or male parts, provided on a body part of the horseman or his clothing, and, on the other hand, movable receiving, female, parts which are preferably provided on the saddle, with the receiving parts having an open and a closed position. The ability to releasably open and close the connection is thus actually effected by the securing device itself. It is advantageous in this case if the force by means of which these receiving parts can move from a closed into an open position is preferably adjustable. It is advantageous if, in addition, the horseman or another person can open and close the receiving part, and better still both receiving parts, in a single operation. This may involve an assembly of a receiving female part which is provided on the front side of the knee on the saddle and a thickened male part which is provided on the front side of the knee of the horseman, with the knee being enclosed further by a fixed pressure point in the knee cavity. However, more than one assembly is also possible, such as for example two, with such an assembly being provided on the saddle and on the knee of the horseman, both on the front side and on the rear side of the knee. The receiving female part may in this case be configured in such a way that all or certain directions of movement are limited as desired, but other combinations of directions of movement are also possible. This embodiment is similar to a ski binding. The thickened male parts may in this case be provided on a limb of the horseman and be attached to the clothing of the horseman in a fixed manner or in a detachable manner, such as, for example, by means of an optionally elastic uninterrupted or interrupted knee sock. If, for example, two thickenings are provided on the knee of the horseman, for example on the front and rear side, then it is possible for both thickenings to be connected to each other, for example because there is a structural connection between both thickenings, for example on the lateral side of the knee.

According to the invention, it is advantageous if the assemblies on both sides of the saddle can be released and/or closed by one push of a button, which is situated, for example, on top of the saddle on the front side. Such control may be effected either in an electronic or mechanical way, by means of for example small steel cables.

In an embodiment, the securing device comprises an assembly of magnetic securing elements which, in use, form a magnetic connection to securing elements which react to magnetism. Thus, it is for example possible for there to be or to be created a magnetic field on the side of the horse, for example by means of electromagnetism, while the horseman is provided, optionally by means of clothing or otherwise wearable, with iron elements which are attracted by the magnetic field. To this end, the magnetic field has to be sufficiently strong in order to, in use, keep a horseman on his horse under all circumstances.

It is advantageous in this case if use is made of adjustable magnets, such as for example electromagnets or organometallic compounds. The horse may carry a power source, such as an optionally rechargeable battery, in order to energize the electromagnet, optionally attached to the saddle or removably accommodated in the saddle or connected thereto. In this case, use may be made of magnetism for opening and closing the securing arrangement by simply switching off or activating the power, for example by operating a button or switch. Such an electromagnetic securing mechanism can also be adjusted by means of the force of the magnetism.

It will be clear that if a saddle is provided with electric power, other power-consuming applications are also possible, as a result of which, a "high-tech" saddle is created with features such as, for example, lighting, heating or cooling for a saddle and/or a horseman or food and drinks, telephone, radio, TV, GPS, computer, internet, data reader and carrier, DVD player, CD player, loudspeaker, a monitor, a pressure pump, air blower, alarm, weather station, gyrometer, transmitter, etc. Such features may make it possible to give instructions to the horseman while he is riding his horse. It would be advantageous with such a "high-tech" saddle if the saddle is preferably provided with a small display, preferably comprising a touchscreen suitable for outdoor use, which is connected to the saddle, preferably by means of a movable and flexible arm, which preferably does not impede the limbs, including the hands of the horseman.

Various types of saddles are known for riding animals. Effectively, a saddle provides a reinforcement between on the one hand the backside, the thighs and the knees of the horseman, but also a protection for the back of an animal to be ridden. Known saddles have a saddle seat of leather or plastic which is fitted around the belly and/or rib cage of an animal by means of so-called girths. Furthermore, stirrups for the feet of a horseman are directly or indirectly connected to the saddle seat, usually by means of stirrup leathers. Saddles are often provided with thickenings and reinforcements in such a way that the risk of a horseman falling off the animal is reduced.

It is therefore an object of the invention, in contrast to known protective measures which aim to limit injuries from a fall, to provide a saddle with which or at least by means of which not only the risk of falling can be significantly reduced, but also maximum freedom of movement is provided for the horseman so that he can perform the equestrian movements which he wants to make. This object is achieved by the fact that the saddle is provided with one or more securing devices as described in this application. In a preferred embodiment of the invention, the securing device is directly or indirectly attached to a girth. The girth, in use, is fitted tightly around the body of an animal, whereas this does not have to be the case with other parts of a saddle. Due to the tight fit, the position of the horseman-securing device with respect to an animal is essentially defined. Preferably, the girth is in this case configured to be connected to the animal so as to at least be substantially immovable with respect to the animal. The person skilled in the art will know how to achieve this.

In a preferred embodiment of the invention, the securing device is attached to the saddle seat and/or flaps of the saddle. The saddle seat is a sturdy part of the saddle. Therefore, it is highly suitable for absorbing, via the securing device, forces which may occur during sudden or unexpected movements.

In an embodiment, the saddle or at least the saddle seat is or at least can be fixed with respect to the girth. With some types of saddles, the saddle seat parts can easily be lifted from the animal when the saddle is attached to an animal, separately from other "fixed" parts of the saddle which remain attached to the animal. In this case, this may increase the freedom of movement of a horseman to an undesirable degree. When the saddle seat is fixed to the girth, this risk is avoided, at least if the girth is configured in this case to be connected to the animal so as to be at least substantially immovable with respect to the animal.

In a preferred embodiment, the saddle comprises a securing device with a pivot element which is configured to allow the horseman-securing device to pivot at the location of the knee of the horseman. This applies in particular with relatively large horseman-securing devices which, for example, serve to engage the all of or part of the lower body and/or thigh and optionally also all of or part of the lower leg of a horseman. The pivoting means then provide the desired freedom of movement for a horseman.

In a preferred embodiment, the saddle comprises one or more movable saddle parts and one or more fixed saddle parts, the one or more movable saddle parts being connected in a movable way to the one or more fixed saddle parts to each other, and in which the horseman is or can be attached to the one or more movable saddle parts in a manner as described in this application.

In a preferred embodiment, the one or more movable saddle parts are connected to each other so as to be pivotable or tiltable about one or more pivoting or tilting axles or axes, which are preferably situated on the front and in the middle of the saddle, with respect to the one or more fixed saddle parts.

In a preferred embodiment, the additional features comprise a tiltable or pivotable saddle ("folding saddle"). A tiltable or pivotable saddle may comprise, for example, one or more fixed saddle parts and one or more movable saddle parts which are movably connected thereto. Such a movable connection may consist of one or more tilting or pivoting axles which may preferably be situated in this case on the front side of the saddle, viewed in the direction of riding of the animal. But such a movable connection may also consist of one or more springs or resilient bars which are situated between the movable and fixed saddle parts and are connected thereto. The horseman can then be connected to the one or more movable saddle parts in a releasable manner. In a preferred embodiment, the backside of the horseman is releasably connected to the one or more moving saddle parts. This may be effected by providing, for example on the clothing of the horseman at the location of his backside, one type of hook and loop fastener and the other type of hook and loop fastener on the side facing the horseman of the one or more moving saddle parts. Because the horseman is connected to the one or more moving saddle parts in this way, he still retains all the freedom to perform the required or desired equestrian movements, despite the hook and loop fastener. Another example of a way of securing the horseman using one or more such movable saddle parts is the use of one or more safety straps which are connected to the one or more movable saddle parts and which can be passed around the waist of the horseman or over his thighs, both simultaneously or each thigh separately, and can be closed. It is also possible to extend the one or more moving saddle parts on the rear side slightly upwards, so that a kind of low backrest is created, by means of which a safety belt which is connected thereto can more easily be placed around the waist of the horseman. Such one or more backrests may also be configured in such a way that they consist of one or more separate parts which is/are connected to the one or more movable saddle parts in a telescopic manner. In this case, these telescopic backrests may be temporarily fixed, for example by means of small turning knobs on the side(s) of the movable saddle part. It is also possible to produce such a backrest or backrests in different sizes, which can then be connected to the moving saddle part in a non-telescopic manner. In this way, the backrest or backrests may be adapted to the size and posture of the horseman. It is obvious that the one or more movable saddle parts should be placed on top of the one or more fixed saddle parts, since the one or more saddle parts move upwards with the horseman. However, it is also possible for the one or more movable saddle parts to be situated inside the one or more fixed saddle parts, in which case the one or more fixed saddle parts are situated around the one or more movable saddle parts. Conversely, the one or more movable saddle parts may be situated around or on the outer side of the one or more fixed saddle parts, but in that case, features will always be provided on the one or more movable saddle parts which are situated underneath the backside of the horseman, which features will then in turn be situated on top of the one or more fixed saddle parts. The one or more movable saddle parts may be made from the same material and have the same properties as the current saddle seats, but it is also possible for the one or more movable saddle parts to be configured, for example, as a tube structure, which tube or tubes are situated on the periphery of the one or more moving saddle parts, while the central part of the one or more moving saddle parts may be made of, for example, canvas or another thin material, such as for example textile, thin natural or plastic fibres, or just plastic.

The movable part may be virtually as large as or cover a virtually identical surface to the fixed saddle part, but it is also possible for the movable saddle part to be significantly smaller and to have a smaller surface than the fixed saddle part. After all, what matters is that the horseman is connected to the saddle in a movable way. In addition, the movable saddle part may consist of a single part or of several parts, e.g. 2 parts, e.g. 1 part at the position of each thigh, as a result of which the horseman may even have more freedom to rotate his body. In the case of e.g. 2 movable saddle parts, it is advantageous if each such saddle part can pivot by means of a separate axle, or can pivot separately using the same axle.

Alternatively, it is possible for the one or more movable saddle parts not to be situated underneath the backside of the horseman, but at his front side, in the form of an abdominal support and/or thigh supports, to which the horseman can be connected. At rest, when the horseman is fully seated in the saddle, the one or more movable saddle parts are then on the front side of the thighs of the horseman and/or his abdomen. During light-riding or jumping, the one or more movable saddle parts move concomitantly forwards and upwards, in which case the one or more movable saddle parts may also use one or more guides which move inside or along one another. By means of such a movable saddle part at the front side of the horseman, in particular the undesirable and excessive forward movement by the horseman is prevented.

Of course, combinations of one or more movable saddle parts placed underneath the backside of the horseman and in front of the abdomen and/or thighs of the horseman are also possible.

The abovementioned pivotable and/or tiltable saddles can also be used to attach the thighs and optionally the knees of the horseman, in which case it is obvious to then attach these body parts to the one or more moving saddle parts by extending these saddle parts downwards, in the direction of these body parts. In order to maintain the pivotability of the knee joints of the horseman, these extended movable saddle parts have to be provided with a pivot element at knee or thigh level. After all, if this is not done, the lower legs would tilt together with the thighs.

Such pivot elements at knee or thigh level could thus be used with the tiltable and/or pivotable saddle as additional movement element on for example one or more tilting or pivoting axles at the front centre of the saddle, but it is also possible for the one or more movable saddle parts to be solely movably connected to the one or more fixed saddle parts by means of these pivot elements at knee or thigh level.

An advantage of securing the horseman by means of these movable saddle parts compared to securing the horseman at knee level is the fact that, with the former method, fewer corrections have to be made to allow for differences in posture and anatomy of the horseman than with the latter method.

It is advantageous if the movable connection between the one or more movable saddle parts and the one or more fixed saddle parts is effected by means of one or more pivoting and/or tilting axles, which are preferably situated at the front side of the saddle, since the horseman will want to raise his body and move forward. The axle between the movable saddle part and the non-movable saddle part may be incorporated into the fixed saddle part in an as it were invisible manner, but may also be fitted in a visible manner on the outer side, or on either side of the fixed saddle part. It may be a single axle or several axles, e.g. 2 axles. An axle may also be fitted on either side of the fixed saddle part, which 2 axles are connected to each other and/or move concomitantly by means of a concomitantly moving bridge across the saddle.

It may be advantageous in this case that the movement of the tilting or pivot axle can be limited to a maximum number of degrees, thereby for example preventing the horseman from moving forwards too far and in this way falling off his horse. The number of degrees to be limited also depends on the sort of horse riding the horseman desires. Thus, a jumping jockey will perhaps require that he can fully stretch his thighs with respect to his downwardly hanging lower legs, which corresponds to a position of the one or more movable saddle parts of 0 degrees in the starting position to 90 degrees in the upright position. For horsemen who do not want to jump, but only want to light-ride, a travel of perhaps 15-30 degrees or less may already be sufficient. In addition, it may be advantageous according to the invention if the movement between the one or more movable saddle parts and the one or more fixed saddle parts can be configured to be, for example, resilient or delayed. Such manipulation of the movement may be effected in the pivoting or tilting axle(s) themselves, but also by means of one or more connecting elements between the moving saddle part and the fixed saddle part, such as for example one or more hydraulic or resilient connecting rods between, for example, the rear bottom of the one or more movable saddle parts and the front side or axle of the one or more fixed saddle parts.

In a preferred embodiment, a saddle comprises one or more movable saddle parts, one or more fixed saddle parts and pivoting or tilting means in order to be able to tilt or pivot the one or more movable saddle parts and the one or more fixed saddle parts with respect to each other, preferably about a pivot axle or axis in the centre at the front side of the saddle, in which the axle/axis, in use, is oriented perpendicularly to the longitudinal direction of the animal.

When securing the thighs of the horseman to the animal or his saddle, the freedom of movement of the horseman will quickly be limited, as a result of which it will become difficult if not impossible for the horseman to raise his backside. Therefore, a securing arrangement for a thigh according to the invention will often preferably be designed as part of a pivotable securing arrangement, having a pivoting or tilting axle/axis at knee level or not much higher on either side of the saddle. Another preferred embodiment is the securing arrangement of the thigh in combination with a pivotable or tiltable saddle with 1 axle, at least when the one or more movable saddle parts of the tilting saddle have been extended downwards with parts to which or with which the thighs are or can be completely or partly attached. A particular embodiment of such a combination of a pivotable securing arrangement of the thighs and lower body of the horseman, is/are the pivotable body clamp or clamping trousers, in which the hinges are at knee level and the thighs and the lower body of the horseman are releasably clamped between essentially a part which is situated on the front side of the horseman and a part which is situated on the rear side of the horseman.

In a preferred embodiment, the saddle is provided with a horseman-securing device comprising one or more, optionally flexible, bent bars, which extend from the rear side of the horseman to the front side of the saddle, in which the horseman is connected in a movable and detachable manner to one or several bars by means of one or more ancillary means, in such a way that the horseman who is secured to the animal can move over a limited distance along the length direction of the bar or bars in order to rise between a position in which he makes complete contact with the back of the animal with his backside, or indirectly via the saddle, to a position in which the backside of the horseman is not or no longer in complete contact with the back of the animal, or indirectly via the saddle.

One or several of such bars, arcs or masts which may extend, in use, above the horseman, like a protective rollover construction of a car. Such an arc or mast also protects a horseman against situations in which an animal fails headfirst (somersault) or backward.

Such a saddle which is provided with such bent bars may be provided with a horseman-securing device in which the horseman is releasably connected to the bar or bars by means of a releasable safety harness, safety waistcoat or safety trousers or other connecting means described in this application and which can be displaced along the bar or bars. It is then advantageous if the guided movement of the horseman along the bar is then limited in such a way that the horseman only retains the freedom to perform a lifting movement with his body. In this case, it may be advantageous if the connection between the horseman and the bars is resilient and/or delayed, optionally via connecting elements such as discussed elsewhere in this application.

In a preferred embodiment, the securing device comprises at least one guide and a guide element which can be guided in the at least one guide. The guide may, for example, be attached to a saddle and the guide element to a horseman. Thus, a movement of the horseman is only allowed in a defined direction. This direction may be adapted to movements which are desirable for a horseman, which may also result in a learning effect during the riding of an animal. The guide may extend as a straight line or a bent curve, for example by using a toothed wheel and a gear rack. The guide element may be enclosed in the guide or be removably accommodated therein. By means of the at least one guide, the user can determine, for example the position of one or more securing devices on the saddle, in which case the user can displace or rotate the securing device in the height and width, and if desired also in the lateral or radial direction on the saddle and fix it/them at the selected location.

In a preferred embodiment, the securing device comprises opening and closing elements of an opening and closing mechanism. Thus, the securing device can easily be attached to the horseman or the horse by opening the opening and closing element, positioning an element or body part to be enclosed and subsequently closing the opening and closing element in a semi-permanent way. Alternatively, a fully closed securing element may be used, in which an element or body part is inserted, for example, in the axial direction in order to be enclosed. Other examples of opening and closing mechanisms are clamps, a click-fit connection or a safety belt of, for example, the type which is known from cars and aeroplanes. Use may also be made of a hook and loop fastener as opening and closing element in order to quickly open and close a securing device.

This fastening and releasing of the securing device by means of an opening and closing mechanism may be effected for each securing device separately or by a group of securing devices or centrally. Thus, it may be advantageous if a knob or lever is provided on top of the saddle, on the front side, by means of which all securing devices are simultaneously controllable and can be closed and released. Such control may be effected, for example, in an electronic or mechanical way. Securing and releasing the securing device will depend on the type of securing device. Thus, strips, cables, tapes, bands, cords, wires and the like can easily be released from and attached to buckles, clamps, hooks, eyelets and the like. Many of said securing devices may be attached and released by means of a hook and loop fastener, which has been discussed in more detail elsewhere in this application. Stronger securing devices may be opened and closed by bending, pivoting or clamping the securing device or by using known open locks. The use of techniques similar to ski bindings is also a possibility. Every opening and closing mechanism may be configured as a quick-action connection, so that a horseman can quickly be secured to and released from an animal.

In a preferred embodiment, the securing device is provided with an unlocking element by means of which the securing arrangement can actively be released by a horseman. An unlocking element preferably provides the possibility of releasing the securing arrangement quickly and simply by means of a quick unlocking action, for example after riding or in an emergency during riding, while the securing arrangement of the horseman on the animal remains intact when such a directed action is omitted. This is an explanation of the term semi-permanent.

It is advantageous if the closing mechanism can actively be opened in a simple and quick manner, by means of only a few movements, by the horseman in preferably a fraction of a second, preferably within one, preferably at most three, seconds. Here, it is a preferred embodiment according to the invention if a kind of emergency push button or pull or push lever, but it may also be a tape or handle, is used, for example on the front and on the top of the saddle, operation of which causes the securing devices on both sides of the saddle to open and/or close in one go. Such a mechanism may be controlled, for example by using steel wires, in a mechanical way, as with a safety belt, but if electric power is present, for example by attaching a battery in or on the saddle or horseman, the control may also be effected electrically or electronically. Several such emergency buttons, for example on either side of the saddle, are of course also possible. When unlocking is effected, it is preferable when this is done by means of operations which are not customary for a horseman during "normal" riding in order to minimize the risk of unintentional and/or undesirable unlocking.

In a preferred embodiment, the securing device allows a gradual movement of a part of a horseman which is secured to a saddle with respect to the saddle, but they block any sudden movement thereof in the direction away from the saddle. Such an embodiment may also be deduced from, for example, safety belts for cars and aeroplanes. Such an embodiment provides, on the one hand, a relatively great freedom of voluntary movement. On the other hand, it may block a movement of the horseman at a relatively short distance from the animal in the case of sudden movements, such as a panic or startled reaction of the animal and/or the horseman. In other words, the freedom of movement of the horseman is only limited if this is desired or required. In this case, the securing arrangement may be configured in such a way that the securing arrangement is releasable by a gradual movement, but not by a sudden movement.

In a preferred embodiment, the securing device comprises a hook and loop fastener of the hook-and-eyelet type. In this case, a connecting element may be provided, either between a touch-and-close-fastener-side and the saddle or between a touch-and-close-fastener-side and the horseman, which connecting element allows a mutual displacement between the saddle and the horseman at the respective securing position. Due to the large contact surface between the thighs (and optionally the backside) of a horseman and the back of the animal, a hook and loop fastener with a relatively strong adhesion may be sufficiently strong to keep the horseman on the back of the animal during any unexpected movements of the animal.

In a preferred embodiment, the securing device comprises an alternative hook and loop fastener, in which a connecting element is provided, either between a touch-and-close-fastener-side and the saddle or between a touch-and-close-fastener-side and the horseman, which connecting element allows mutual displacement, such as for example rotation, between the saddle and the horseman at the respective securing position. Although such an embodiment appears, at first glance, to be similar to the known securing arrangement described above, there is a significant difference.

According to the invention, a hook and loop fastener may be used as an additional strip-shaped securing device, as described above, but may also be used as a direct independent securing device between the contact surface of the horseman and the contact surface of the saddle, provided that this does not compromise the freedom of movement of the horseman as provided by the invention and that use is made of additional features which ensure that the raising of the backside and the knee hinge movement of the horseman are not impeded. If, for example, a hook and loop fastener is used for a direct connection between the side of the knee facing the saddle and the side of the saddle facing the horseman, then a preferred embodiment according to the invention is a movable connecting element, such as for example a rotatable disc, which may either be provided between a touch-and-close-fastener-side and the saddle or between a touch-and-close-fastener-side and the horseman on the respective securing position so that a mutual movement, such as for example rotation, between the saddle and the horseman remains possible.

Such a rotatable connecting element could in this case rotate, for example via an axle which is perpendicular to the saddle, in which case, for example the outer side of such a rotating disc is provided with a type of hook and loop fastener and the inner side of the knee of the horseman of the other type of hook and loop fastener. Such a rotatable connecting element may be situated on the saddle or the securing element or be incorporated in the saddle or securing element or be connected thereto. Such an axle may also consist of an axle and a sphere, in which case the sphere fits, for example, in a cavity in the saddle.

In a preferred embodiment, the securing device is provided with an adjustment element for adjusting the securing device in accordance with the user's wishes. The adjustment element may be of the semi-permanent type, and remain unchanged once they have been set for a user, saddle or animal. The adjustment element may also be of the flexible type and is thus configured so as to (be able to) always adapt the securing arrangement to changing circumstances. Of course, memory may also be provided in order to (be able to) set the securing device to predetermined positions.

The expression adjustability of the securing device is understood to refer to distinctly different properties of the securing device:

adjustability of the securing force of the securing device or the closing mechanism;

adjustability of the force required to fit the securing arrangement;

adjustability of the force required to fit and release the closing mechanism;

adjustability of the location of the securing device on the horse, girth, saddle or on the horseman or his clothing;

adjustability of the direction which the securing device has on the horse, girth or saddle with respect to the horseman or his clothing, and adjustability of the direction which the securing device has on the horseman or his clothing with respect to the horse, girth or saddle;

adjustability of the pivoting or tilting movement which may be configured, for example, as an axle at knee level or as an axle on the pivoting or tilting saddle, both with regard to the number of degrees of the pivoting or tilting movement and the speed of the movement, which can be adjusted by incorporating a certain delay.

With a strip-shaped securing device, the force by means of which the securing arrangement is fitted can easily be adjusted by pulling the strip tighter or less tight and thus fixing it. This fixing may be effected by means of a buckle or clamp or a hook and loop fastener or any other known technique, with it preferably being possible for the horseman to release this fixing according to the invention easily and quickly. Thus, each type of securing device will have its own way of adjusting the securing force, often by using shapes and dimensions which are adapted to the horseman.

Adjustability of the position of the securing device will also have an effect on the securing force, but it is advantageous according to the invention to adapt the securing device to each horseman in a tailor-made fashion, depending on the anatomy of the horseman and the desired freedom of movement, which in turn may depend on the desired riding style.

It is advantageous if the securing device is adjustable. In this context, the term adjustable is understood to mean that the retaining and releasing force of the securing arrangement is adjustable. The adjustability of the force which is exerted by the securing device will depend on the type of securing device. Thus, the force exerted by a strip may be adjusted by pulling the strip tighter or less tight and fixing it in the desired position. Whereas the releasing force depends on the type of opening and closing mechanism by means of which the securing device is fixed.

Thus, for example, with a bendable interrupted clamping tube, if no additional use is made of strips, the force may be adjustable by bending this tube, in which case the opening and closing forces are determined by the stiffness of the material used. With a magnetic securing device, the retaining and releasing power of the magnet can usually be adjusted electrically.

It is advantageous if the pivotability of the securing device is limited to a predetermined or presettable number of degrees. By limiting the number of degrees, the movements of the horseman are limited to those movements which are required to be able to ride a horse with maximum freedom, but no more than that. Thus, for example, when using a pivoting mechanism at knee level, the number of degrees that the pivoting mechanism has to be able to travel does not have to be more than between 0 to 90 degrees. When using the pivotable or tiltable saddle with a pivoting mechanism at the front of the saddle, the number of degrees which the pivoting mechanism has to be able to travel will also not have to be more than between 0 to 90 degrees. This prevents the horseman from falling too far over the neck of the horse. For horsemen who do not jump over obstacles, but only want to light-ride, a travel of 15 to 30 degrees or even less is probably sufficient.

It is advantageous if the securing device is displaceable on the horse, girth or saddle, with the securing device assuming an adjustable position with respect to the body part to be secured. Such a displacement may be effected by displacing the securing device by means of an adjustable and fixable way via a guide rail, slot, bar or groove and the like. The securing device can also be displaced in the radial direction, for example by means of a gear wheel structure, in which the parts can centrifugally or centripetally be displaced to an imaginary centre point.

It is advantageous if the securing device is displaceable on the horseman or his clothing, with the securing device assuming an adjustable position with respect to the horse, girth or saddle to be secured.

The securing device may also offer passive protection for the body parts of the horseman against forces or objects from outside. If, for example, the outer side, i.e. the side which faces away from the horseman, of the securing device is made of metal, hard plastic or leather, optionally filled with harder materials, then the securing device will thus also provide passive protection for the horseman.

It is advantageous if the securing device on the outer side is made of hard material or hard material is fitted to the outer side of the securing device. In this way, the secured body parts of the horseman are protected against direct contact with objects from outside and they thus also act as a passive protection means. In this case, the toughened parts may extend beyond the body part with which the securing device engages. Thus, the passive protection parts of a securing device which, for example, engages with the knee of the horseman may extend over the shins and thighs of the horseman.

In order to increase the effectiveness of the protection, but also to improve the fit and comfort of the protection means for the horseman, it is advantageous according to the invention if the protection means are provided with soft materials on the inner side, i.e. the side facing the horseman, such as foam, textiles, deformable plastics or thermoplastic materials.

It is advantageous if the securing device around or on the inner side facing the horseman is provided with semisoft materials, which are preferably deformable, or better still are formed as the mirror image of the body part of the horseman which is to be fixed. Such materials may, for example, consist of plastics, such as foam, or textiles or combinations thereof, but also thermoplastic materials, in which case in a heated state an imprint of the body part to be secured can be made beforehand, the shape of which can be fixed at a colder temperature.

If the securing device is fitted over a relatively large surface of one or more body parts of the horseman, and all the more if use is made of a relatively large toughened outer surface and a softened inner surface, it is advantageous to boost ventilation if the one or more securing devices on the outer side are provided with one or more ventilation openings or contain cooling elements. Heating elements are likewise possible.

It will be clear that several of said securing devices may be combined with each other in a complementary and/or supplementary way.

BRIEF DESCRIPTION OF THE DRAWINGS

FIG. 17A is a horizontal cross section through the right knee of a horseman as seen from above with a pivotable clamping structure, which in fact consists of two parts, a pivotable part and a non-pivotable counterpart, as from FIGS. 16A-16C.

FIG. 17B is a horizontal cross section through the right knee of a horseman as seen from above with a pivotable clamping structure on the outer side of the knee, in which a second hinge is situated on the rear side of the knee, as in FIG. 16D.

FIG. 17C is a horizontal cross section through the right knee of a horseman as seen from above with a pivotable clamping structure on the outer side of the knee which consists of two parts, a pivotable part and a non-pivotable counterpart.

FIG. 17D is a horizontal cross section through the right knee of a horseman as seen from above with a pivotable clamping structure on the outer side of the knee with a pivotable clamping structure similar to FIG. 17C, but with the difference that the hinge is now not situated on the medial and rear sides of the knee, but on the lateral and rear sides of the knee.

FIG. 17E is a perspective right-hand side and rear view of the pivotable clamping structure from FIG. 17A.

FIG. 19B is a right-hand side view of a saddle with securing elements as in FIG. 19A.

FIG. 23B is a front view of the legs of a horseman with a hook and loop fastener of the one type fitted completely or in part around the thigh of the horseman to be fitted within the inner side of the tubular securing element in FIG. 23A.

FIGS. 34B and 35C are schematic details of the rotating movement in hinge of the saddle, as is shown in FIG. 34A, in which the maximum number of degrees is limited to 90 degrees, and this in such a way that the movable saddle part can pivot from a horizontal position (FIG. 35A) to a vertical position at most (illustrated by dashed lines in FIG. 35A).

Figure 47B:
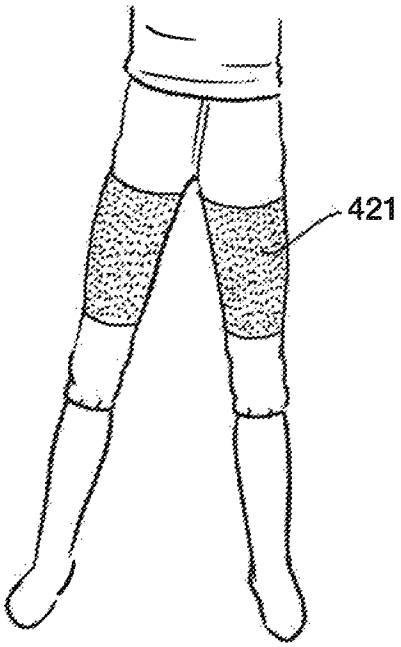
Figure 47A:
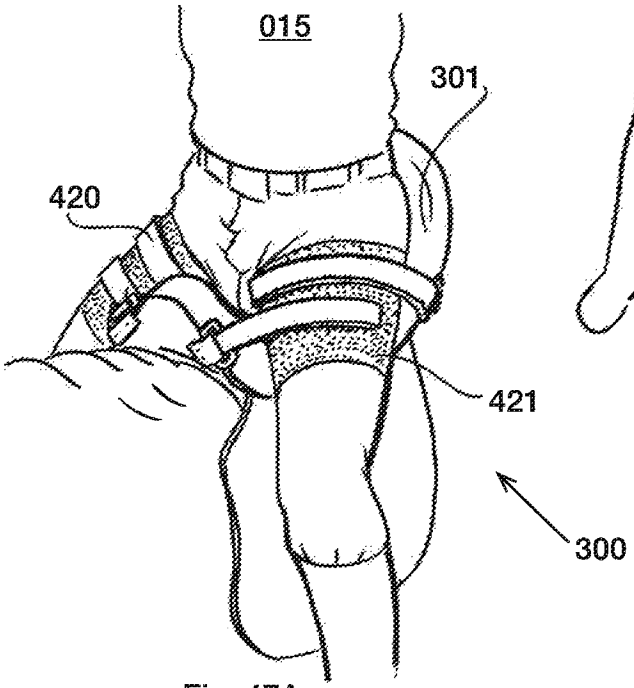

FIG. 47A is a perspective enlarged partial left-hand side and front and upper view of a horse carrying a saddle equipped with a horseman securing device by means of an assembly of an upper saddle part of a tiltable or pivotable saddle, in the form of an assembly between widened strip-shaped elements with a touch and a close fastener of the one type on the inner side and a hook and loop fastener of the other type provided around the thighs of the horseman or his clothing.

FIG. 47B is front view of the lower parts of a horseman with hook and loop fastener fitted with thighs of the horseman or his clothing to be combined with the an upper saddle part of a tiltable or pivotable saddle as shown in FIG. 47A.

Figures 48A, 48B, 48C, 48D, 48E, 48F:
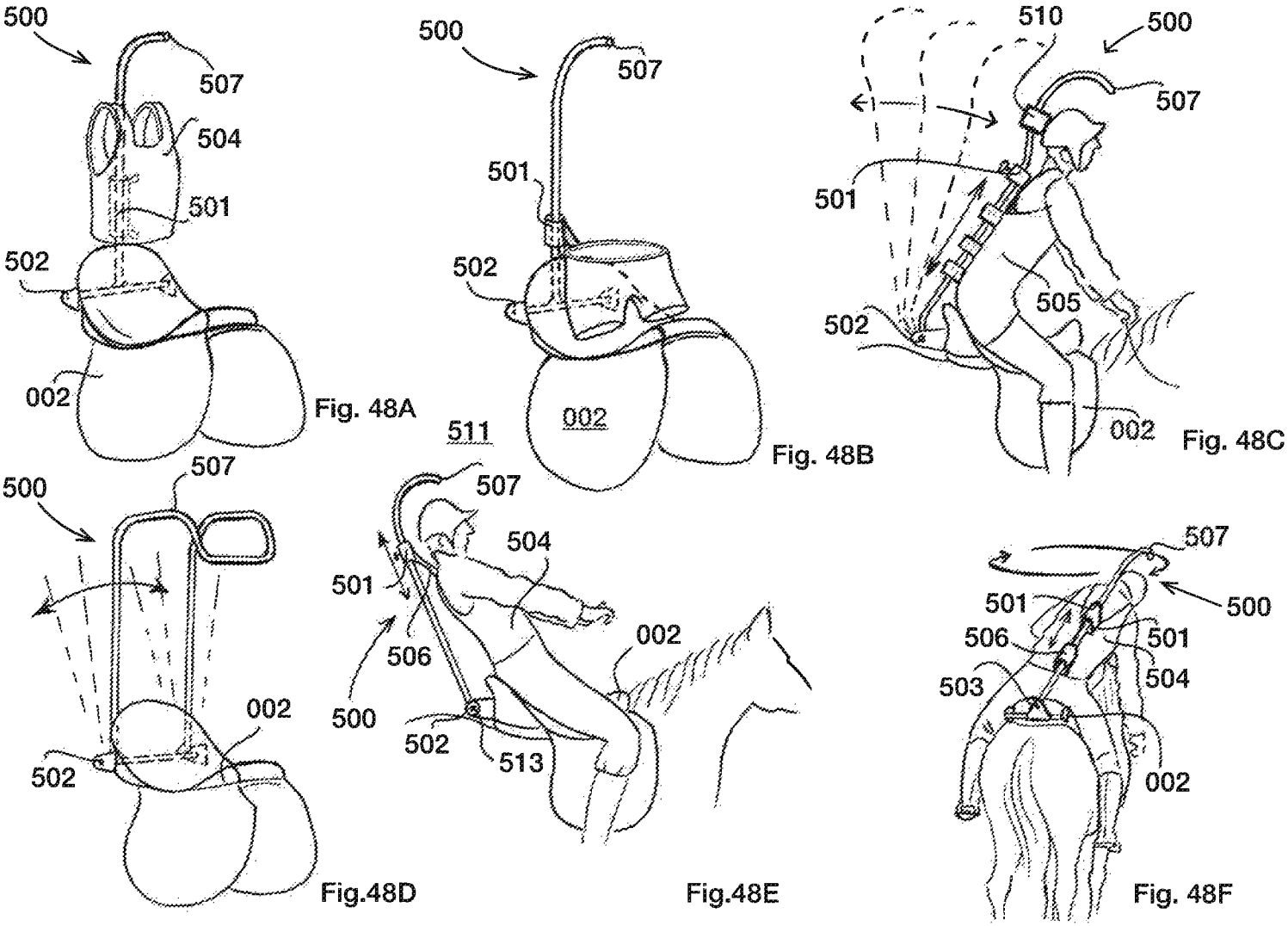

FIG. 48A is a perspective right-hand side and front and upper view of a saddle equipped with another embodiment of the horseman securing device by means of a bendable bar which is attached to the rear side of the saddle by means of a hinge, to which the horseman can be connected to the bar by means of a kind of waistcoat.

FIG. 48B is a perspective right-hand side and front and upper view of a saddle as shown in FIG. 48A, but here the horseman can be connected to the bar by means of a pair of trousers.

FIG. 48C is an enlarged partial right-hand side view of a horse carrying a saddle equipped with a horseman securing device by means of a bendable bar which is attached to the rear side of the saddle by means of a hinge, to which the horseman can be connected to the bar by means of a kind of waistcoat-trousers, and does show the forward and backward pivoting or tilting movement of the bar.

FIG. 48D is a perspective right-hand side and front and upper view of a saddle with double bendable bars attached to the rear side of the saddle by means of a hinge, to which the horseman can be connected to the bar.

FIG. 48E is an enlarged partial right-hand side view of a horse carrying a saddle equipped with a horseman securing device by means of a bendable bar which is attached to the rear side of the saddle by means of a hinge, to which the horseman can be connected to the bar, with the forward and backward pivoting or tilting movement of bar, in which the backward position is approximately 45 degrees removed from the forward position in this case.

FIG. 48F is a partial rear view of a horse carrying a saddle equipped with a horseman securing device by means of a bendable bar which is attached to the rear side of the saddle by means of a hinge, to which the horseman can be connected to the bar, and shows the lateral freedom of movement of bar, in this case a freedom of movement towards the right-hand side of horse and horseman.

Figures 49A, 49B, 49C, 49D, 49E:
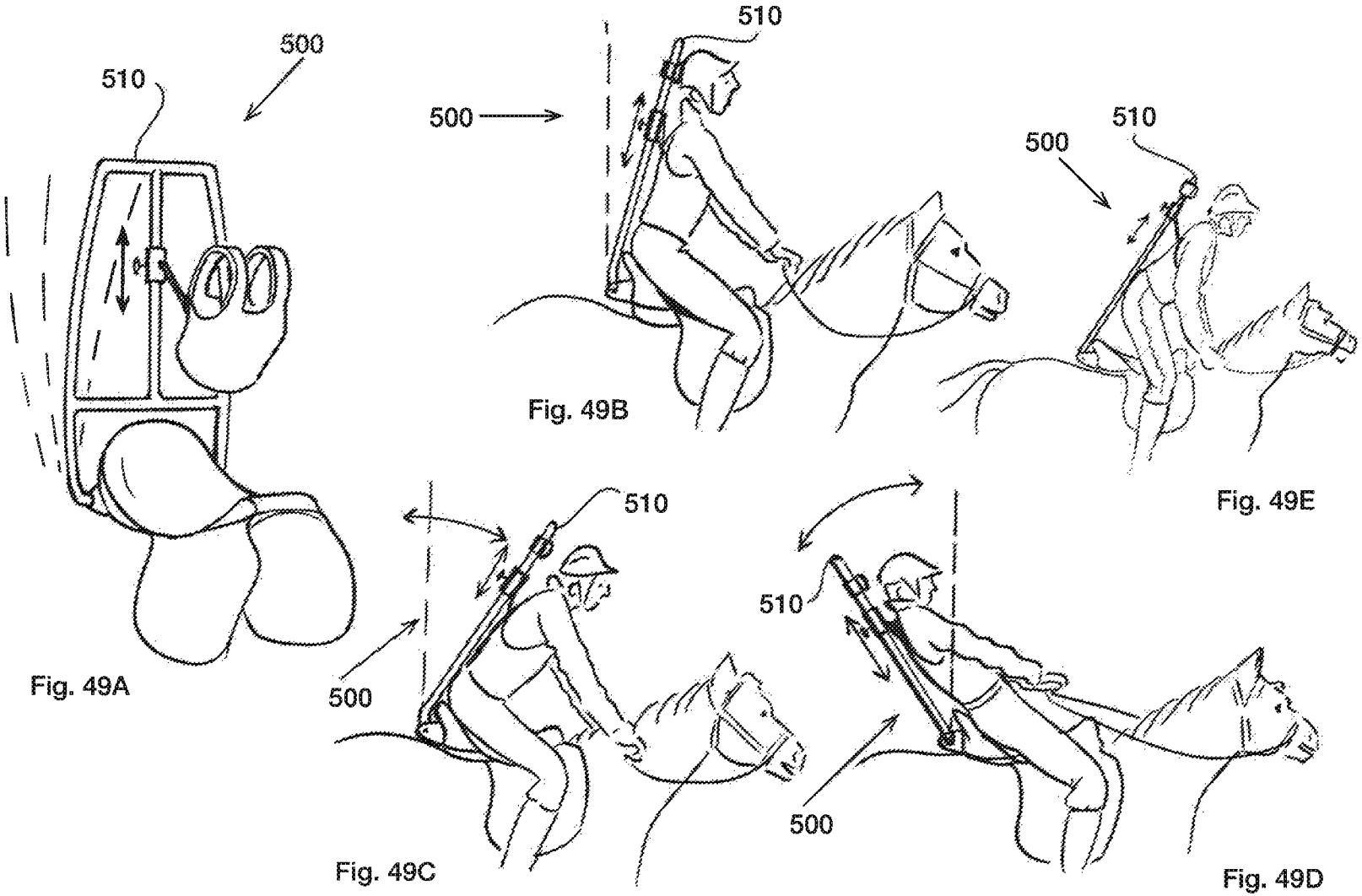

FIG. 49A-49E show a variant to the single bar, as illustrated in the FIG. 48, consisting of a several bars or backrest. FIG. 49A is a perspective right-hand side and front and upper view, and FIGS. 49B-E are right-hand side views.

Figure 50B:
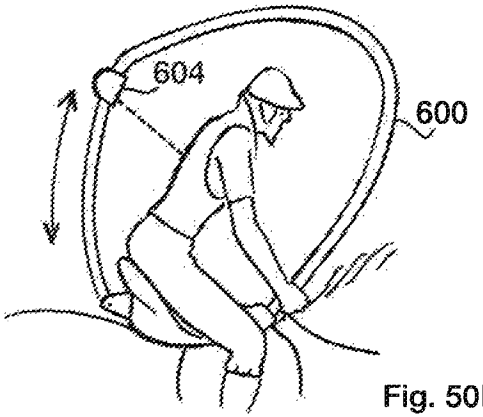
Figure 50C:
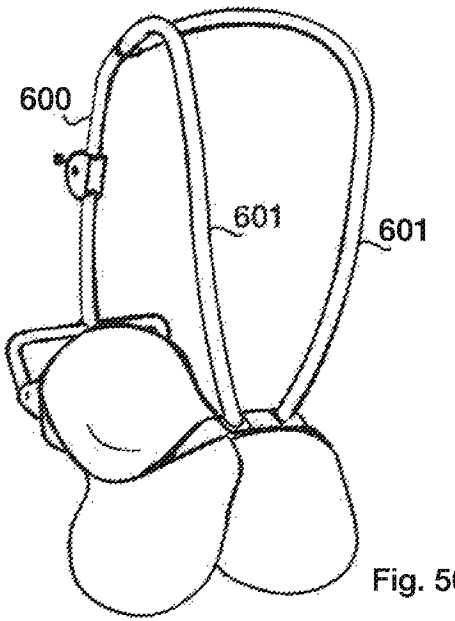
Figure 50A:
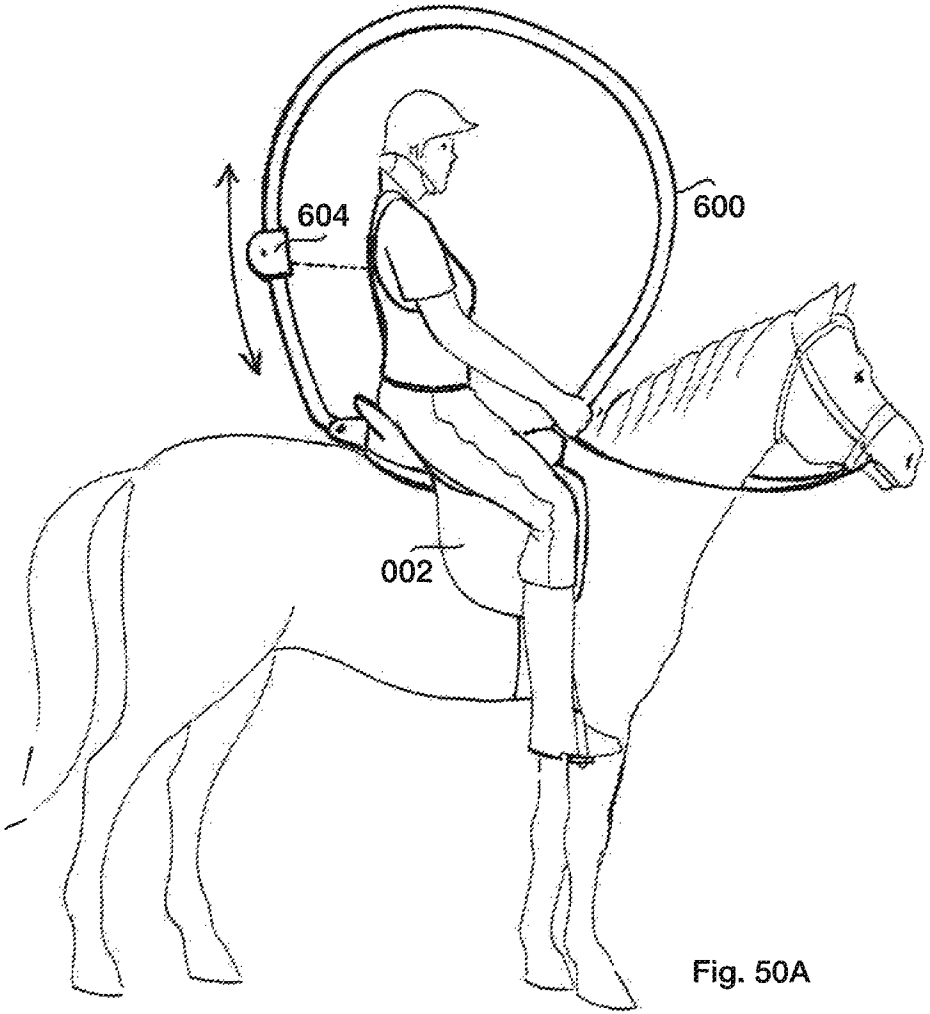

FIG. 50A is a right-hand side view of a horse and horseman sitting on a saddle equipped with another embodiment of the horseman securing device by means of a bar which extends from the centre and rear side of the saddle up to the centre and front side of the saddle, to which the horseman can be connected to the bar, forming a continuous ring which may contribute to the passive protection of the horseman, here in rest position.

FIG. 50B is an enlarged partial right-hand side view of a horse carrying a saddle equipped with a horseman securing device as in FIG. 50A, in which the horseman has raised his backside, e.g. in light trot, in which coupling piece (604) is in an elevated position.

FIG. 50C is a perspective right-hand side and front and upper view of a saddle with a bar which consists of a single bar on the rear side and branches in such a way that there are two bars on the front side of the horseman, which are connected to the front side of the saddle.

Figure 51B:
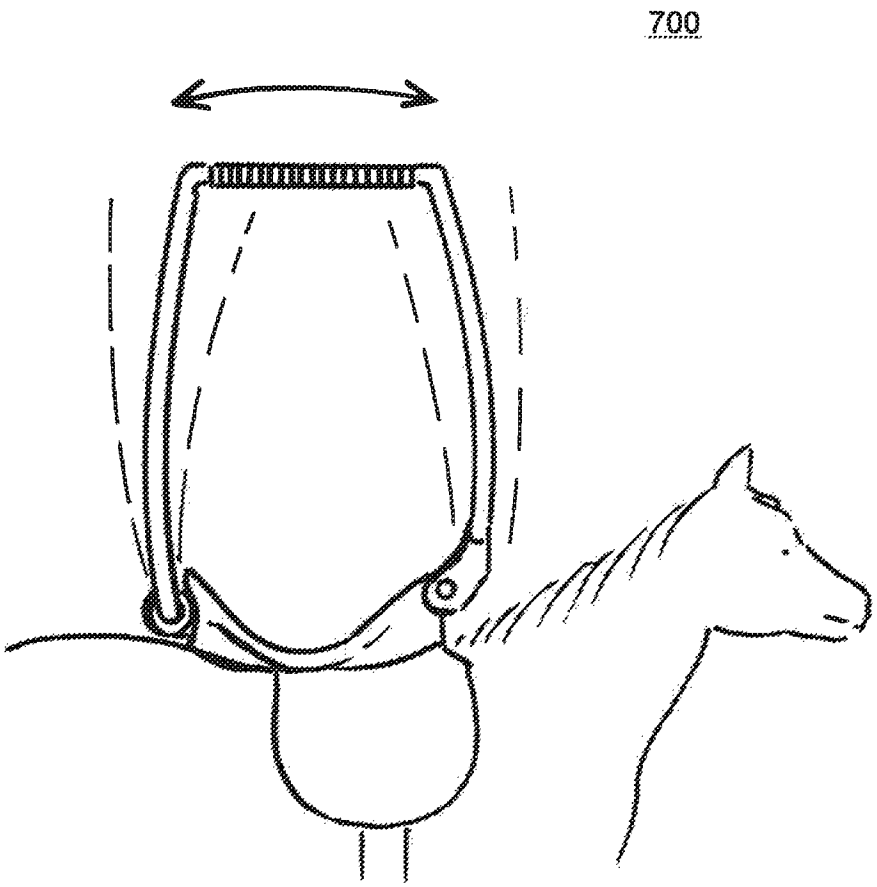
Figure 51A:
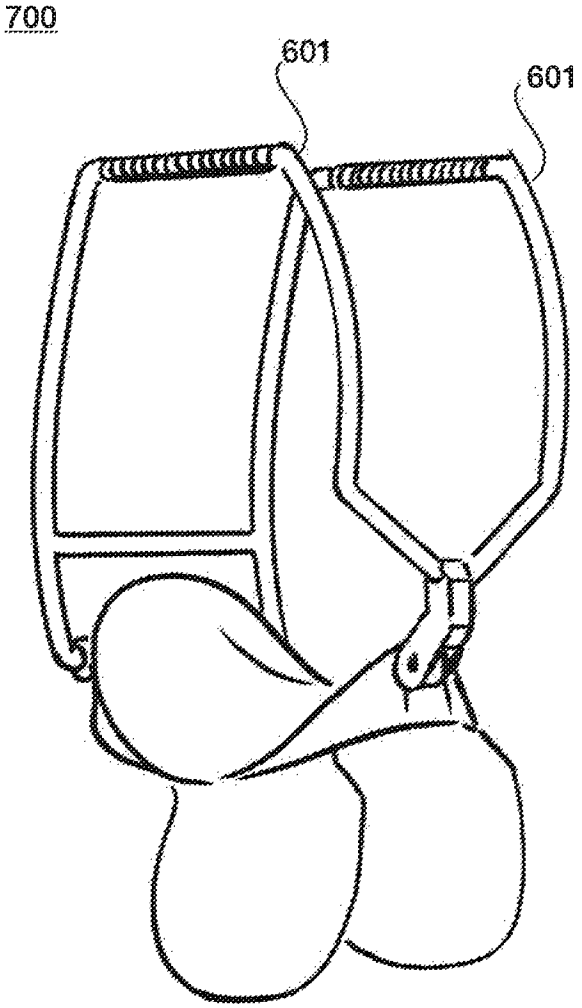
Figure 52C:
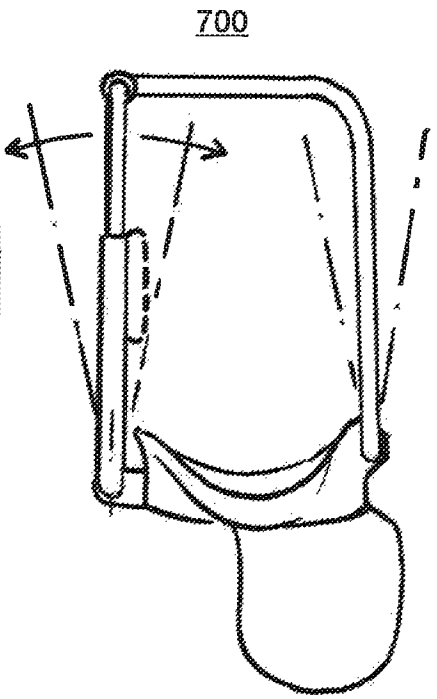
Figure 52B:
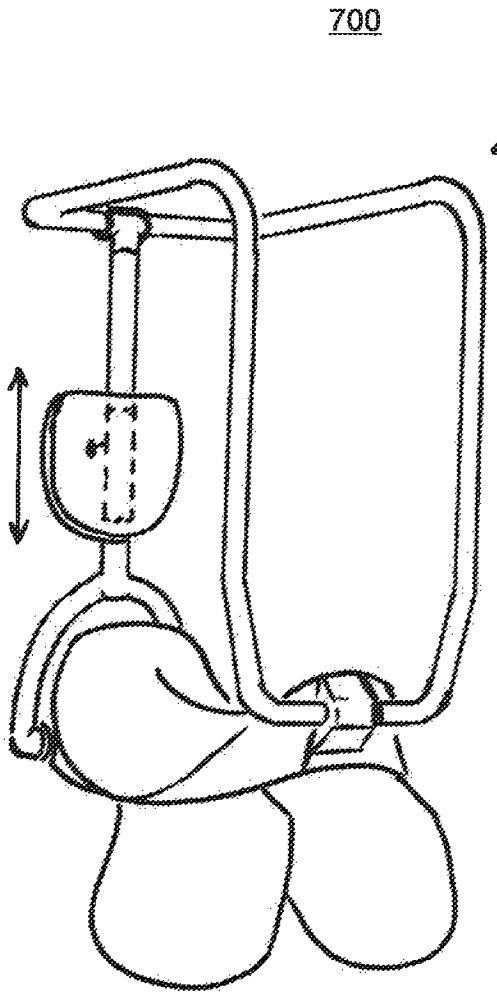
Figure 52A:
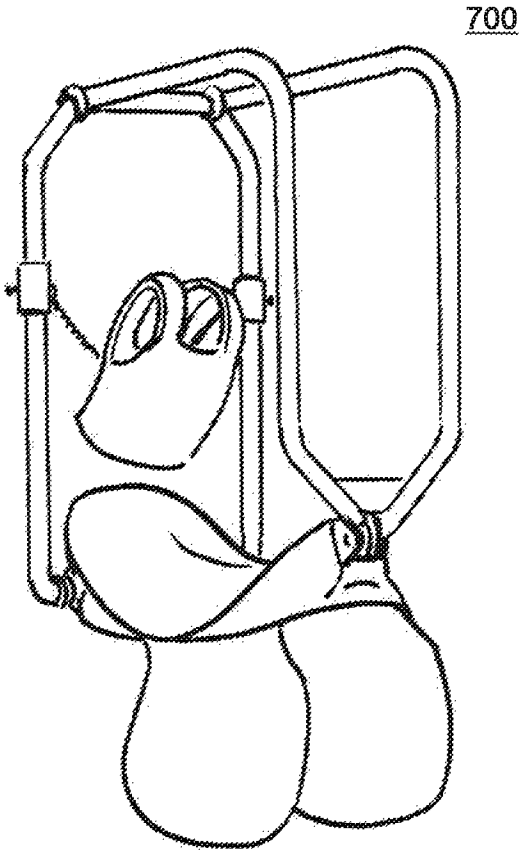

FIG. 51A, 51B, 52A-C are right-hand side and oblique right-hand side and front views of variations of FIG. 50, in which a kind of cage structure is produced by using several bars, which contributes to the passive safety of the horseman. FIGS. 51A, 52A, and 52B are perspective right-hand side and front and upper views, and FIGS. 51B and 52C are right-hand side views.

Figure 54:
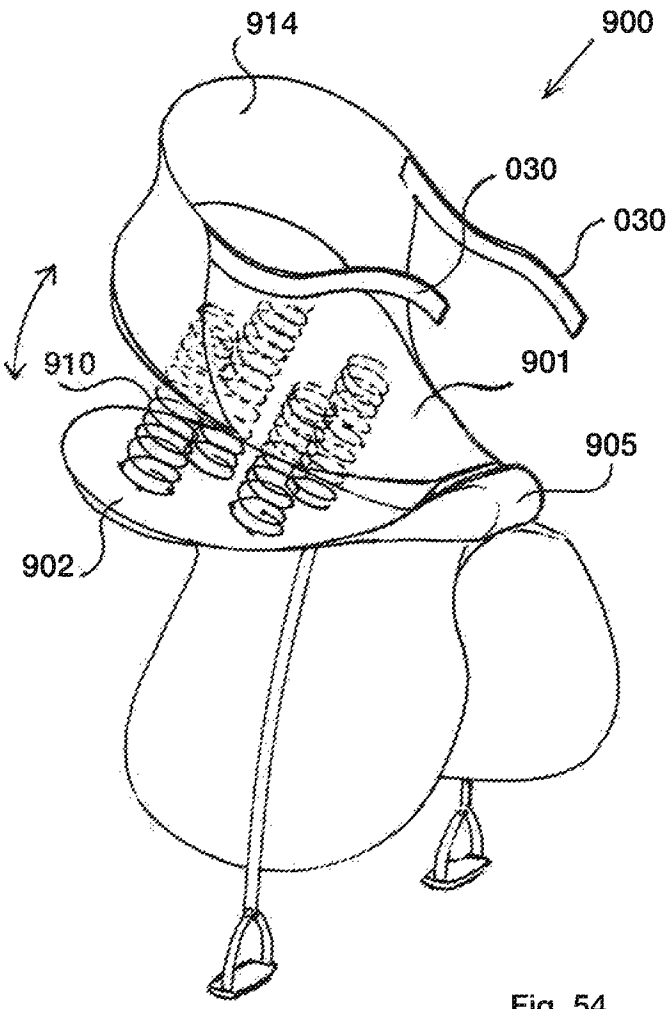
Figure 53:
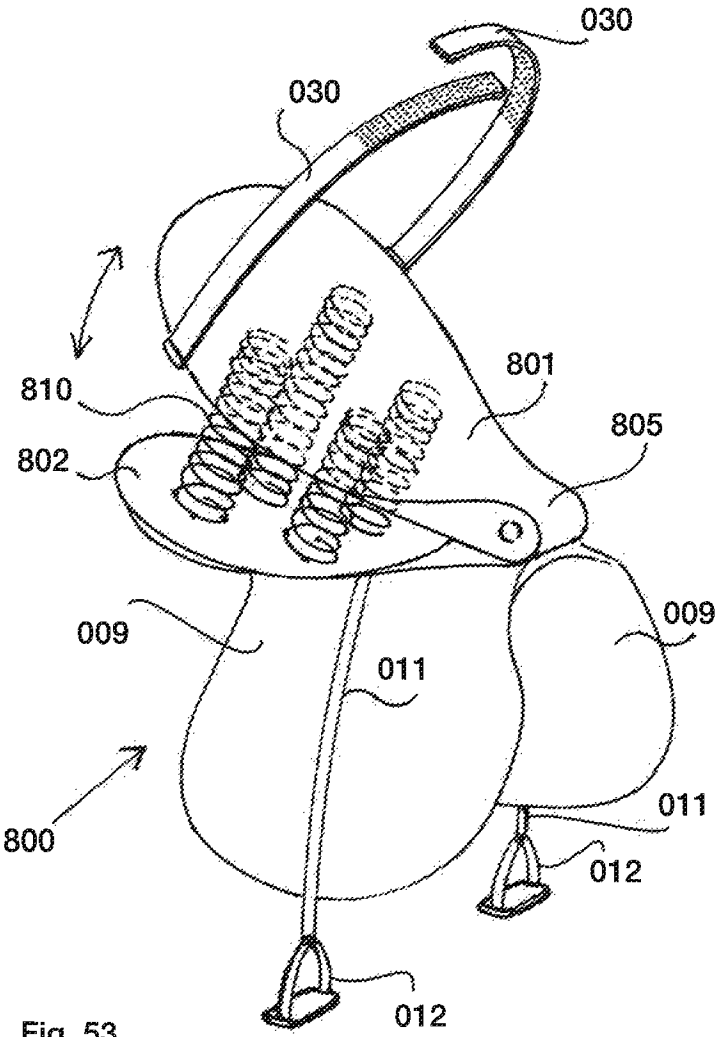

FIGS. 53 and 54 are perspective right-hand side and front and upper views of a saddle equipped with another embodiment of horseman securing device by means of a movable saddle part which is movably connected to a fixed saddle part by means of a single hinge at the front and top side of the saddle, and in which the horseman is or can be secured to the one or more movable saddle parts, for example by means of the strip-shaped securing elements, in which one or more resilient connecting elements, preferably of different lengths, are provided between the movable saddle part and the fixed saddle part.

DETAILED DESCRIPTION

Aspects of the invention has been illustrated in the figures and described above by means of single exemplary embodiments. It will be clear that various variants are possible, which may be obvious to a person skilled in the art, without departing from the scope of protection which is defined by the following claims.

Effectively, aspects of the invention can be applied to simpler saddles than the saddle described in the claims. In exceptional cases, a horseman may even ride an animal without a saddle, but will use a girth, or a similar device which may be passed around the belly and/or rib cage of an animal and to which stirrups are attached. All cases which may or may not be exceptional and in which a usually common part of a saddle has been omitted, but in which a horseman can be releasably secured to a saddle or saddle-like element in a manner as described in this document are deemed to fall within the scope of protection of the invention.

Figure 1:
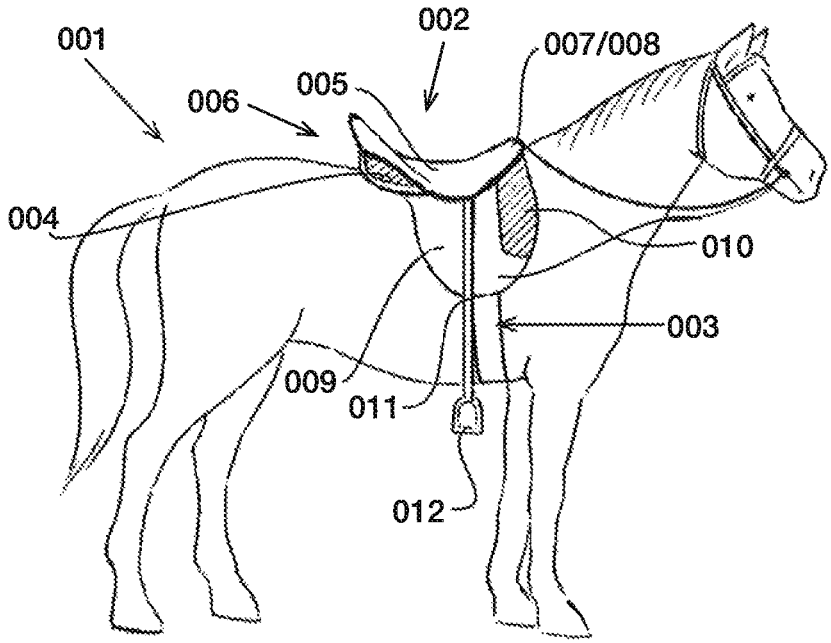
FIG. 1 is a right-hand side view of a horse or pony carrying a prior art saddle and saddle girth.

FIG. 1 shows an example of a four-legged animal, in this case a stationary horse or pony (001) on a horizontal surface, seen from the right-hand side of the animal. The general anatomical features of a four-legged animal (001) are assumed to be known to those skilled in the art. On the back of the horse (001), a saddle (002) is present which is secured to the animal (001) by means of a saddle girth (003) around the belly and/or rib cage of the animal (001). The upper part of the saddle (002) is formed by the bow, which effectively rests on the back of the animal and of which often only the saddle pad (004) can be seen from the side. On top of the bow and saddle pad (004) is the saddle seat (005) which may be raised at the rear and front side, referred to as cantle (006) and pommel (007), respectively. The pommel (007) is often of raised design to provide space for the withers of the horse, thus forming the gullet (008) of the saddle (002). From the bow, on either side of the animal (001), flaps (009) are present which are situated more laterally on the animal and can often move concomitantly with the lateral movements of the rib cage of the animal (001). The saddle seat (005) smoothly blends into the flaps (009) on either side of the animal (001). At the front side of each flap (009), a thickening may be present to support the knee of the horseman, referred to as knee roll (010). From the bow and/or saddle seat (005), stirrup leathers are present on either side of the animal (and stirrup leather with stirrup, of which only the right-hand stirrup leather (011) and stirrup (012) are shown).

Figure 2:
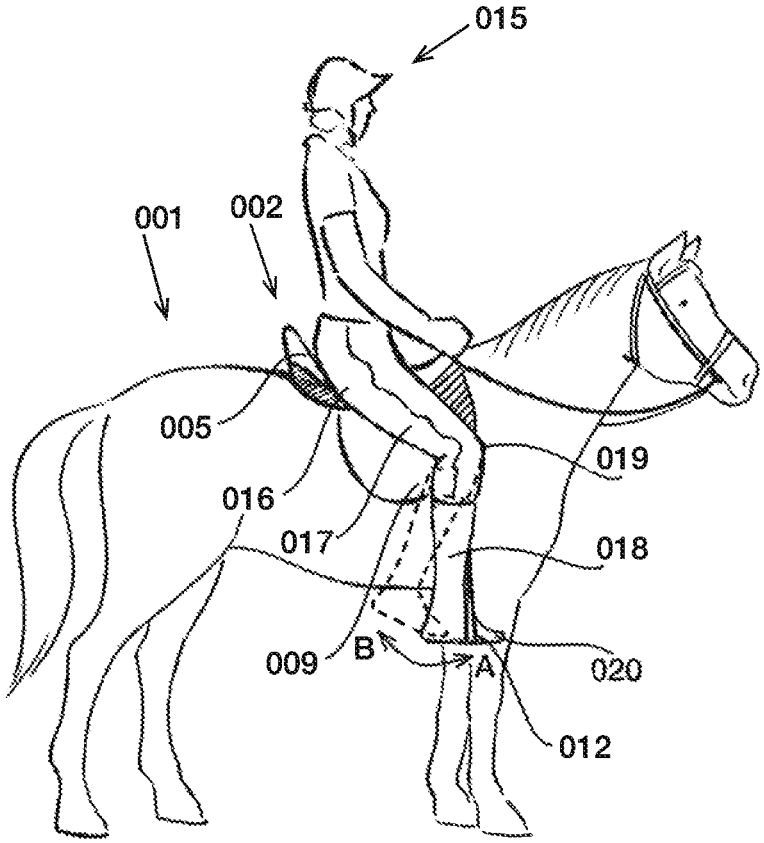
FIG. 2 is a right-hand side view corresponding to that of FIG. 1 with a horseman sitting on a saddled horse giving the horse aids.

FIG. 2 shows a horseman (015) sitting on a stationary saddled horse (001) on a horizontal surface, seen from the right-hand side of the animal (001) and horseman (015). Characteristic of a horseman (015) sitting on the animal (001) is the fact that, when the animal is stationary, the backside (016) and inner side of the thighs (017) of the horseman (015) make complete contact with the saddle (002), and in particular with the outer side of the saddle (002), and in particular with the saddle seat (005) and flaps (009) thereof, which position of the horseman may be referred to as first backside position. The lower legs (018) of the horseman (015) hang downwards at right angles from the knee (019), with the feet (020) of the horseman (015) being situated in the stirrups (012), which position of the lower leg may be referred to as first lower leg position. At the location of the knee joint (019), on the rear side of the knee, the lower leg (018) makes an angle of approximately 135 degrees with respect to the thigh (017) and, on the front side of the knee (019) of approximately 225 degrees. This rest position is shown here by a solid line (first lower leg position A). If the horseman (015) does want to give the horse (001) any aids, such as "spurring on", then the horseman (015) will move his lower leg (018) with his foot (020) and stirrup (012) to the rear, indicated here by a dashed line (second lower leg position B). The arrow A-B shows the to-and-fro movement of the lower leg (018) from a first lower leg position (A) to a second lower leg position (B) and back again to the first lower leg position (A).

Figure 3:
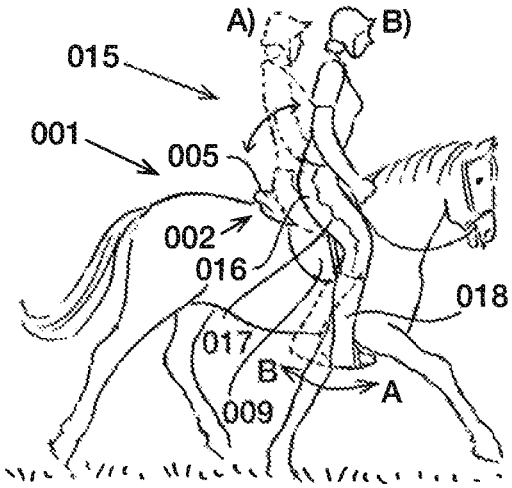
FIG. 3 is a right-hand side view corresponding to that of FIG. 2 of a horseman sitting on a trotting saddled horse.

FIG. 3 shows a horseman (015) sitting on a trotting saddled horse (001) on a horizontal surface, seen from the right-hand side of the animal (001) and horseman (015). Here, the horseman (015) makes a raising movement from the seated first backside position at rest (as illustrated in FIG. 2) in which the horseman (015) is shown by dashed lines, here denoted by A), to a raised position in which the horseman (015) makes no, or at least no complete, contact with his backside (016) and/or thighs (017) and the saddle (002), and in particular with the saddle seat (005) and flaps (009) thereof. This raised position of the horseman may be referred to as second backside position. The raised seat of the horseman (015) is illustrated here by solid lines and denoted by B). After assuming the second raised backside position, the horseman will descend, synchronously with the trotting movements of the horse, and assume his first backside position, in which case his backside again makes complete contact with the saddle. Trotting in this manner, with the horseman moving up and down, is also referred to as "English riding" or "light riding". During this raised position, the leg of the horseman (015) extends slightly in the knee joint (019), with the lower leg (018) making an angle with respect to the thigh (017) which is greater than 135 degrees on the rear side of the knee (019) and an angle which is smaller than 225 degrees on the front side of the knee (019). The upper arrows without letters and numbers show the to-and-fro movement of the body of the horseman (015) during this "English riding" or "light riding". The bottom arrows with the letters A and B show the to-and-fro movement of the lower leg (018) from a first lower leg position (A) to a second lower leg position (B) and back again to the first lower leg position (A), as shown in FIG. 2.

Figure 4:
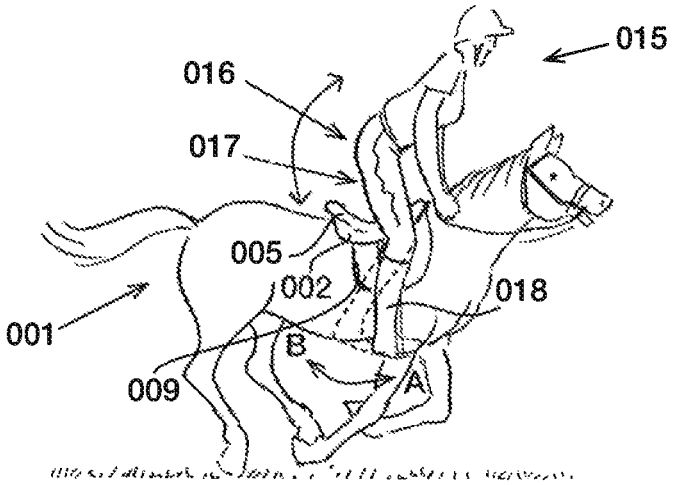
FIG. 4 is a right-hand side view corresponding to that of FIG. 2 of a horseman sitting on a saddled horse in racing gallop.

FIG. 4 shows a horseman (015) sitting on a saddled horse (001) in racing gallop on a horizontal surface, seen from the right-hand side of the animal (001) and horseman (015). Here, the horseman (015) is constantly in the raised position and second backside position as described for FIG. 3 (B), but now the elevation is greater, so that the backside (016) and the thighs (017) of the horseman (015) no longer make contact with the saddle (002), and in particular with the saddle seat (005) and flaps (009) thereof. The second backside position will in this case often be assumed at the start of the racing gallop, and the return to the first backside position will often take place at the end of the racing gallop. Galloping in this way is also referred to as galloping with a "light seat". In this case, the legs of the horseman (015) will stretch even further than is the case with English riding or light-riding, so that the thigh (017) almost comes to lie in line with the lower leg (018). The upper arrows without letters and numbers show how the body of the horseman (015) makes a to-and-fro movement and assumes the first and second backside position at the start and end of the racing gallop. The bottom arrows with the letters A and B show the to-and-fro movement of the lower leg (018) from a first lower leg position (A) to a second lower leg position (B) and back again to the first lower leg position (A), as shown in FIGS. 2 and 3.

Figure 5:
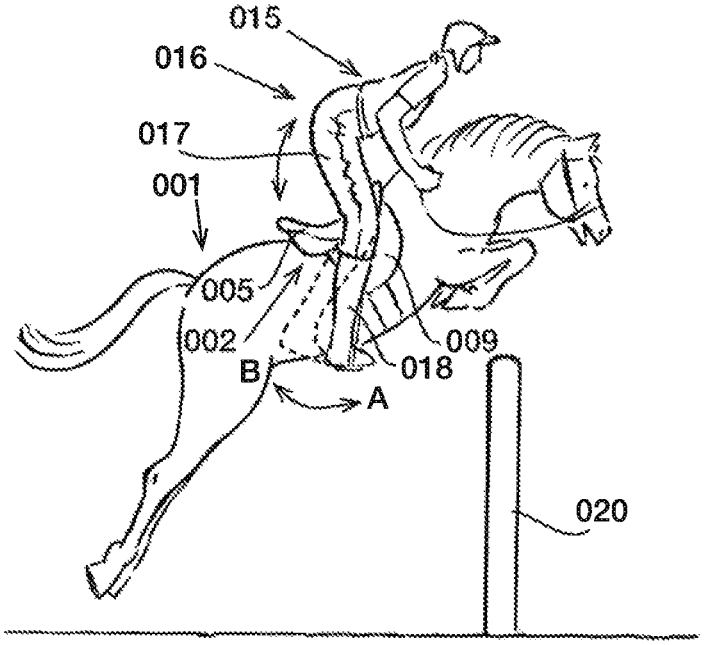
FIG. 5 is a right-hand side view corresponding to that of FIG. 2 of a horseman sitting on a saddled horse in an upward jump over an obstacle.

FIG. 5 shows a horseman (015) sitting on a saddled horse (001) in an upward jump over an obstacle (020), seen from the right-hand side of the animal (001) and horseman (015). In this case, the horseman (015) is in the raised position during the jump and assumes a second backside position as described for FIG. 3 (B), but now the elevation is greater, so that the backside (016) and the thighs (017) of the horseman (015) make no, or virtually no, contact with the saddle (002), and in particular with the saddle seat (005) and flaps (009) thereof. Depending on the height of the obstacle (020), the elevation of the horseman (015) will be identical to or greater than the elevation shown in FIG. 4. In this case, the legs of the horseman (015) will stretch even further than is the case with English riding or light-riding, so that the thigh (017) almost comes to lie in line with the lower leg (018). The upper arrows without letters and numbers show the to-and-fro movement of the body of the horseman (015) at the start and the end of the jump. The bottom arrows with the letters A and B show the to-and-fro movement of the lower leg (018) from a first lower leg position (A) to a second lower leg position (B) and back again to the first lower leg position (A), as shown in FIGS. 2-4.

It is notable that the lower legs (018) are situated further backwards with respect to the horse (001) and saddle (002) and girth (003) during the upward jump, but that the lower legs (018) still hang perpendicularly downwards, illustrated here as first leg position A. The lower legs (018) assume a similar position when the horseman (015) is on a horse (001) on an upwardly sloping surface. Conversely, in the case of a downward jump or a downwardly sloping surface, the lower legs (018) of the horseman (015) and the first leg position will be situated further to the front with respect to the horse (001), saddle (002) and girth (003), but also in that case still hang down perpendicularly (this first leg position in which the legs are situated further forward is not shown here).

Figures 6A, 6B, 6C:
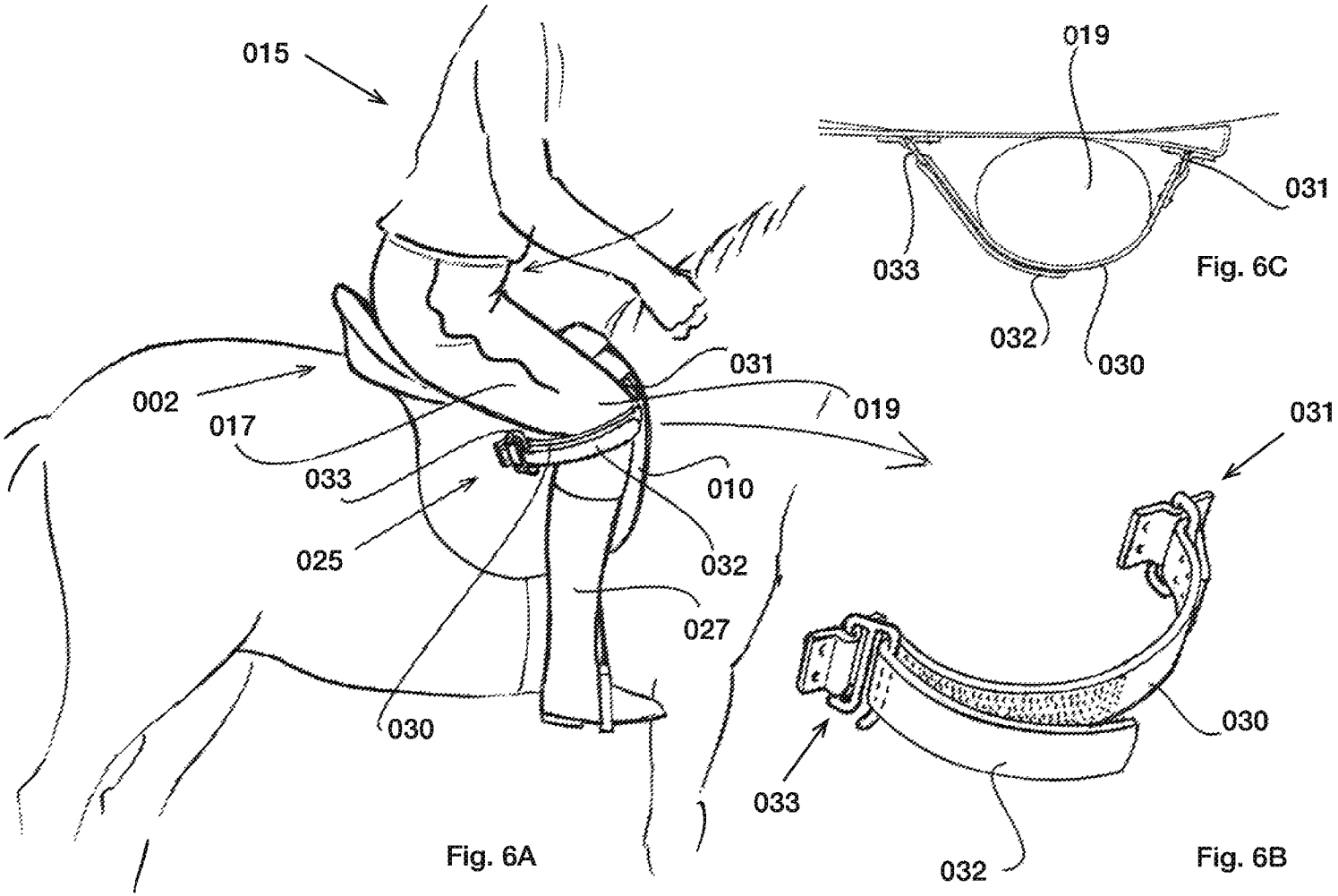
FIG. 6A is an enlarged partial right-hand side view of a horse carrying a first embodiment of the saddle equipped with a horseman securing device.
FIG. 6B is an enlarged perspective right-hand view of a strip of the horseman-securing device of FIG. 6A.
FIG. 6C is a horizontal cross section view of the horseman's right leg and the securing device of FIG. 6A and FIG. 6B holding it, as seen from above.

FIG. 6A shows a horseman-securing device by means of a strip-shaped securing element (025) on the outer side of the knee (019) of the horseman (015). In this text, the term outer side of the knee (019) is understood to refer to all sides of the knee (019) except the inner side, that is the side facing the saddle, with the exception of the knee roll (010). Only the right-hand side of the saddle (002) with lower body (026), thigh (017), knee (019) and upper part of the lower leg (027) of the horseman (015) is shown. The strip-shaped securing element (025) is shown in the form of a strip (030), one end (031) of which is attached in a fixed way to the front side of the saddle (002), preferably on the flap (009) and/or roll (010) thereof and the other end (032) of which is attached as a free end (032) in a non-fixed way on the rear side of the saddle, preferably on the flap (009) thereof. In this case, the free end (032) may have been passed through a loop or hook (033), which loop or hook (033) may itself be connected to the saddle (002) in a fixed way. The loop or hook (033) may be open on one side, preferably at the bottom side thereof, in order to facilitate quick disengagement of the strip (030) and/or free end (032).

FIG. 6B shows a detail of the free end (032) or strip (030) and the securing arrangement of loop or hook (033).

FIG. 6C shows a horizontal cross section of the right-hand knee (019) of the horseman (015), as seen from above, with the fixed end (031) of the strip-shaped element (030) at the front side of the saddle (002), and on the rear side the securing arrangement of the free end (032) through a hook or loop (033) on the rear side of the saddle (002). The strip (030), and in particular the free end (032) thereof, may be fixed in different ways, for example by providing a hook and loop fastener on the outer side of strip (030), in which the inwardly directed surface of the free end (032) of the strip which is folded back once is of the type other than the hook and loop fastener which is provided on the outer side of the strip (030) which is situated on the outer side of the knee and which comes into contact with the folded-back part of the free end (032) of the strip (030). If the horseman (015) wants to set himself free, he only needs to release the free end (032) of the strip-shaped element (030) by pulling it outwards and backwards. In order to facilitate release of the strip (030), a preferred embodiment of the invention is such that the free end (032) is passed through a loop or hook (033) which is open on one side, preferably the bottom or top side, so that, when the strip (030) is no longer under tension, it is released from the loop or hook (033) completely by itself or through a small movement of the horseman (015). To ensure the correct functioning of a horseman-securing device by means of a strip-shaped securing element (025) on the outer side of the knee (019) of the horseman (015), a preferred embodiment of the invention is configured in such a way that a hook and loop fastener of the one type is provided on the outer side of the knee (019), at least on the clothing of the horseman (015), and a hook and loop fastener of the other type is provided on the inner side of the strip-shaped element (030). Of course, a simple buckle may also serve as securing arrangement.

Figure 7C:
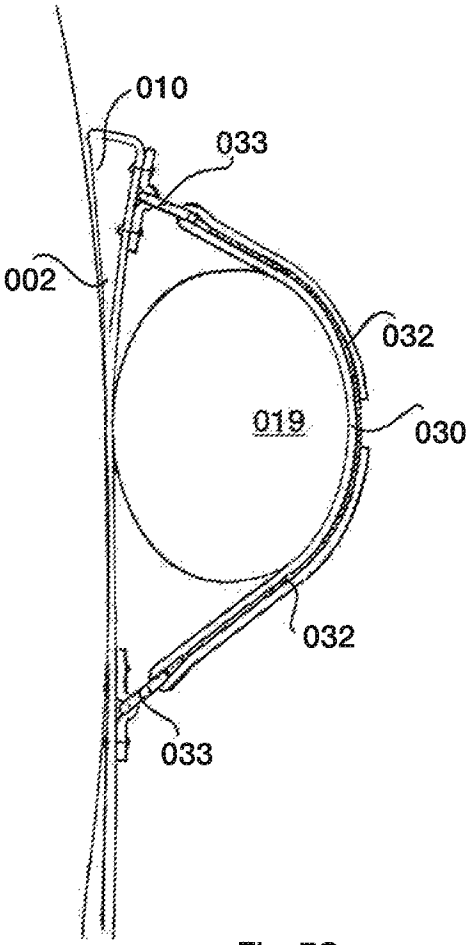
FIG. 7C is a horizontal cross section view of the horseman's right leg as seen from above and the securing device of FIG. 6A-C.
Figure 7B:
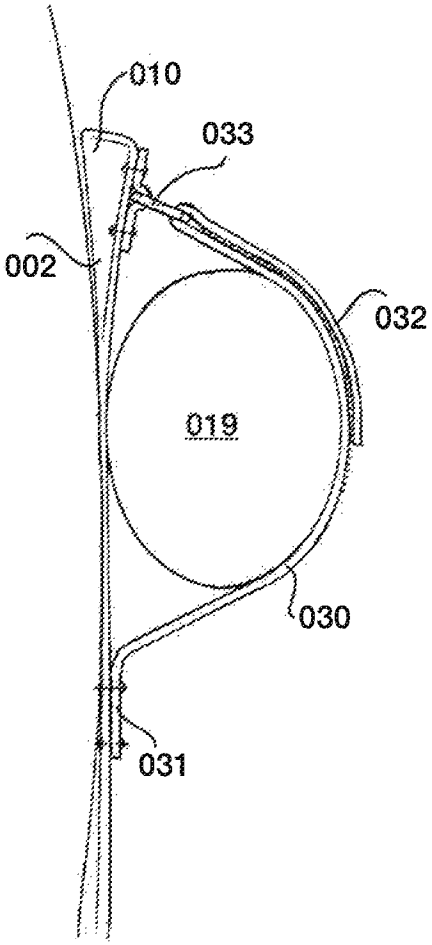
FIG. 7B is a horizontal cross section view of the horseman's right leg as seen from above and the securing device of FIG. 6A-C.
Figure 7A:
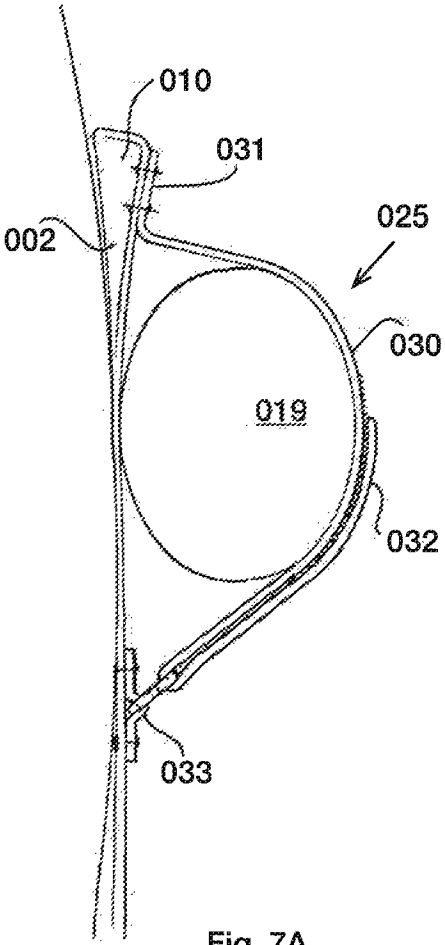
FIG. 7A is a horizontal cross section view of the horseman's right leg as seen from above and the securing device of FIG. 6A-C.

FIGS. 7A-7C show a horizontal cross section of a horseman-securing device by means of a strip-shaped securing element (025) on the outer side of the right-hand knee (019) of the horseman (015), seen from above. The top side of the figure corresponds to the front side of the saddle (002), in which the thickened part is the roll (010).

FIG. 7A shows a strip (030) on the outer side of the knee (019), in which one end (031) is fixedly connected at the front side of the knee (019) to the saddle and a free end (032) of the strip (030) which is releasably connected to the saddle (002) at the rear side of the knee (019) by means of a hook or eyelet (033), all this corresponding to FIGS. 6A-C.

FIG. 7B shows a strip (030) which runs in the reverse direction compared to FIGS. 6A-C, in which the strip (030) is situated on the outer side of the knee (019), in which one end (031) is fixedly connected at the rear side of the knee (019) to the saddle and a free end (032) of the strip (030) which is releasably connected at the front side of the knee (019) to the saddle (002) by means of a hook or eyelet (033).

FIG. 7C shows a strip (030) on the outer side of the knee (019), in which both ends (033) are releasably connected to the saddle (002), both at the front and rear side of the knee (019), by means of a hook or eyelet (033). In these embodiments, the free end (032) of the strip (030) can also be attached to the outer side of the strip (030) at the location of the outer side of the knee (019) by means of a hook and loop fastener, such as described for FIGS. 6A-C.

FIGS. 8A-8D show that a plurality of strip-shaped elements or strips (030) is possible instead of the single strip shown in FIGS. 6 and 7. When using several strips (030), the intermediate space between different strips (030) may be filled with textiles, plastic and the like to provide more support, and in a number of cases also passive protection, to the knee (019). Such fillings may be provided not only at the front side, but also in the hollow of the knee as well as on the lateral side of the knee (019). The strips (030) may also start from reinforcements and curvatures of the saddle (002), such as for example the roll (010) at the front side of the knee (019). Such strip-shaped securing elements (030) may be used independently, but also as an assembly of ancillary means which are situated at the location of the knee (019) of the horseman (015) or on his clothing locally.

Figure 8B:
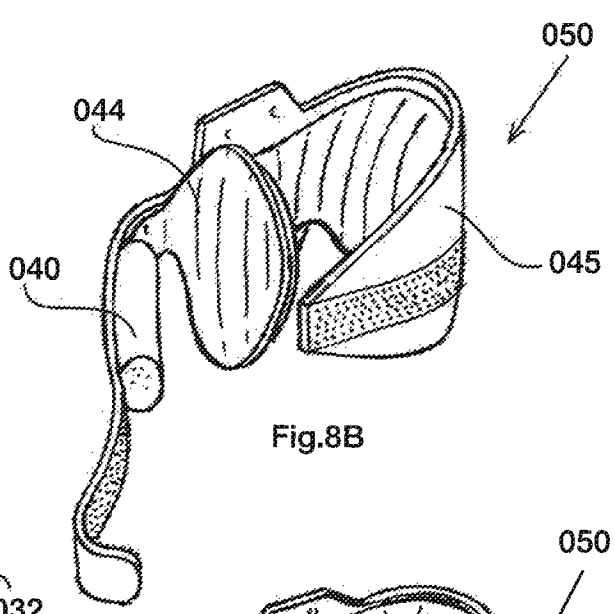
FIG. 8B-C is a right-hand side view of a knee-strengthening aid and knee-enclosing structure.
Figure 8C:
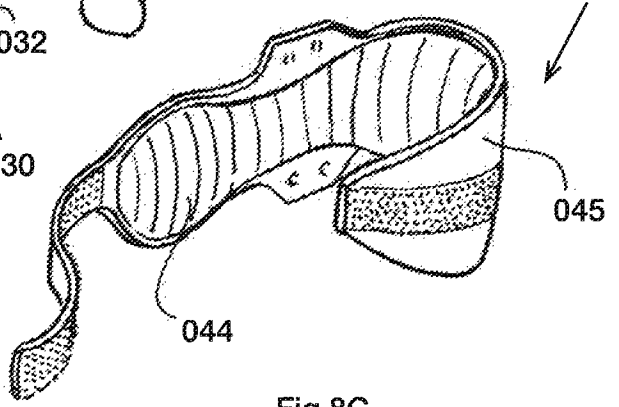
Figure 8A:
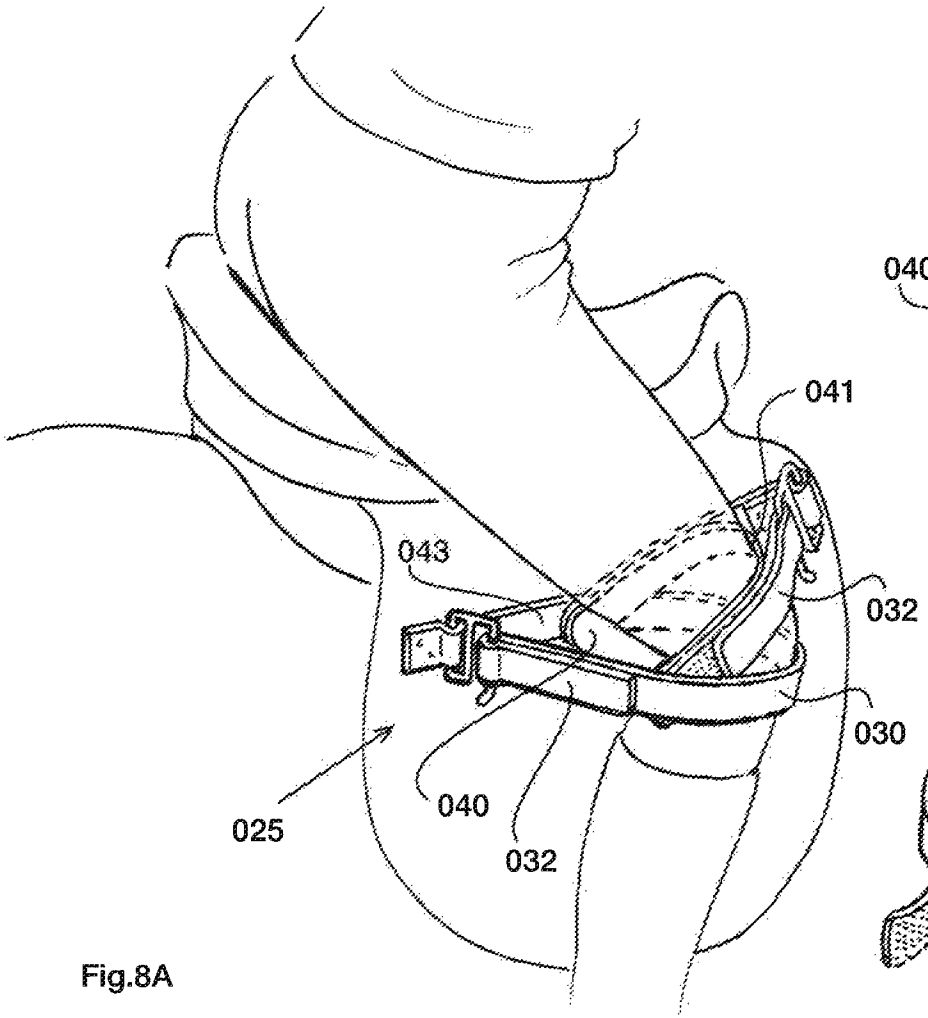
FIG. 8A is an enlarged partial right-hand side view of a horse carrying a saddle equipped with another embodiment of a horseman securing device by means of multiple strip-shaped securing elements on the outer and inner side of the knee of the horseman and with the horseman sitting on the saddle and secured by the device.

FIG. 8A shows a horseman-securing device by means of a strip-shaped securing element (025) on the outer and inner side of the knee (019) of the horseman (015). In this embodiment, several strips (030) are used which run in different directions, with a strip (040) which has been provided with extra thickening being arranged in the hollow of the knee and a strip (041) being arranged above the kneecap and a strip (042) being arranged below the kneecap. Here, the strip (043) is shown on the inner side of the knee (019), but it may also be absent.

FIGS. 8B and 8C show a horseman-securing device by means of a strip-shaped securing element (025) on the outer side of the knee (019) of the horseman (015), in which a separate or integrated knee-strengthening aid (050) is shown. This knee-strengthening aid consists of a thickening (040) in the hollow of the knee, which optionally presses against a larger element (044) which fills the hollow of the knee. At the front side of the knee (019), the kneecap is completely covered by a knee-enclosing structure (045). The strips (030) mentioned and shown above may be incorporated in this knee-strengthening aid (046) or may run through or around it. The knee-strengthening aid (050) may also form part of the clothing of the horseman (015) or be worn as a separate item on top of the clothing of the horseman at the location of the knee.

Figure 8D:
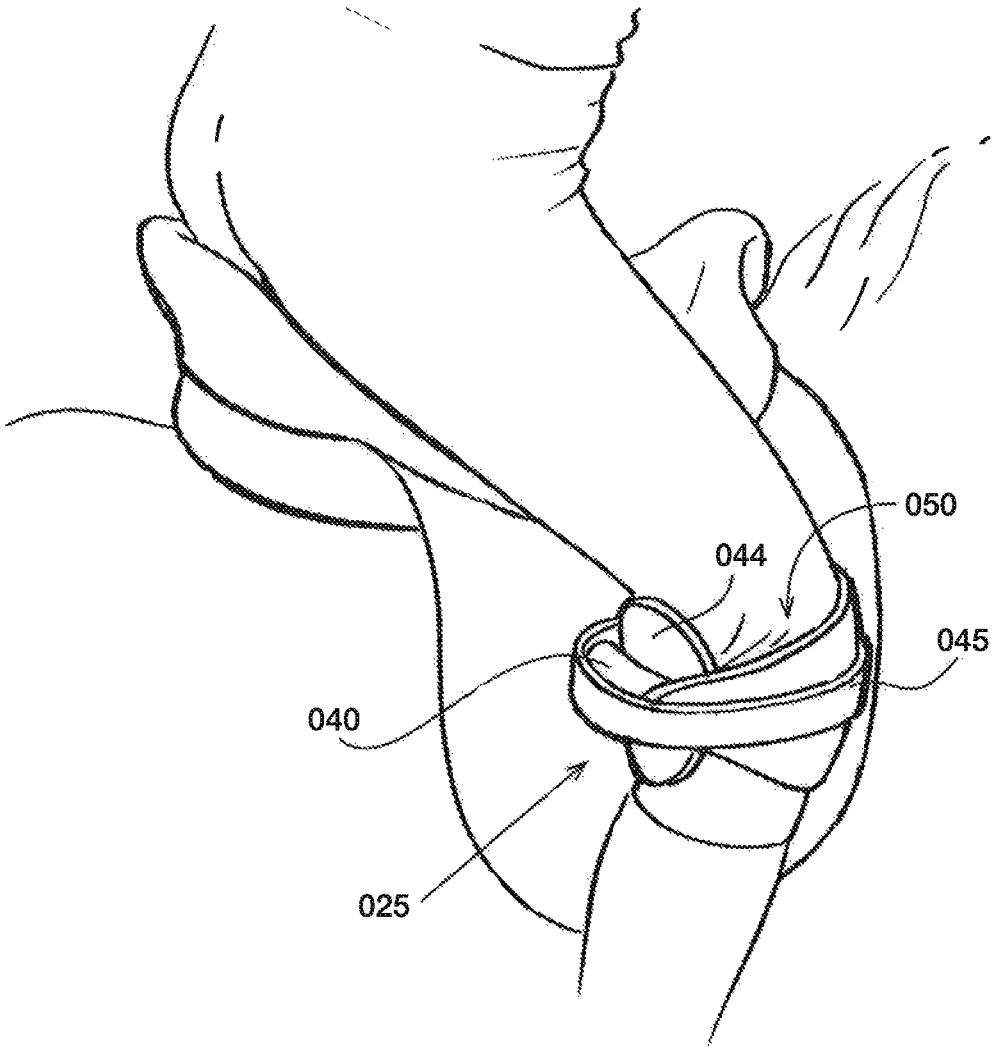
FIG. 8D is a right-hand side view of a horse carrying another embodiment of the saddle equipped with a horseman securing device of FIG. 8A in which the knee-strengthening aid is combined with strip-shaped securing means.

FIG. 8D shows in which way the knee-strengthening aid may be combined with a strip-shaped securing device.

Figure 9:
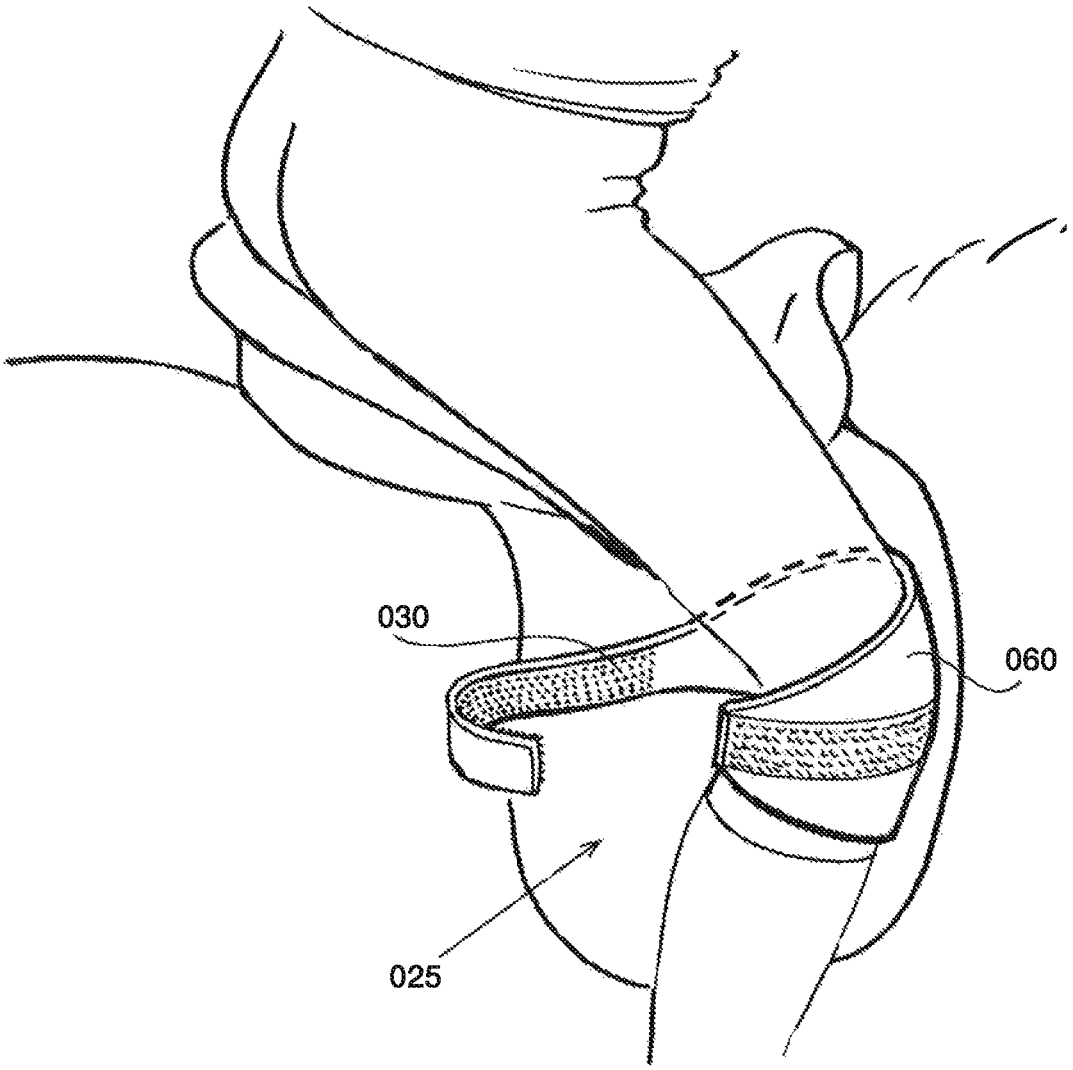
FIG. 9 is an enlarged partial right-hand side view of a horse carrying another embodiment of a saddle equipped with a horseman securing device by means of a strip-shaped securing element on the outer side of the knee of the horseman, in which the strip-shaped securing element forms a part of one or more toughened parts which form or forms a single part with the saddle.

FIG. 9 shows a horseman-securing device by means of a strip-shaped securing element (025) on the outer side of the knee (019) of the horseman (015), in which the strip-shaped securing element forms a part of one or more toughened parts (060) which forms or form a single part with the saddle (002), preferably situated at the front side, forming a single part with the knee roll (010), see FIG. 6A. Such a toughened part may be configured to be integrated with the saddle in leather and filled with the same materials used for making a leather saddle, but may also be made of toughened plastic with a soft filling. In this way, the toughened part contributes to the passive safety of the horseman (015), and in particular of his knees. The medial part of this toughened part (060) may be very thin or be completely absent to ensure a free and good contact of the inner side of the knee (019) of the horseman (015). The strip (030) encloses the knee from the rear side of the knee and is shown here in such a way that the enclosure is ensured by securing a hook and loop fastener, provided on the inner side of the strip (030) and outer side of the toughened part (060), with two different types of hook and loop fastener being used. Of course, other ways of securing the enclosure are also possible, such as for example buckles and the like.

Figure 10:
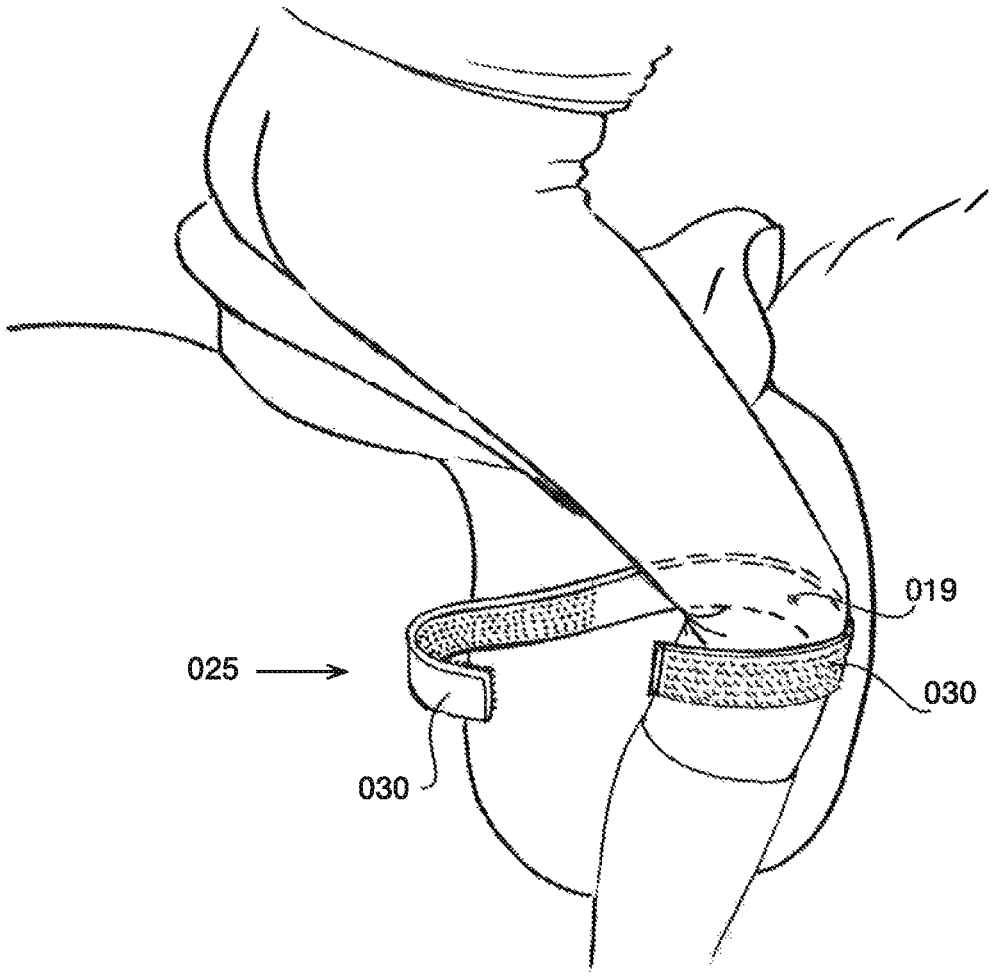
FIG. 10 is an enlarged partial right-hand side view of a horse carrying the saddle equipped with another embodiment of a horseman securing device by means of a strip-shaped securing element around the knee of the horseman, in which the strip-shaped securing element only consists of one strip, in which the 2 free ends can be fastened to each other by means of two types of hook and loop fastener.

FIG. 10 shows a horseman-securing device by means of a strip-shaped securing element (025) around the knee (019) of the horseman (015), in which the strip-shaped securing element only consists of one or more strips, in which at least 2 free ends can be fastened to each other by means of two types of hook and loop fastener, one type of which is arranged on the side of the strip (030) facing the knee and the other type is arranged on the side of the other strip (030) facing away from the knee. In the illustrated drawing, a single strip with 2 free ends is shown, but the medial part of the strip may also be omitted, as a result of which 2 separate strips are created, in which the knee can rest even closer against the saddle.

Figure 11B:
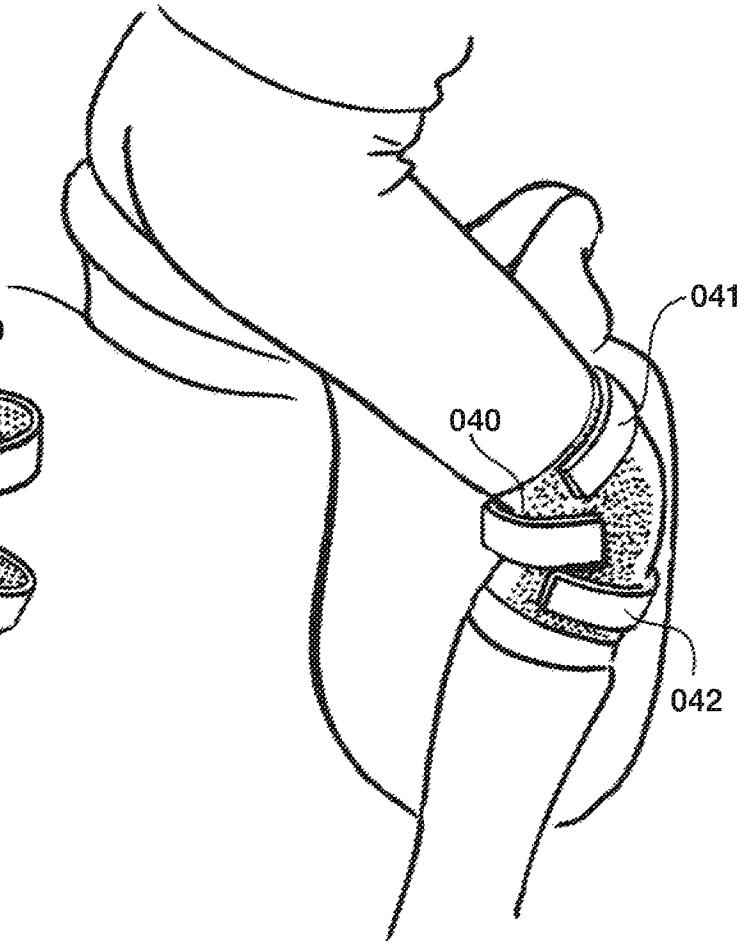
FIG. 11B is an enlarged partial right-hand side view of a saddle with a horseman securing device by means of three strip-shaped securing elements with one type of hook and loop fasteners on one side and a hook and loop fastener of the other type on the outer side of the knee of the horseman.
Figure 11A:
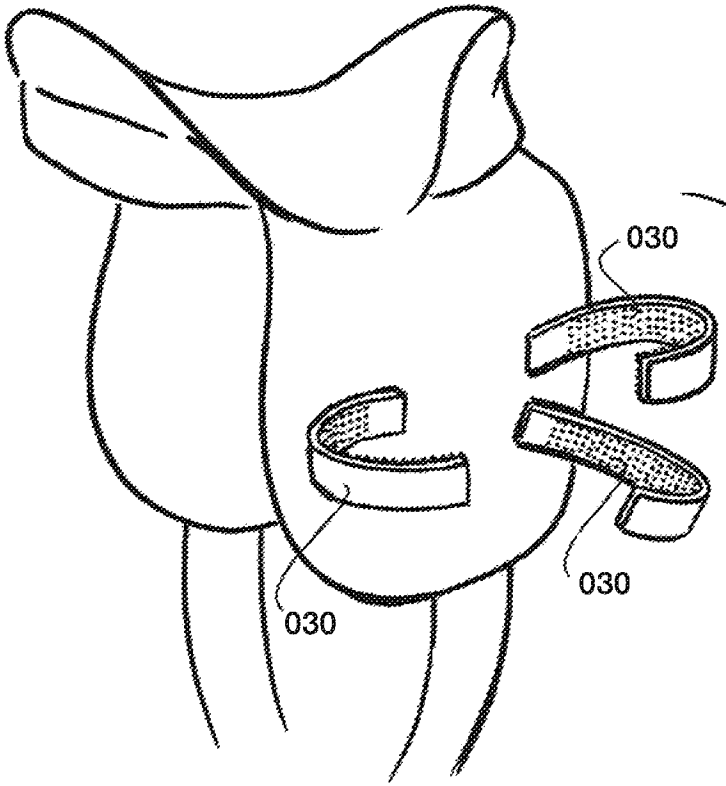
FIG. 11A is a right-side side perspective view of a saddle equipped with a horseman securing device by means of three strip-shaped securing elements with one type of hook and loop fasteners on one side turned towards the knee of the horseman as depicted in FIG. 11B.

FIGS. 11A and 11B show a horseman-securing device which consists of an assembly of strip-shaped securing elements (030) which are arranged on the saddle (002), with one type of hook and loop fastener on one side and a hook and loop fastener of the other type at the location of the knee of the horseman, at least his clothing or a separately worn garment, such as an optionally elastic knee sock (070).

FIG. 11A shows 3 strips (030) which are connected to the outer side of the saddle, optionally in a continuous manner.

FIG. 11B shows that these strips are attached around the knee (019), at least on the front, rear and outer side thereof, by means of a hook and loop fastener of the one type on the side of the strips (030) turned towards the knee and a hook and loop fastener of the other type on the outer side of the knee, at least of the clothing or additional garment of the horseman. In this case, one strip (041) is situated above the kneecap and one strip (042) below the kneecap and 1 strip (040) in the hollow of the knee. Other positions of the strips are also possible. Also, the attachment of the strips (030) at the location of the saddle may be situated further to the front or to the back with respect to the knee.

FIGS. 12A-12D show an assembly of a horseman-securing device by means of a strip-shaped securing element (025) around the knee (019) of the horseman (015), in which the strip-shaped securing element (030) is situated between two thickenings (071) and (072) arranged at the location of the knee (019) of the horseman (015). In this case, one thickening (071) may be situated above the kneecap and one thickening (072) below the kneecap, in which case both thickenings may form a V shape, in which the largest distance may be situated at the front side of the knee (019) of the horseman (015). These thickenings (071 and 072) may be provided directly on the clothing of the horseman (015), such as on the pair of riding breeches of the horseman, but may also be provided on separate optionally elastic knee socks (070).

Figures 12A, 12B, 12C, 12D:
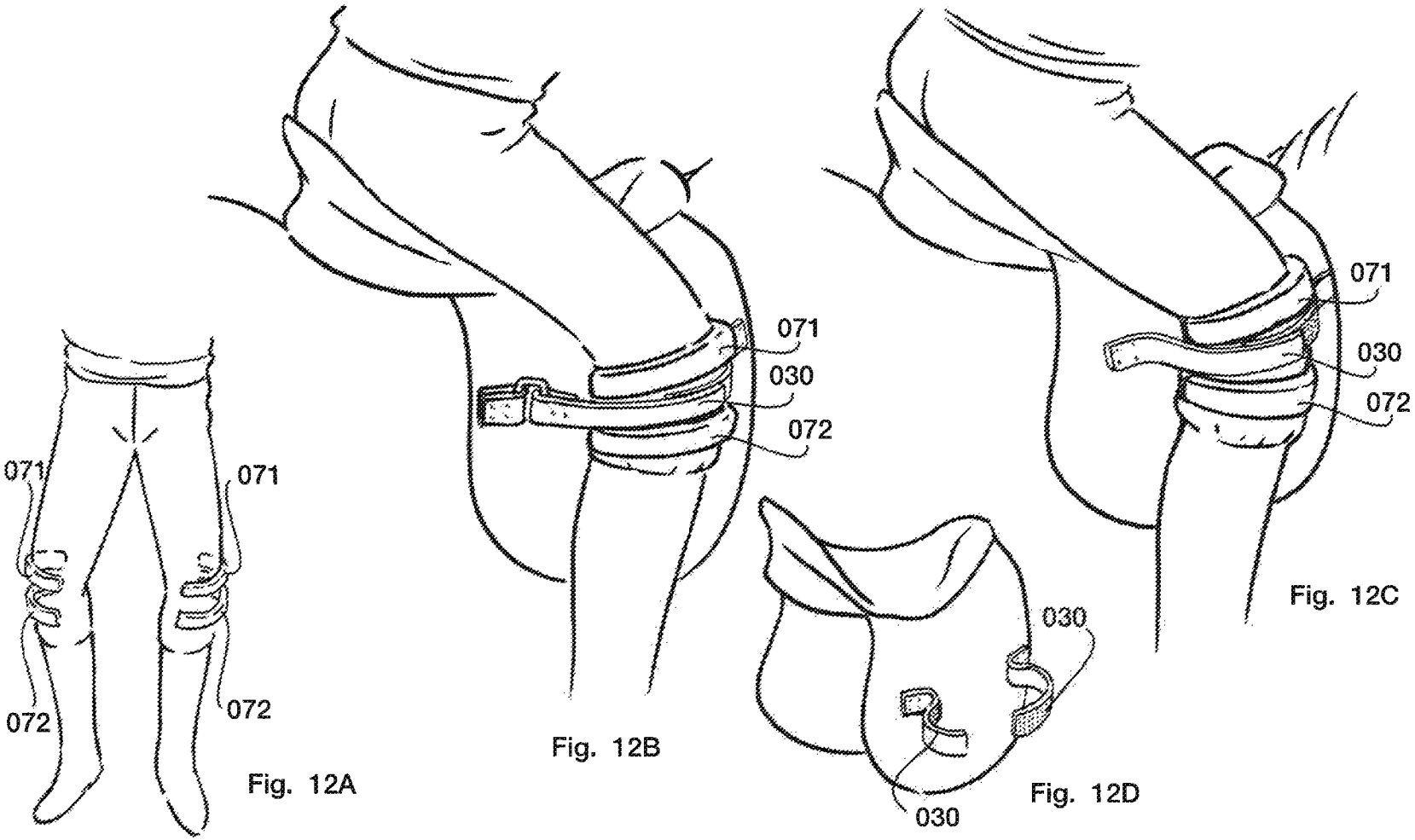
FIG. 12A is a front view of the legs of a horseman with two thickenings at the lateral side of (the clothing at) his knees.
FIG. 12B is an enlarged partial right-hand side view of a horse carrying a saddle equipped with another embodiment of a horseman securing device by means of an assembly of a strip-shaped element starting from the saddle and positioned between two lateral thickenings and around the knee of the horseman.
FIG. 12C is an enlarged partial right-hand side view of a horse carrying a saddle equipped with the horseman securing device as in FIG. 12B, in which the strip-shaped elements can be fastened by means of a hook and loop fastener of the one type on the inner side of a strip and of the other type on the outer side of the other strip.
FIG. 12D is a right-hand side perspective view of a saddle equipped with the horseman securing device as in FIG. 12C.

FIG. 12A shows an example of the way in which the thickenings (071) and (072) may be provided or are worn on the lateral side of the knees (019) of the horseman (015). Preferably, these thickenings are provided around the knee, but not on the inner side (side of the knee (019) of the horseman (002) facing the saddle (002).

FIG. 12B shows an assembly of a strip-shaped element (030) starting from the saddle (002) and positioned between the two lateral thickenings (071) and (072) around the knee (019) of the horseman (015). The strip-shaped structure is shown as a strip (030) such as that shown in FIGS. 6 and 7A, but may also be one or more of the other strip-shaped elements described and/or shown in this application.

FIGS. 12 C and D show two strip-shaped elements (030) which are attached to the saddle (002) and which are situated between the two thickenings (071 and 072) which can be fastened by means of a hook and loop fastener of the one type on the inner side of a strip (030) and of the other type on the outer side of the other strip (030).

Figure 13A:
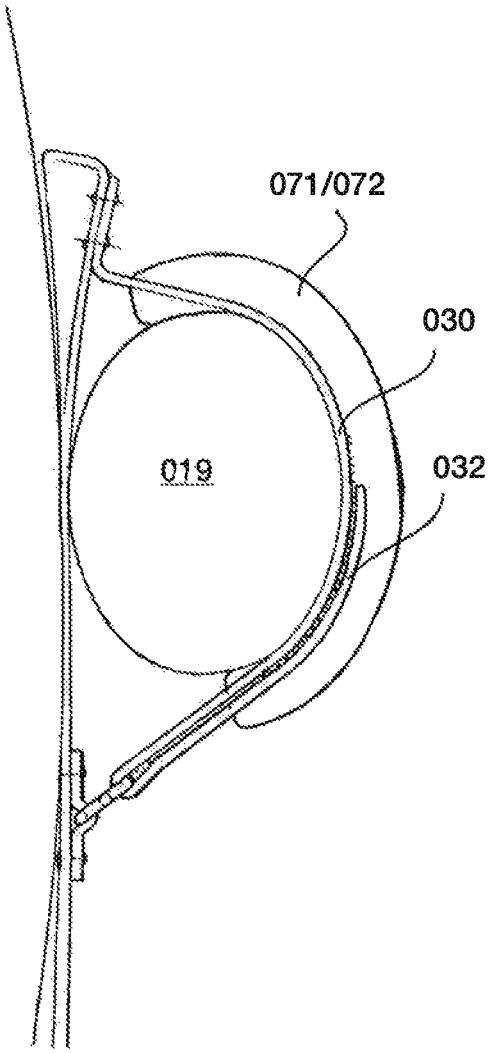
FIG. 13A is a horizontal cross section view of the horseman's right leg as seen from above and the securing device of FIG. 12B.
Figure 13B:
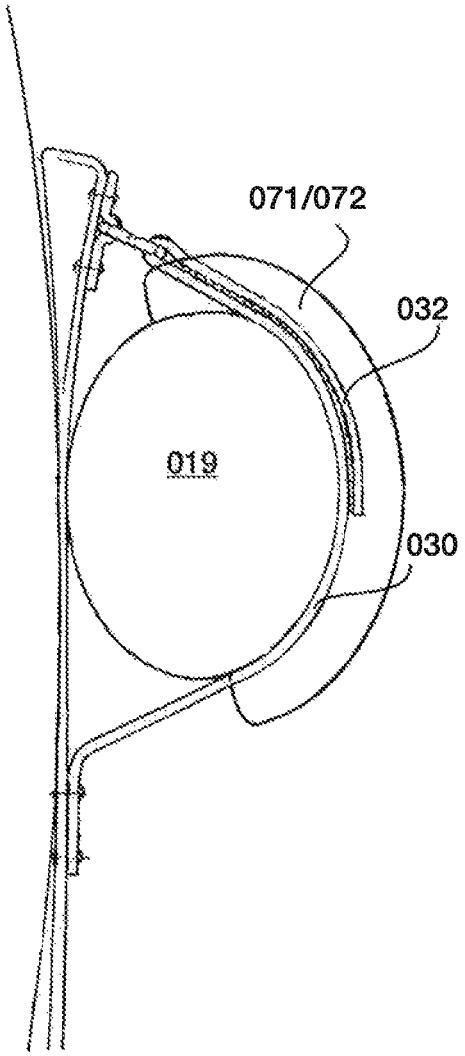
FIG. 13B is a horizontal cross section view of the horseman's right leg as seen from above and the securing device of FIG. 12C.

FIGS. 13A and 13B show a horizontal cross section of a horseman-securing device by means of a strip-shaped securing element (025) around the right-hand knee (019) of the horseman (015), seen from above, in which the strip-shaped securing element (030) is situated between two thickenings (071) and (072) provided at the location of the knee (019) of the horseman (015).

FIG. 13A shows a cross section of FIG. 12B, while FIG. 13B shows a cross section of FIG. 12C.

Figures 14A, 14B, 14C:
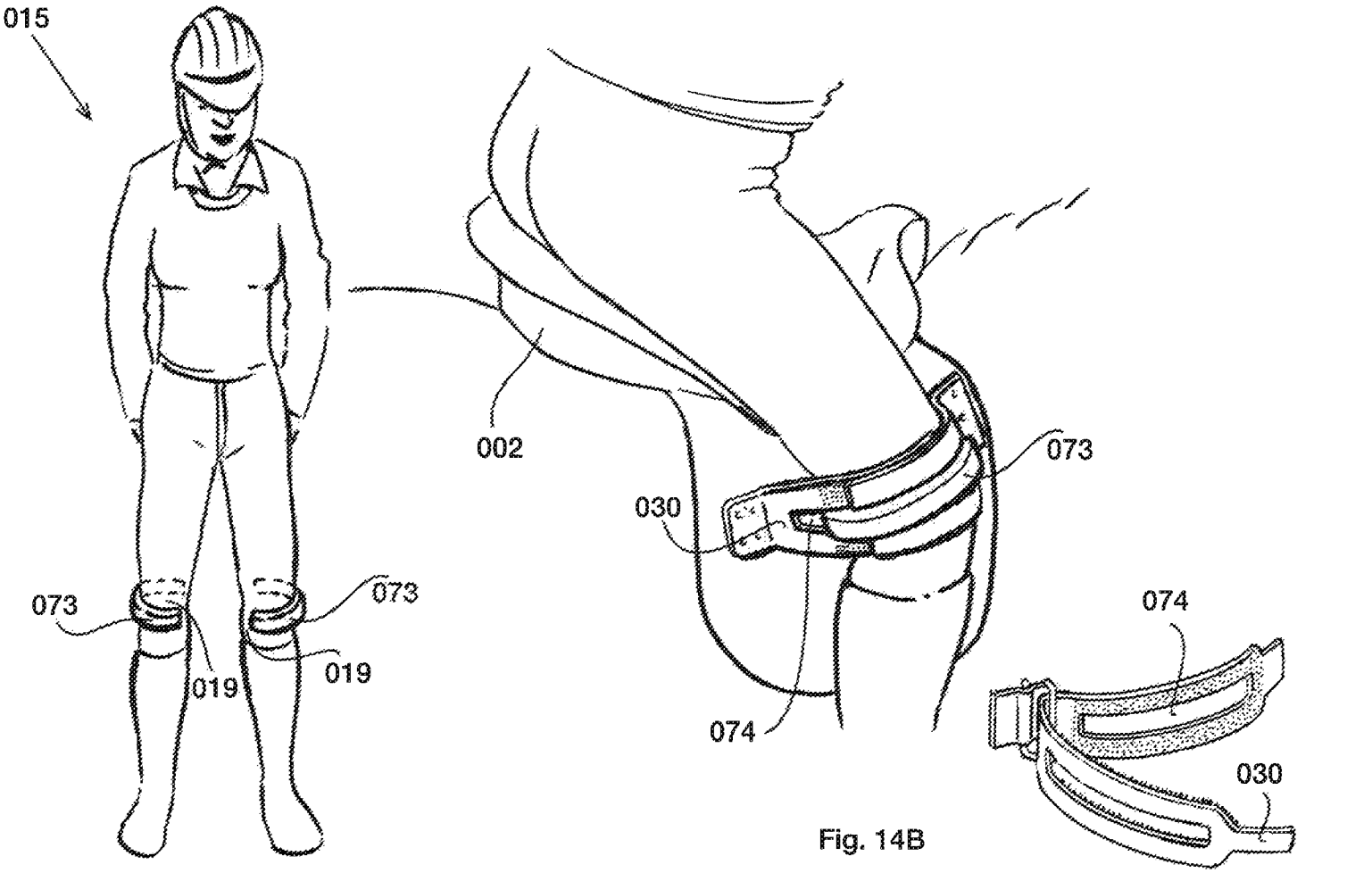
FIG. 14A is a front view of a horseman provided with thickenings at the lateral side of (the clothing at) his knees.
FIG. 14B is an enlarged partial right-hand side view of a horse carrying a saddle equipped with another embodiment of a horseman securing device by means of an assembly of a strip-shaped element starting from the saddle and positioned on either side of the lateral thickenings at the location of the knee joint of the horseman.
FIG. 14C is a perspective right-hand side view of a detail of the strip-shaped structure of the assembly as shown in FIG. 14B.

FIGS. 14A-14C show an assembly of a horseman-securing device by means of a strip-shaped securing element (025) around the knee (019) of the horseman (015), in which the strip-shaped securing element (030) has an opening which is situated on either side of a thickening (073) provided at the location of the knee (019) of the horseman (015).

FIG. 14A shows an example of the way in which the thickenings (073) may be provided or worn on the lateral side of the knees (019) of the horseman (015). Preferably, these thickenings are arranged around the knee, but not on the inner side (side of the knee (019) of the horseman (002) facing the saddle (002). Preferably, the thickening will be situated at the location of the knee joint (019) of the horseman (015).

FIG. 14B shows an assembly of a strip-shaped element (030) starting from the saddle (002) and positioned on either side of the lateral thickenings (073) at the location of the knee joint (019) of the horseman (015). The strip-shaped structure is shown as a strip (030) such as that shown in FIGS. 6 and 7A, but may also be one or more of the other strip-shaped elements described and/or shown in this application, and furthermore has an opening which fits exactly around the thickening (073). In a preferred embodiment, the height of the thickening (073) is slightly greater at the front side than at the rear side, in which case the thickening may also have a triangular shape, and the strip-shaped element (030) has a corresponding opening (074), so that the thickening (073) fits exactly into the opening (074).

FIG. 14C shows only the strip-shaped structure of the assembly as shown in FIG. 14B. The strip-shaped structure is shown as a strip (030) and has an opening (074) which fits exactly around the thickening (073) and in which the strip also has a free end which can be passed through an open hook, for example on the rear side of the knee, with this free end also having an opening which fits exactly around the thickening (073). The first part of the strip-shaped structure can then readily be attached to the free part of the strip and easily released therefrom by means of a hook and loop fastener.

FIGS. 15A-15D show a horseman-securing device by means of an assembly of strip-shaped securing elements (030) and semi-stiff clamping aids which may be arranged on the outer side of the knee (019) of the horseman (015).

Figure 15B:
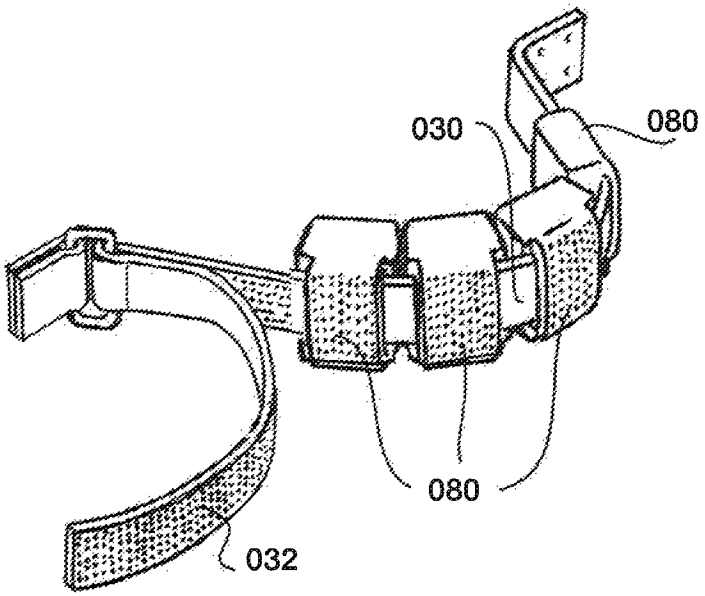
FIG. 15B is a right-hand side view of a strip-shaped securing element with a free end, as is for example illustrated in the FIG. 6, which runs through a plurality of semi-stiff clamping aids.
Figure 15A:
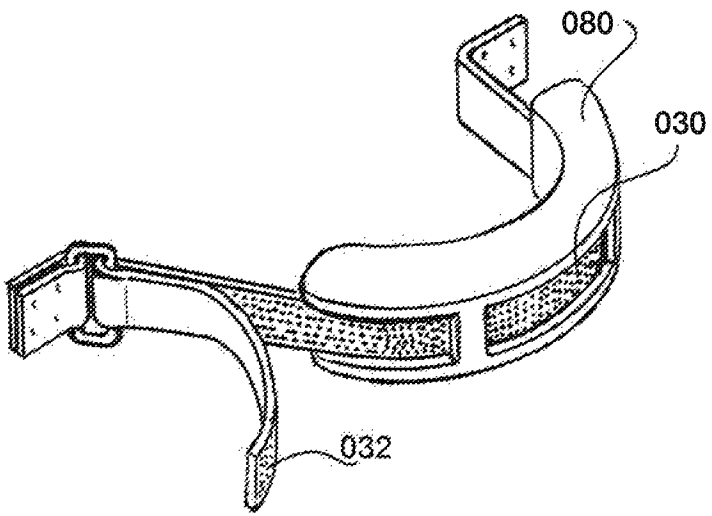
FIG. 15A is a perspective right-hand side view of a strip-shaped securing element with a free end, as is for example illustrated in the FIG. 6, in which the strip runs through a semi-stiff clamping aid, which preferably fits on the outer side of the knee of the horseman.

FIG. 15A shows a strip-shaped securing element (030) with a free end (032), as is for example illustrated in the FIG. 6, in which the strip (030) runs through a semi-stiff clamping aid (080), which preferably fits on the outer side of the knee (019) of the horseman (015). In this case, the material has to be strong, at least on the outer side, so that the aid contributes to the passive protection of the knee (019), but flexible on the inner side, so that it rests comfortably on the outer side of the knee (019).

FIG. 15B shows a strip-shaped securing element (030) with a free end (032), as is for example illustrated in the FIG. 6, in which the strip (030) runs through several semi-stiff clamping aids (080), which preferably fits on the outer side of the knee (019) of the horseman (015). For the remainder, FIG. 15B corresponds to FIG. 15A. The plurality of aids (080) can adapt to the different shapes of knees (019) of horsemen (015) more easily.

Figure 15D:
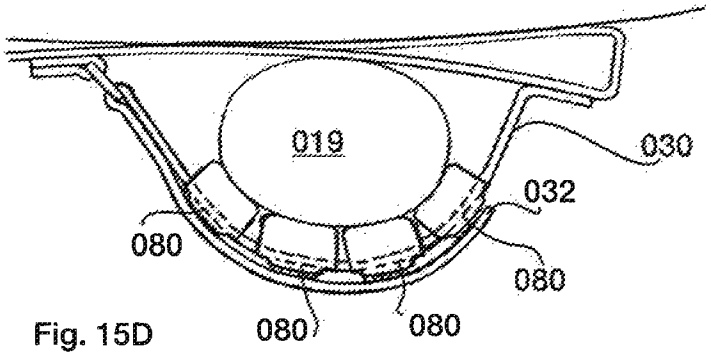
FIG. 15D is a horizontal cross section through the right knee of a horseman as seen from above with a strip-shaped securing element with a free end, as is illustrated in FIG. 15B.
Figure 15C:
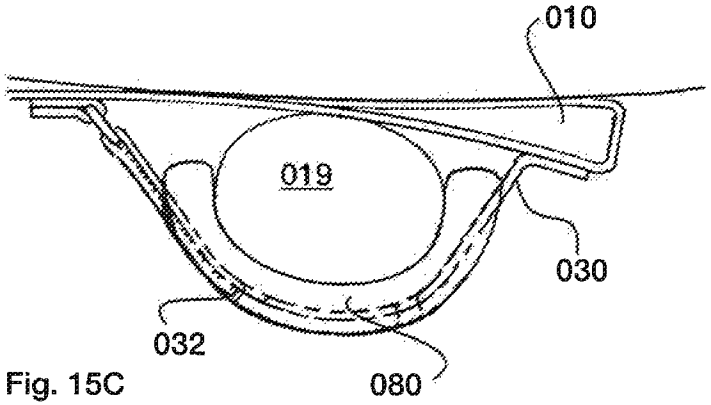
FIG. 15C is a horizontal cross section through the right knee of a horseman as seen from above with a strip-shaped securing element with a free end, as is illustrated in FIG. 15A.

FIG. 15C shows a horizontal cross section of a strip-shaped securing element (030) with a free end (032), as is illustrated in FIG. 15A in which the strip (030) runs through a semi-stiff clamping aid (080), which preferably fits on the outer side of the knee (019) of the horseman (015). Only a horizontal cross section of the right-hand knee is represented, as seen from above.

FIG. 15D shows a horizontal cross section of a strip-shaped securing element (030) with a free end (032), as is illustrated in FIG. 15B, in which the strip (030) runs through several semi-stiff clamping aids (080), which preferably fits on the outer side of the knee (019) of the horseman (015). Only a horizontal cross section of right-hand knee is represented, as seen from above.

FIGS. 16A-16D show a horseman-securing device by means of securing elements of the clamping type (090) which can clamp a knee (019) of the horseman (015), in which case these clamping structures can be opened and closed by pivoting. Preferably, the outer side of the securing element is made of toughened or hard material, in order to contribute to the passive protection, and of soft material on the inner side. The pivotability may be achieved by means of one or more hinges (091) with a more or less vertical axle. The hinge (091) may in this case be fastened temporarily and released again by means of a mechanism which acts on the hinge (091) itself or by means of strips, including a hook and loop fastener, as described and shown elsewhere in this application, or other opening and closing mechanisms.

In this case, use can also be made of, for example, a hook and loop fastener. The pivotable clamping structure (090) is similar to a binding such as those which are used in skis.

Figure 16B:
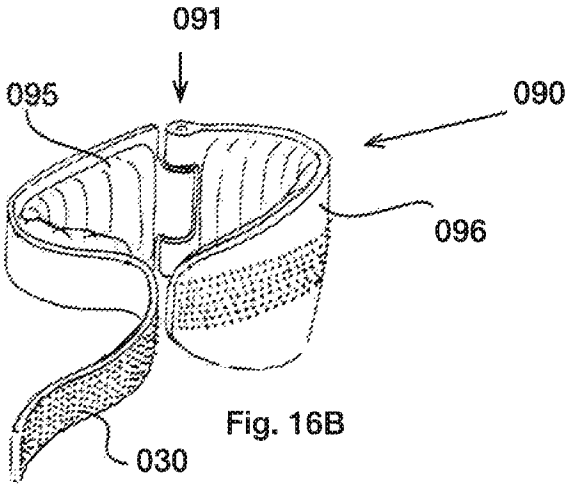
FIG. 16B is perspective right-hand side and rear view of an isolated pivotable clamping structure intended for the knee of the horseman, which actually consists of two parts, a pivotable part and a non-pivotable counterpart, as in FIG. 16A.
Figure 16D:
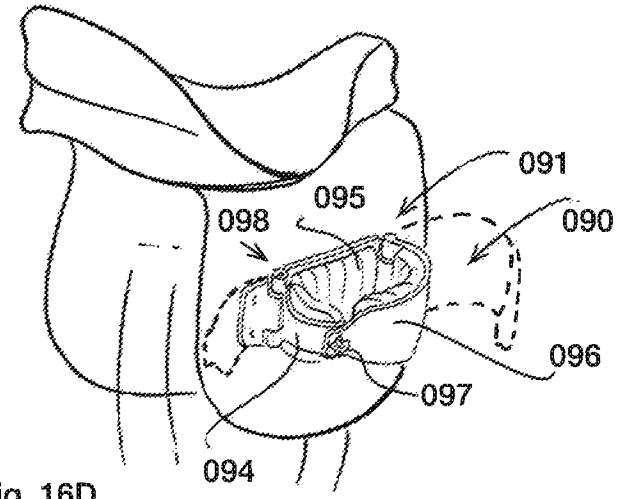
FIG. 16D is a perspective right-hand side and rear view of a saddle with a horseman securing device with a securing element of the clamping type which can clamp the knee of the horseman with a pivotable clamping structure, in which a second hinge is provided on the rear side of the knee instead of a single hinge on the front side of the knee.
Figure 16A:
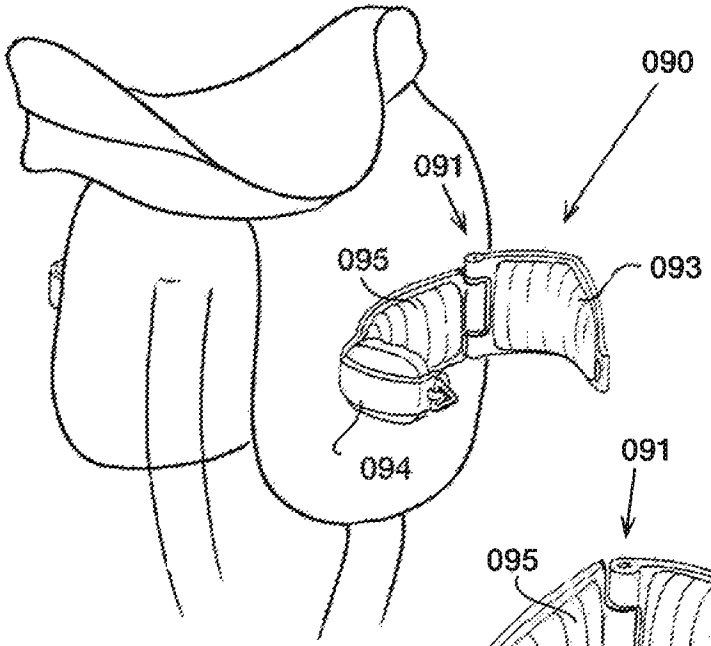
FIG. 16A is a perspective right-hand side and rear view of a saddle with another embodiment of a horseman securing device with a securing element of the clamping type which can clamp the knee of the horseman, in which case this clamping structure can be opened and closed by pivoting.

FIG. 16A shows a securing element of the clamping type (090) which can clamp the right-hand knee (019) of the horseman (015), in which case this clamping structure can be opened and closed by pivoting, in which case the hinge (091) is situated at the front side near the knee roll (010) or is incorporated therein, in which case the axle of such a hinge will generally extend in the vertical direction. The clamping structure (090) itself is shown here as consisting of four parts, namely a part which is situated on the front side of the knee (092), on the lateral side (093), on the rear side (094) and, if desired, also on the medial side (095) of the knee (019). In this case, the front side (092) and lateral (093) side parts are shown as being movable. The pivotable clamping structure (090) may consist of more or fewer optionally pivotable parts, provided at least one part is pivotable. The medial and/or rear part of the securing element may also be completely omitted.

Thus, FIG. 16B shows a pivotable clamping structure (090) intended for the right-hand knee (019) of the horseman (015), which actually consists of two parts, a pivotable part (096) which combines the parts (092) and (093) from FIG. 16A, and a non-pivotable counterpart (095) which combines the parts (094) and (095) from FIG. 16A. The saddle (002) has been omitted here for the sake of simplicity. As an example of a temporary closure of the pivotable part (096), a hook and loop fastener (030) is shown, in which the closure is effected by using two types of hook and loop fastener.

Figure 16C:
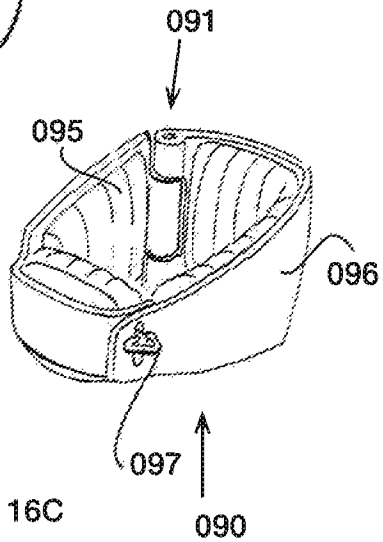
FIG. 16C is a perspective right-hand side and rear view of an isolated pivotable clamping structure intended for the knee of the horseman, similar to the clamping structure shown in FIG. 16B, but now with a closable connection between the two parts of the clamping structure.

FIG. 16C shows the pivotable clamping structure (090) for the right-hand knee, similar to the clamping structure (090) shown in FIG. 16B, but now with a closable connection (097) between the two parts (096) and (095) of the clamping structure (090).

FIG. 16D shows a pivotable clamping structure (090) for the right-hand knee, in which a second hinge (098) is provided on the rear side of the knee instead of a single hinge (091) on the front side of the knee (019). The other numbers are identical to those in FIGS. 16A-C. The dashed lines indicate the pivotable clamping structures in the open position.

FIGS. 17A-17E show horizontal cross sections of horseman-securing devices by means of securing elements of the clamping type (090), which can clamp a knee (019) of the horseman (015), in which case these clamping structures can be opened and closed by pivoting. The drawings show such horseman-securing devices for the right-hand knee (019) of the horseman (015), seen from above, in which only the saddle parts at the location of the horseman-securing device are illustrated. For the sake of simplicity, the rest of the saddle has in this case been omitted.

FIG. 17A shows a horizontal cross section of a pivotable clamping structure (090) intended for the right-hand knee (019) of the horseman (015), which in fact consists of two parts, a pivotable part (096) and a non-pivotable counterpart (095), as from FIGS. 16A-16C. The figure shown in a broken line represent the pivotable part (096A) in the open position, while the figure shown by a solid line represents the pivotable part (096B) in a closed position around the knee (019).

FIG. 17B shows a horizontal cross section of a pivotable clamping structure (096) on the outer side of the knee, in which a second hinge (098) is situated on the rear side of the knee instead of a single hinge (091) on the front and lateral side of the knee (019), for the purpose of a pivotable clamping structure (094) on the rear side of the knee, similar to FIG. 16D.

FIG. 17C shows a horizontal cross section of a pivotable clamping structure (090) intended for the right-hand knee (019) of the horseman (015), which in fact consists of two parts, a pivotable part (094) and a non-pivotable counterpart (097). In this case, the pivotable part (094) is located on the rear side of the knee (019) and the hinge (091) is also situated on the rear side of the knee (019) on the saddle. In this case, the non-pivotable part (097) is situated on the medial, front and lateral sides of the knee. The figure shown by a broken line represents the pivotable part (094A) in the open position, while the figure shown by a solid line represents the pivotable part (094B) in the closed position around the knee (019).

FIG. 17D shows a horizontal cross section of a pivotable clamping structure (090) intended for the right-hand knee (019) of the horseman (015), similar to FIG. 17C, but with the difference that the hinge (091) is now not situated on the medial and rear sides of the knee, but on the lateral and rear sides of the knee (019). Furthermore, the numbering is identical to that of FIG. 17C.

FIG. 17E shows the pivotable clamping structure from FIG. 17A, seen from behind and from the side.

Figures 18A, 18B, 18C:
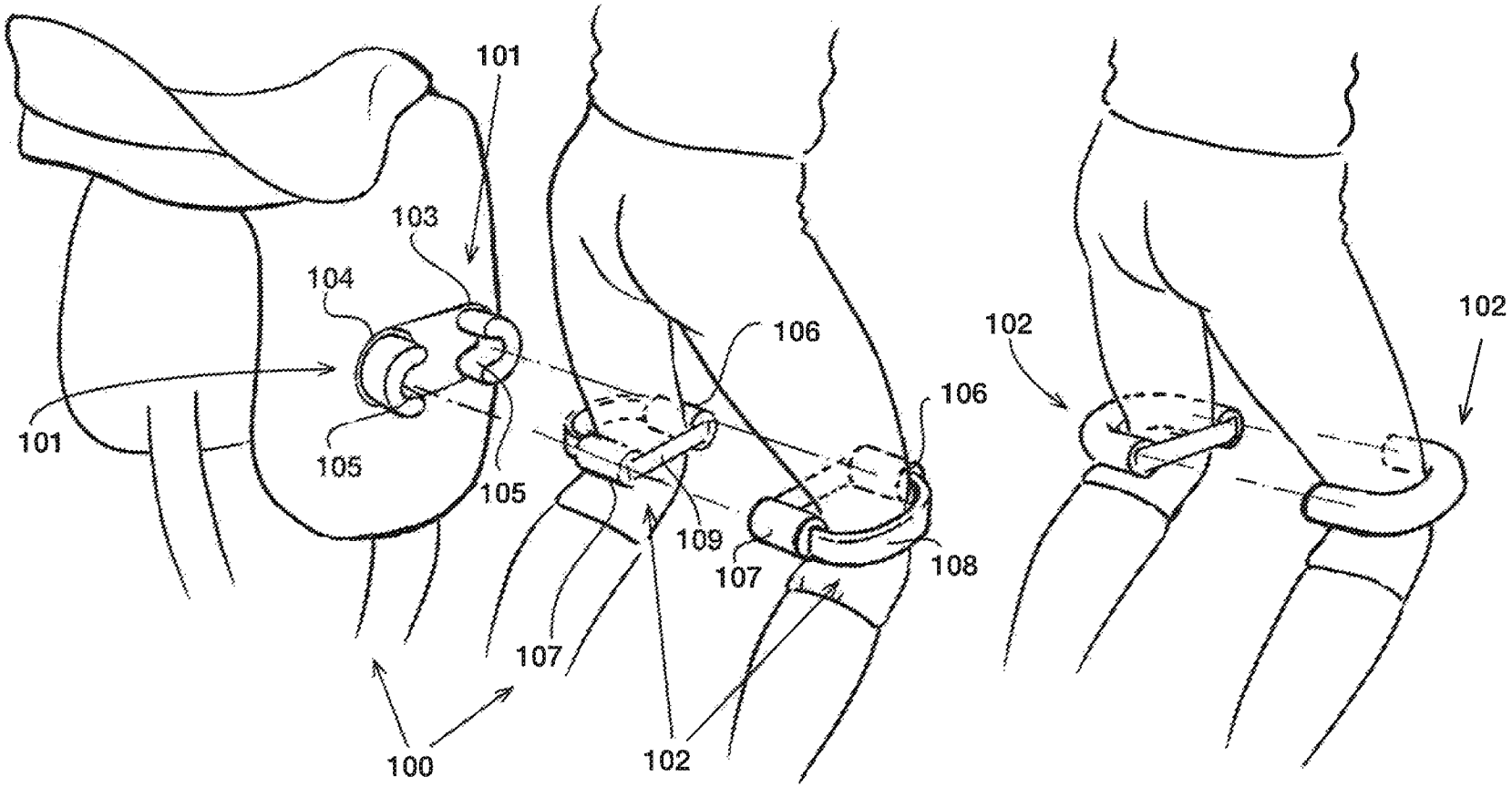
FIG. 18A is a perspective right-hand side and rear view of a saddle with another embodiment of horseman-securing device by means of an assembly of securing elements of fixed parts with protrusions and recesses fitting inside one another, such as female and male parts, which are situated, on the one hand, at the location of the saddle and are connected, on the other hand, to the horseman or his clothing, in which the female parts are placed on either side on the lateral side of the saddle at the location of the knee of the horseman, as in FIGS. 18B and 18C.
FIG. 18B is a perspective right-hand side and rear view of the lower part of a horseman with the male parts of the assembly associated with FIG. 18A.
FIG. 18C is a perspective right-hand side and rear view of the lower part of a horseman with a detail of the male parts from FIG. 18B.

FIGS. 18A-18C show a horseman-securing device comprising an assembly (100) of securing elements of fixed with protrusions and recesses fitting inside one another, such as female (101) and male (102) parts, which are situated, on the one hand, at the location of the saddle (002) and are connected, on the other hand, to the horseman or his clothing (015).

FIG. 18A shows a horseman-securing device comprising an assembly (100) of securing elements of fixed with protrusions and recesses fitting inside one another, such as female (101) and male (102) parts, which are situated, on the one hand, at the location of the saddle (002) and are connected, on the other hand, to the horseman or his clothing (015), in which the female parts (101) are placed on either side on the lateral side of the saddle (002) at the location of the knee (019). The female parts (101) in this case consist of two thickenings (103 and 104), a front (103) and a rear (104) thickening with mutually facing indentations (105). The front thickening (103) may equally well be part of the knee roll (010), so that the front female part is then essentially formed by only an indentation (105) in the knee roll (010).

FIG. 18B shows the male parts (102) of the assembly (100) associated with FIG. 18A, a front male part (106) and a rear male part (107), both of which fit in the indentations (105) of the front female part (103) and the rear female part (104), respectively, which are arranged at knee level on the saddle (002). Once he is seated in the saddle, the horseman (015) only has to move his knees from a lateral to a medial position in order to slide the male parts (102) at the location of his knees (019) into the female parts (101). In these FIGS. 18A and 18B, the male parts (102) which are at the location of the right-hand knee (019) of the horseman (015) slide into the female parts (101) which are situated on the right-hand side of the saddle (002), which movement is indicated here in the drawing by means of straight parallel dashed lines. Conversely, in order to dismount from his horse (001), the horseman (015) only has to move his knees (019) laterally in order to slide the male parts (102) out of the female parts (101). The advantage of this embodiment of the invention is that, strictly speaking, no additional measures are required to further fix the knees (019) by means of strips and the like. This is due to the fact that, if the female (101) and male parts (102) are securely connected to each other, the two knees (019) will never become detached simultaneously in case of an unexpected movement of the horse (001) in whichever direction. This does not alter the fact that even with this embodiment, it is possible to use additional securing measures, such as e.g. strips (030) (hook and loop fasteners) to close off the space between the front (103) and rear (104) female parts via the outer side of the knee (019). The front (106) and rear (107) male parts, which are situated on the front and rear side of the knee (019) of the horseman (015), may still be connected to each other, both by a connection (108) on the outer side of the knee and by a connection (109) on the inner side of the knee, in which case the latter connection is then preferably of a thin design in order to ensure that free unimpeded movement on the inner side of the knee remains possible.

FIG. 18C shows a detail of the male parts from FIG. 18B.

In the illustrated FIGS. 18A-C, in all cases, the female parts are shown on the side of the saddle and the male parts on the side of the horseman, but this may equally well be turned around. Also, these figures always show pairs of female and male parts, but these parts may equally well be configured in odd or other even numbers.

Figure 19B:
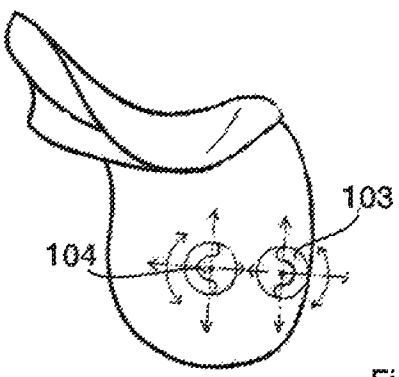
FIGS. 19A and 19B is a perspective right-hand side and rear view of a saddle of another embodiment of a horseman-securing device by means of an assembly of securing elements of movable protrusions and recesses which fit inside each other, such as female and male parts, which are situated, on the one hand, at the location of the saddle and are connected, on the other hand, to the horseman or his clothing (not depicted).
Figure 19A:
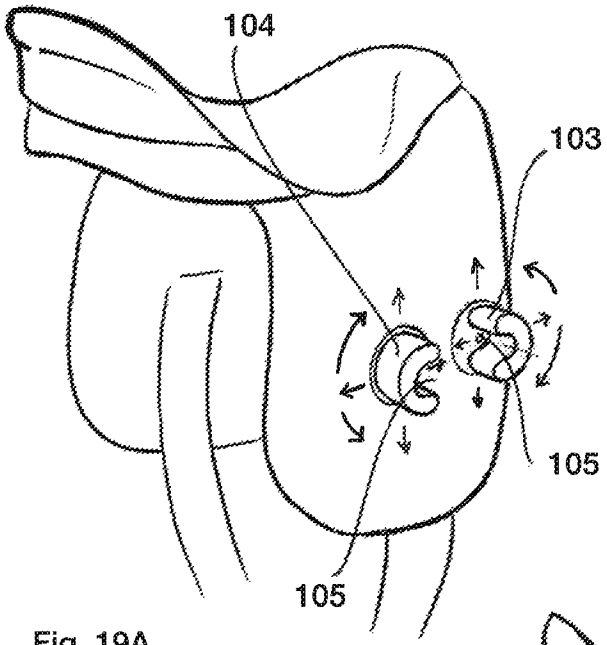

FIGS. 19A and 19B show a horseman-securing device comprising an assembly (100) of securing elements of movable protrusions and recesses which fit inside each other, such as female (101) and male (102) parts, which are situated, on the one hand, at the location of the saddle (002) and are connected, on the other hand, to the horseman or his clothing (015). The mobility consists of the possibility to displace the female parts (101), and in particular the front and rear female parts shown here, in an adjustable manner, so that it is still possible to have an assembly with the male parts with the same set of female parts, even if the front and rear male parts are a different distance apart or if the length of the leg and size of the knee will differ for different horsemen. This adjustability may involve e.g. the height and or width position of one or more individual female parts, for example by using guide rails in or on the saddle and/or the medial side of the female parts.

FIGS. 20 and 20A-20C show a horseman-securing comprising securing elements of the clamping type which, in use, clamp around a limb and/or lower body of the horseman, which are preferably configured as an assembly (110) of one fixed and one or more displaceable clamping structures or of only displaceable clamping structures.

Figure 20:
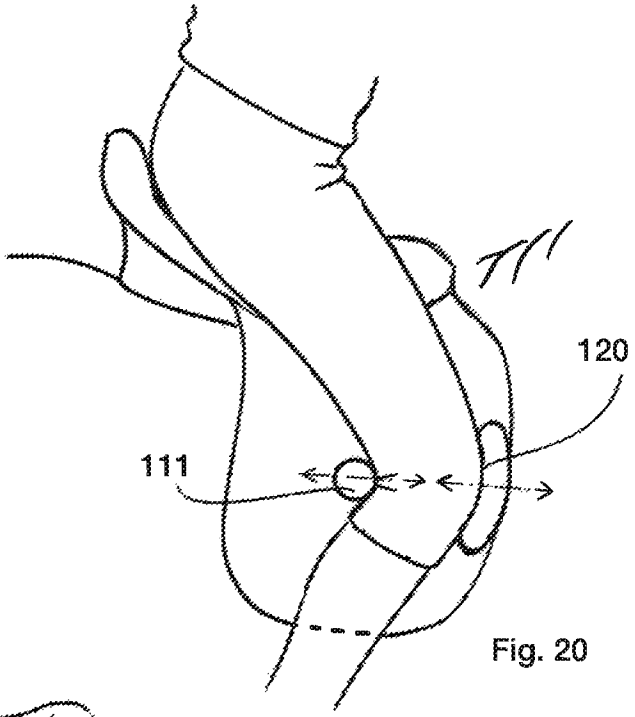
FIG. 20 is an enlarged partial right-hand side view of a horse carrying the saddle equipped with another embodiment of the horseman securing device with a clamping structure situated in the hollow of the knee and a clamping structure, situated on the front side of the knee of the horseman, in which one of these clamping structures, or both clamping structures, are displaceable.

FIG. 20 shows a clamping structure (111) situated in the hollow of the knee and a clamping structure (120), situated on the front side of the knee, in which one of these clamping structures or both clamping structures are displaceable, for example in a horizontal direction, but other directions or composite directions are also possible.

Figures 20A, 20B, 20C:
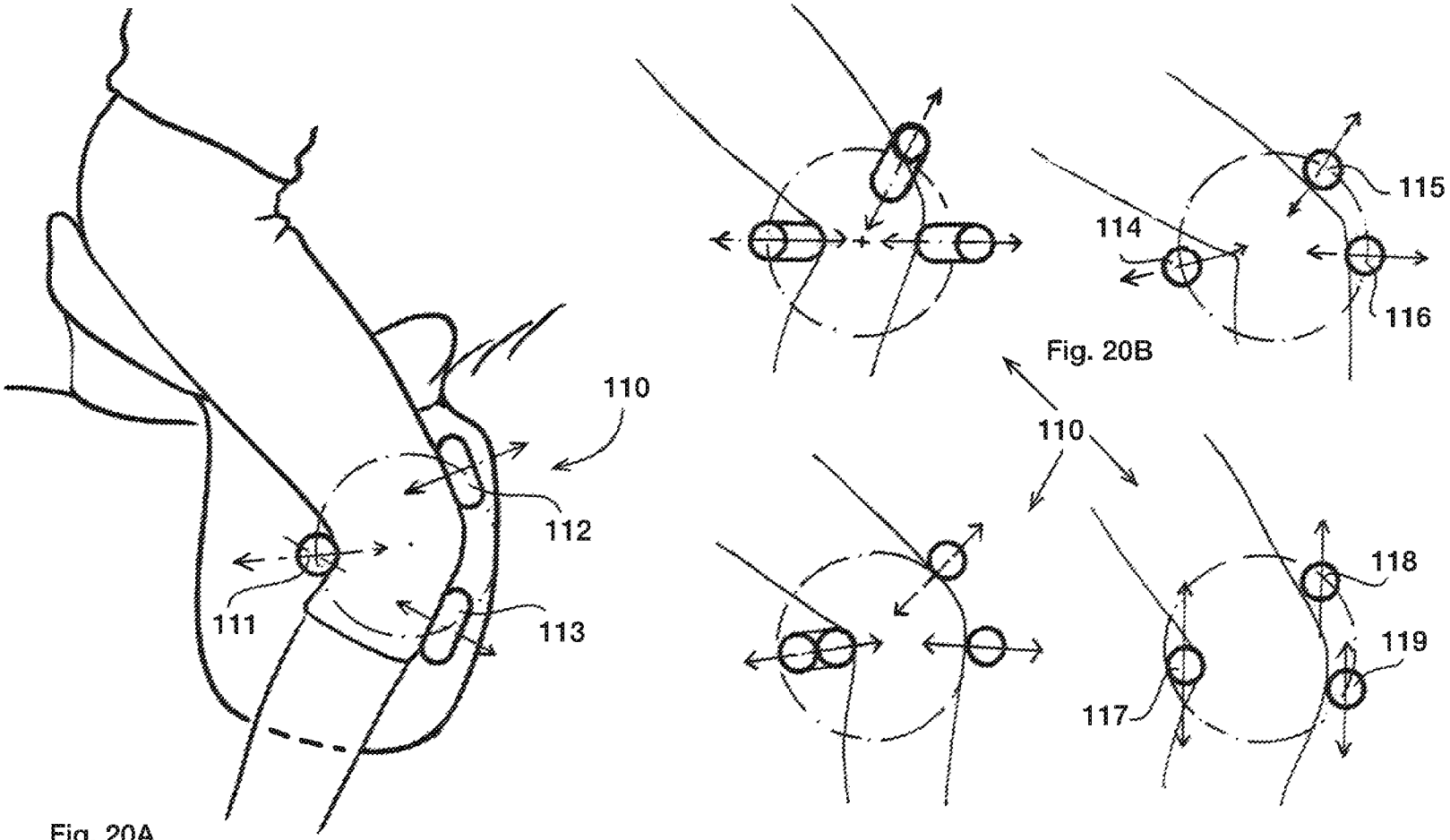
FIG. 20A is a partial right-hand side view of a horse carrying a saddle equipped with another embodiment of the horseman securing device with an assembly that consists of a clamping structure in the hollow of the knee, a clamping structure on the front and top side of the knee, and a clamping structure on the front and bottom side of the knee, wherein these clamping structures are displaceable.
FIG. 20B is a schematical drawing of clamping structures similar to the clamping structures from FIG. 20A, in which the movement is now a radial movement to and from an imaginary central point at the centre of the knee.
FIG. 20C is a schematical drawing of the clamping structures similar to the clamping structures from FIG. 20A and from FIG. 20B, in which the movement is now a vertical movement from the top downwards.

FIG. 20A shows such an assembly (110) attached to the saddle (002) or at least the flap (009) thereof. The assembly (110) in this case consists of a clamping structure (111) in the hollow of the knee, a clamping structure (112) on the front and top side of the knee, and a clamping structure (113) on the front and bottom side of the knee. The arrows indicate possible directions of movement of the clamping structures. The clamping structure in the hollow of the knee will generally be displaceable in the horizontal direction. The clamping structures on the front side of the knee may, as shown here, follow a movement starting from an imaginary triangle formed by the three clamping structures.

FIG. 20B shows clamping structures 114 to 116 similar to the clamping structures 111 to 113 from FIG. 20A, in which the movement is now a radial movement to and from an imaginary central point at the centre of the knee.

FIG. 20C shows clamping structures 117 to 119 similar to the clamping structures 111 to 113 from FIG. 20A and the clamping structures 114 to 116 from FIG. 20B, in which the movement is now a vertical movement from the top downwards.

Said movements are only intended to clamp the knee of the horseman once and to compensate for the difference in build between various different horsemen and, optionally, to facilitate getting into and out of the horseman-securing device.

Such movements are possible, for example, by accommodating the clamping structures in radial, horizontal and/or vertical guide rails, as a result of which the clamping structures are able to carry out the abovementioned movements and in which case the clamping structures can temporarily be fixed in the desired position. If, for each clamping structure, double guide rails are used which engage with one another and are rotatable and displaceable with respect to each other, then the clamping structures have a freedom of movement which is such that they can adapt to virtually any body shape.

These FIG. 20 always show 3 clamping structures around the knee, but this number may also be smaller, e.g. 2, or greater, such as e.g. 4, and the clamping structures may also be situated around other body parts, such as for example on either side of the thigh, provided the mobility of the thigh is guaranteed by means of other embodiments of the invention mentioned in this application.

The clothing of the horseman may be provided with thickenings which fit exactly between said clamping structures, if desired with the additional use of a hook and loop fastener.

Figure 21B:
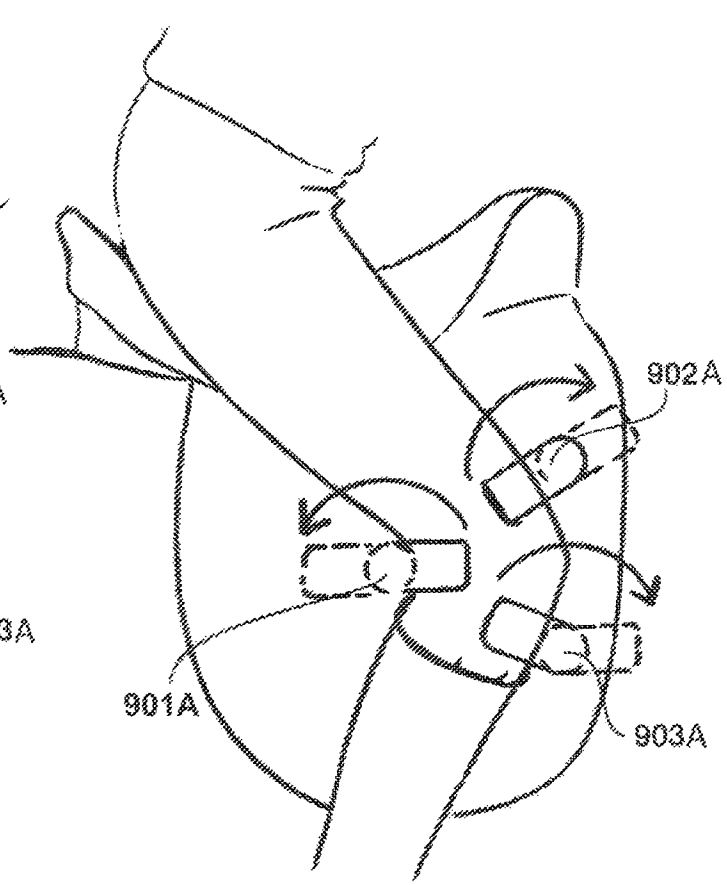
FIG. 21B is a right-hand side view of a horse carrying the saddle equipped a horseman securing device as in FIG. 21A where the same bars are in the open position.
Figure 21A:
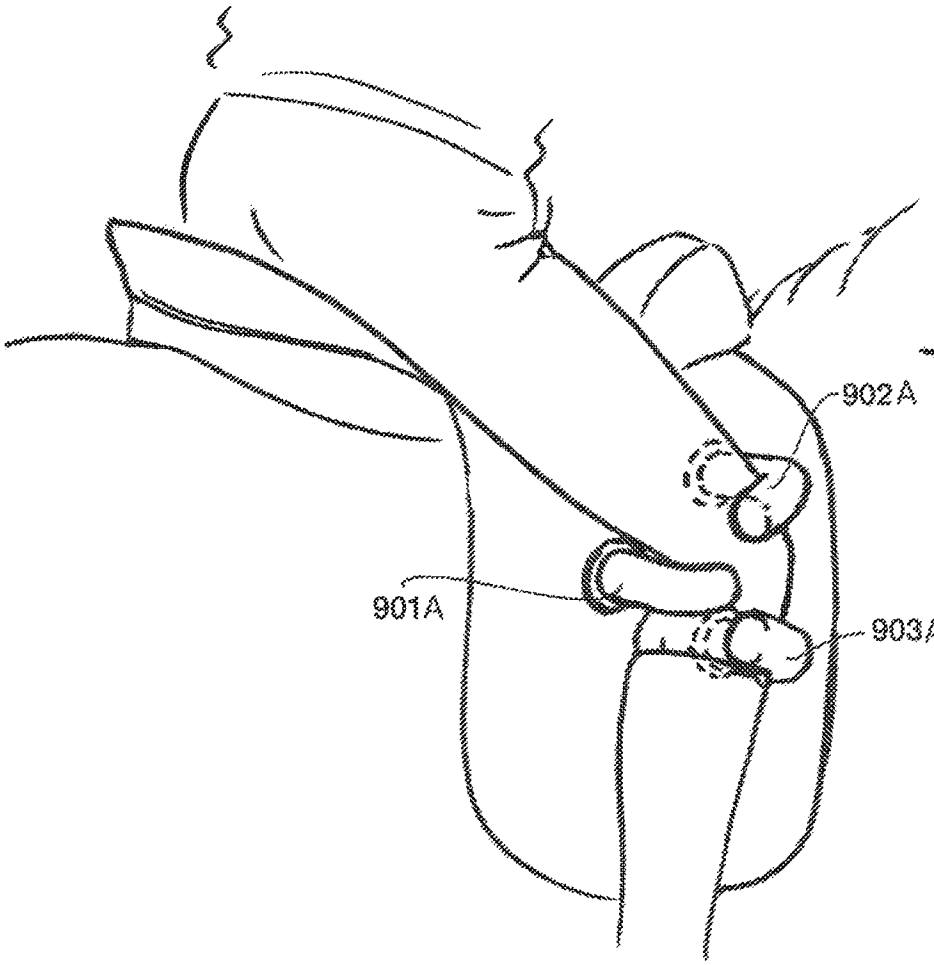
FIG. 21A is an enlarged partial right-hand side view of a horse carrying the saddle equipped with another embodiment of the horseman securing device in which the securing means consist of bendable tubes or bars which can be bent around the knee of the horseman.

FIGS. 21A, B show a horseman-securing device having bendable tubes or bars which can be bent around the knee (019) of the horseman (015).

FIG. 21A, by way of example, shows a bar in the hollow of the knee of the horseman (901A), a bar on the top and front side of the knee (902A) and a bar on the bottom and front side of the knee (903A), in which these bars are shown as being bent around the knee.

FIG. 21B shows the same bars in the open position.

Figure 22B:
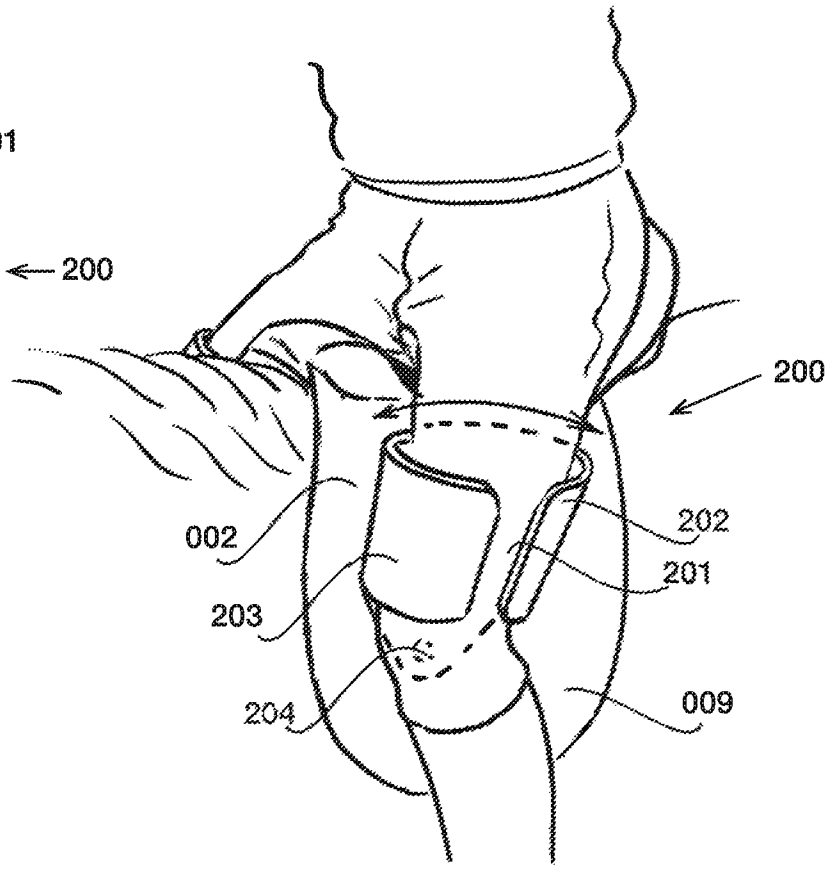
FIG. 22B is an enlarged partial perspective left-hand side and front view of a horse carrying another embodiment of the saddle equipped with a horseman securing device by means of a similar tubular securing element to that in FIG. 22A, but now around the left thigh of the horseman.
Figure 22A:
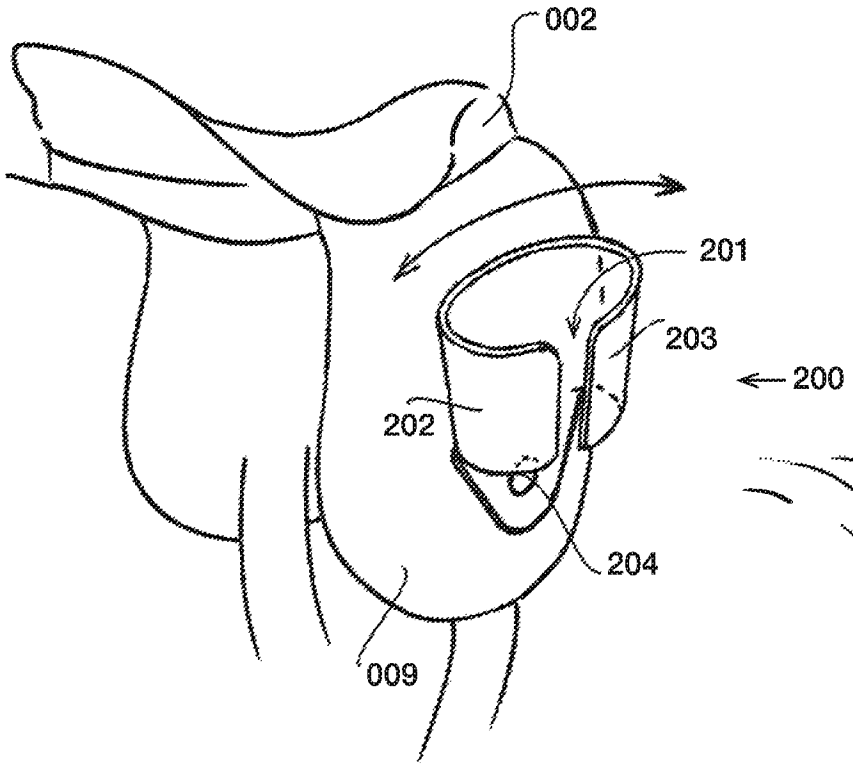
FIG. 22A is a perspective right-hand side and rear view of a saddle equipped with another embodiment of the horseman securing device with a tubular securing element fitted on the right side of the saddle, at least on the flap thereof, intended for clamping the right thigh of the horseman (not depicted).

FIGS. 22A and 22B show a horseman-securing device comprising one or more annular or tubular securing elements which completely or partly enclose a limb of the horseman.

FIG. 22A shows a tubular securing element (200) fitted on the right-hand side of the saddle (002), at least on the flap (009) thereof, intended for clamping the right-hand thigh of the horseman. The tubular securing element (200) has a gap or opening (201), shown here on the lateral side of the tubular securing element (200). The tubular securing element (200) extends from the medial side, facing the saddle, to the front side and rear side and ends with a rearward end (202) and a forward end (203), respectively, on either side of an interrupted circumference (201) of the tubular securing element (200), which is shown here as a slot-shaped opening (201). The tubular securing element (200) may be made from a deformable material, in which the two ends (202 and 203) can be opened when the horseman gets in and out and can be closed when the horseman is in the seated position, in which case the two ends (202 and 203) may also be laid on over one another in the closed position (not shown here). The tubular securing element (200) may equally well be configured to be openable by pivoting, zipping, swinging, tilting or folding or may be opened or closed in another way.

In order to retain the required movements for the horseman, the tubular securing element (200) is connected to the saddle (002), or at least the flap (009) thereof, by means of a hinge (204). By means of this hinge (204), which in this case is fitted to the saddle at knee level of the horseman, the tubular securing element (200) can perform a swinging movement in the forward and backward direction (see arrows).

FIG. 22B shows a similar tubular securing element (200) to that in FIG. 22A, but now seen from the left-hand side of the saddle, around the left thigh of the horseman.

Figure 23C:
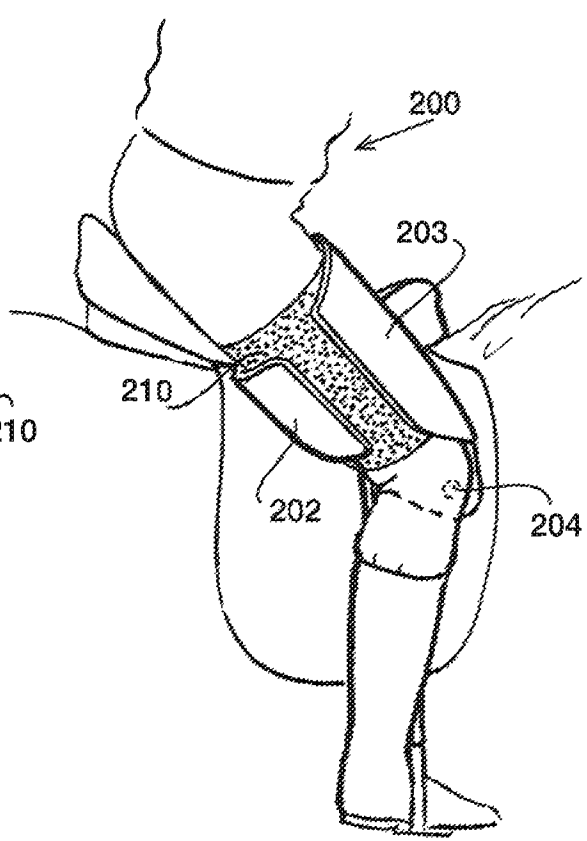
FIG. 23C is an enlarged partial right-hand side view of a horse carrying of a saddle equipped with a horseman securing device by means of an assembly of the tubular securing element as provided on the saddle as shown on FIG. 23A and the hook and loop fasteners as provided on the horseman as shown in FIG. 23B, and that are fitted with each other.
Figure 23A:
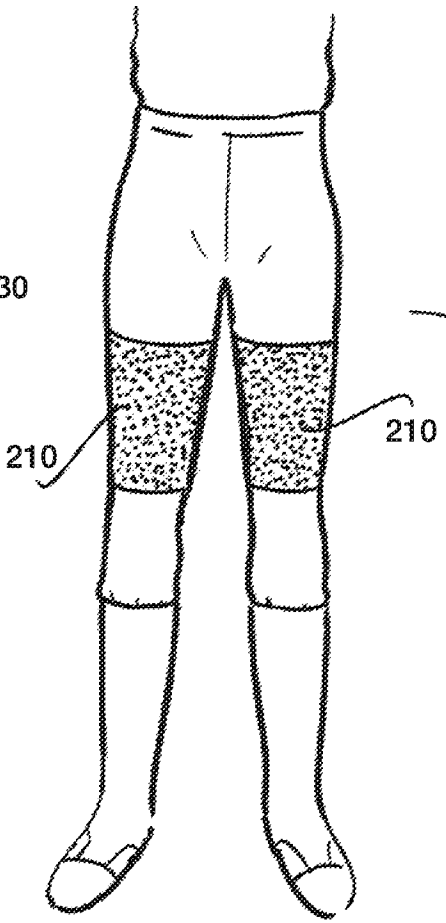
FIG. 23A is a right-hand side view of another embodiment of the horseman securing device with a tubular securing element as in FIGS. 22A and 22B with a strip-shaped element, which may equally well be a continuation of the front or rear end of the tubular securing element, that bridges the gap and is fastened on the outer side of the other end.

FIGS. 23A-23C show in which additional ways the contact of the tubular securing element (200) with the thigh of the horseman may be strengthened.

FIG. 23A shows how a strip-shaped element (030), which may equally well be a continuation of the front (203) or rear end (202) of the tubular securing element (200), bridges the gap (201) and is fastened on the outer side of the other end. It is also possible to use a hook and loop fastener in this case, in which e.g. one type of hook and loop fastener is provided on the outer side of the end of the tubular securing element and a hook and loop fastener of the other type on the inner side of the strip-shaped element (030).

FIG. 23B shows that a hook and loop fastener of the one type (210) is fitted completely or in part around the thigh of the horseman, as a result of which, when a hook and loop fastener of the other type is fitted on the inner side of the tubular securing element (200), the thigh is secured in the tubular securing element (200) in a very secure way. The hook and loop fastener attached to the horseman (210) may be fitted in a fixed way on his clothing, but may also be provided in the form of a replaceable, optionally elastic, stocking around the thigh.

FIG. 23C shows the result, in which the hook and loop fastener on the inner side of the tubular securing element (200) cannot be shown, but is present. It is also shown here that the two ends (202 and 203) of the tubular securing element do not have to be of equal size. Here, it is shown, for example, that the rear end (202) has a smaller height than the front end (203). Such an extended front end may for example contribute to the passive protection of the thigh of the horseman on the front side.

Figure 23A:
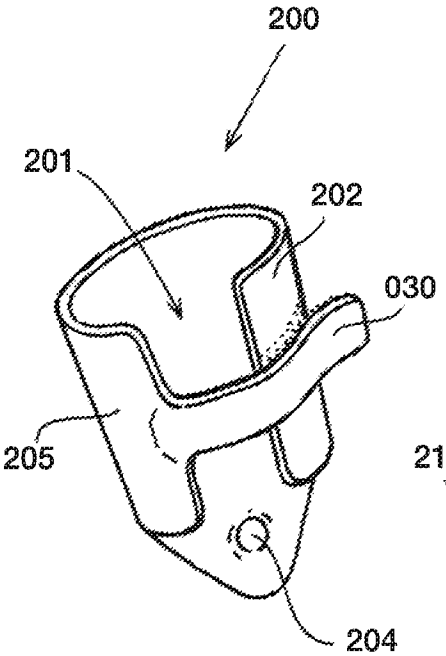
Figure 24B:
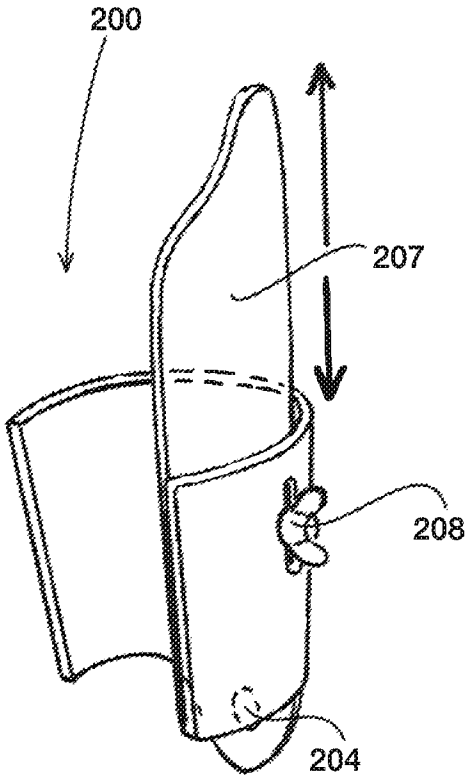
FIG. 24B is a right-hand side view of a tubular securing element in FIGS. 22, 23 and 24A, in which the tubular securing element is extended by a telescopic extending part with an adjusting button in order to fix the telescopic extending part in the desired position with respect to the rest of the tubular securing element.
Figure 24A:
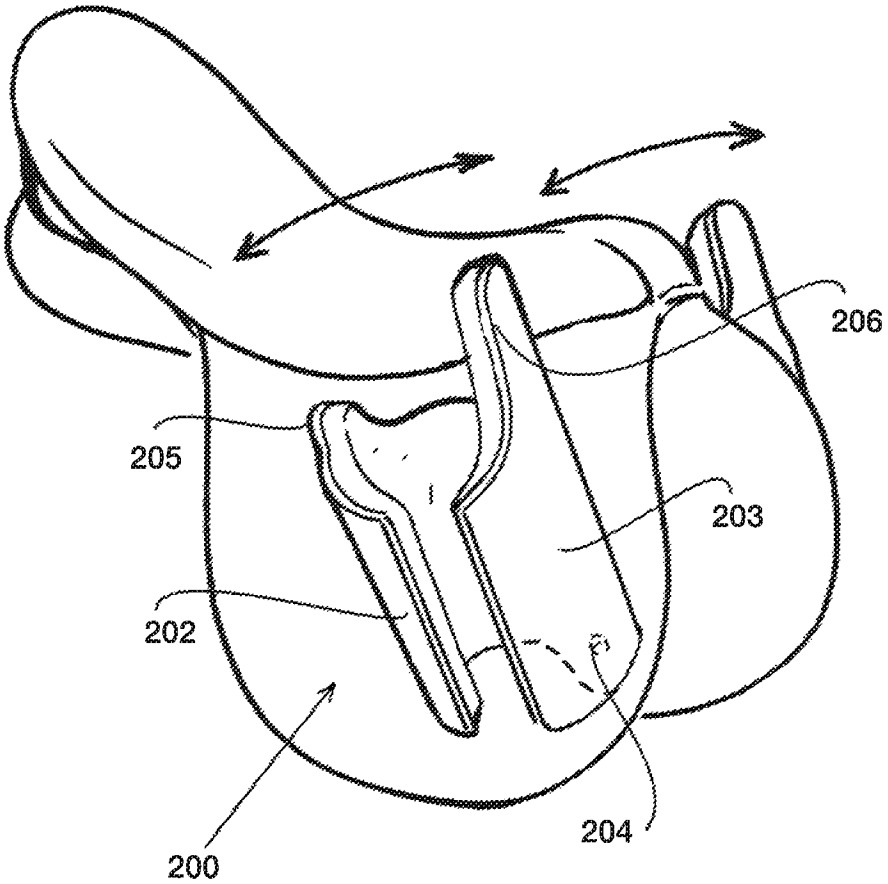
FIG. 24A is a right-hand side view of a saddle equipped a horseman securing device with a tubular securing element as in FIGS. 22 and 23, in which the tubular securing element has been extended upwards in a fixed manner on the rear side and on the front side.

FIGS. 24A and 24B show that the tubular securing element (200), such as shown in FIGS. 22 and 23, may also be extended upwards, in the direction of the lower body of the horseman, in which case nothing has changed with regard to the further properties of the tubular securing element (200), and in particular not with regard to the freedom of movement thereof (see arrows).

FIG. 24A shows an example of a tubular securing element (200) which has been extended upwards in a fixed manner on the rear side (205) and on the front side (206) in order to provide even more support to the proximal part of the thigh and lower body of the horseman.

FIG. 24B shows a telescopic extending part (207) of the tubular securing element (200) with an adjusting button (208) in order to fix the telescopic extending part (207) in the desired position with respect to the rest of the tubular securing element (200). The telescopic extending part (207) may be situated, e.g. in the wall of the tubular securing element (200), provided that this is of a hollow design, and moves, for example, via one or more guide rails. In this way, the tubular securing element (200) can be used for the different lengths of leg of different horsemen.

Figures 25A, 25B, 25C:
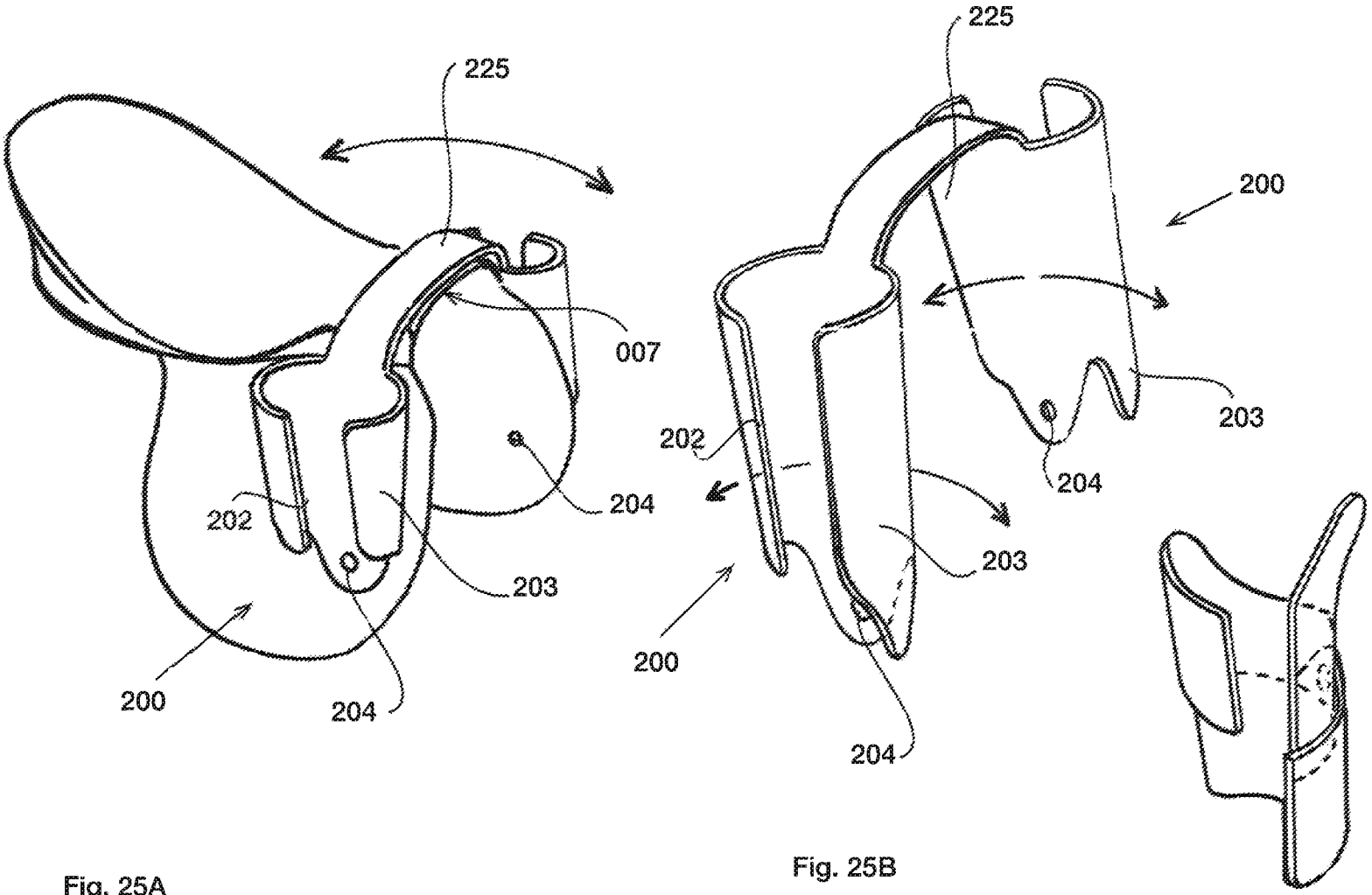
FIG. 25A is a perspective right-hand side upper and front view of a saddle equipped with another embodiment of the horseman securing device as in FIGS. 22 to 24, but in which two tubular securing elements are connected to each other at the top by means of a bridge.
FIG. 25B is a perspective right-hand side upper and front view of the two tubular securing elements that are connected to each other at the top by means of a bridge.
FIG. 25C is a perspective right-hand side upper and front view of a telescopic upper part of the tubular securing element.

FIGS. 25A-25C show a horseman-securing device (200) as shown in FIGS. 22 to 24, but illustrated from both sides, in which the two tubular securing elements (200) are connected to each other at the top by means of a bridge (225). This bridge is configured in such a way that it can move freely over the withers of the horse and the pommel (007) of the saddle. Both tubular securing elements (200) now pivot simultaneously with the hinges (204) positioned on either side of the saddle by means of the bridge (225).

FIG. 25C shows a telescopic upper part of the tubular securing element.

FIGS. 26A-26F show tubular securing elements (200) which are connected to each other on the front side and rear side of the horseman by means of a front bridge (225) and a rear bridge (226), as a result of which a body clamp or a pair of clamping trousers (230) is created. Preferably, the abdomen and genitals of the horseman (227) and buttocks of the horseman (228) are left free, so that these parts are not subjected to pressure and in particular the backside of the horseman can act on the back of the horse and the saddle without any impediment.

All FIG. 26 show a hinge (204) at the location of the knee of the horseman, so that the required pivoting movement of the thigh of the horseman remains possible, similar to FIGS. 22 to 25.

Figure 26A:
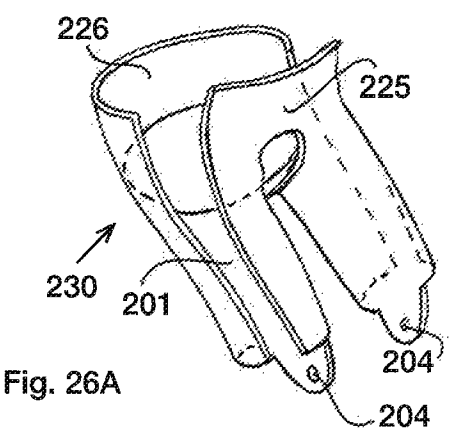
FIG. 26A is a perspective right-hand side upper and front view of a pivotable body clamp or pair of clampable trousers, in which the entire securing device has a vertical gap-like interruption on both sides in order to enable the horseman to get in and out from the side.

FIG. 26A shows the pivotable body clamp or pair of clampable trousers (230) seen from the front at an angle, in which the entire securing device has a vertical gap-like interruption on both sides in order to enable the horseman to get in and out from the side.

Figure 26B:
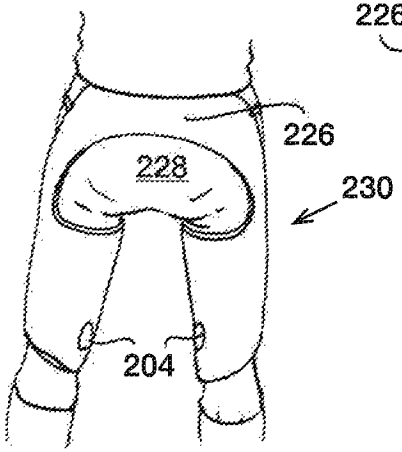
FIG. 26B is a partial rear view of the horseman fitted within the pivotable body clamp or pair of clampable trousers.

FIG. 26B shows the pivotable body clamp or pair of clampable trousers (230), seen from behind.

Figure 26C:
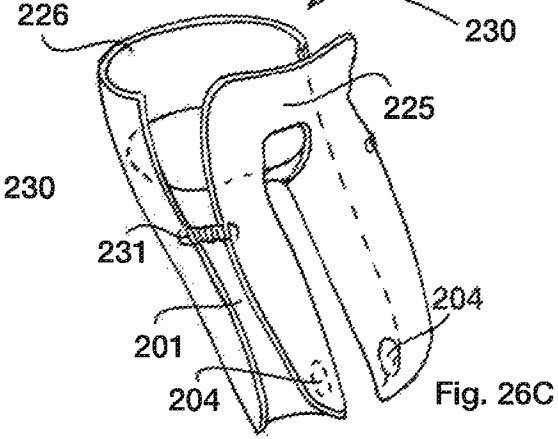
FIG. 26C is a perspective right-hand side upper and front view of the pivotable body clamp or pair of clampable trousers, but now with a strip-shaped element in order to connect the front side thereof to the rear side and releasably lock it.

FIG. 26C shows the pivotable body clamp or pair of clampable trousers (230), seen from the front at an angle, but now with a strip-shaped element (231) in order to connect the front side thereof to the rear side and releasably lock it.

Figure 26E:
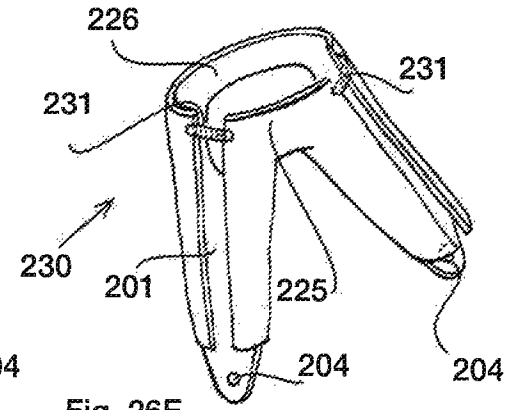
FIG. 26E is a perspective right-hand side upper and front view of the pivotable body clamp or pair of clampable trousers with strip-shaped elements.
Figure 26F:
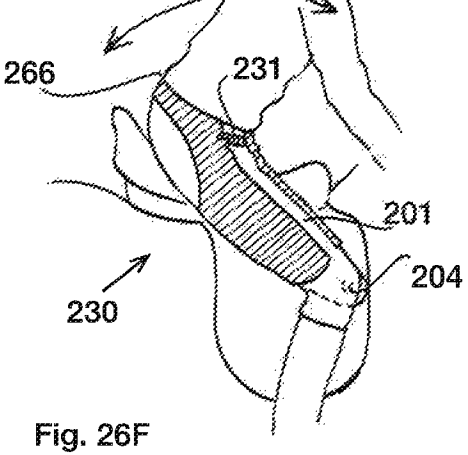
FIG. 26F is a right-hand side view of a horse carrying a saddle equipped with a horseman securing device by means of the pivotable body clamp or pair of clampable trousers (hatched) as illustrated in FIGS. 26A-E and worn by a horseman.
Figure 26D:
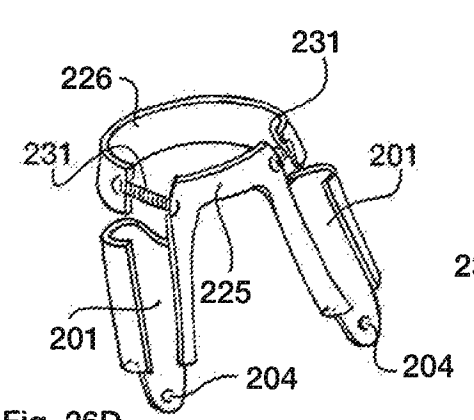
FIG. 26D is a perspective right-hand side upper and front view of the pivotable body clamp or pair of clampable trousers, but now the rear bridge is configured as a more or less separate part, in which case this part is connected to the front bridge only by means of strip-shaped elements, resulting in the rear bridge allowing more freedom to the horseman.

FIG. 26D shows the pivotable body clamp or pair of clampable trousers (230) seen from the front at an angle, but now the rear bridge (226) is configured as a more or less separate part, in which case this part is connected to the front bridge (225) only by means of strip-shaped elements (231), resulting in the rear bridge (226) allowing more freedom to the horseman. Obviously, the invention may also be configured the other way around, in which case the front bridge (225) is of a looser design and is connected to the rear bridge (226).

FIG. 26E shows the pivotable body clamp or pair of clampable trousers (230), seen from the front at an angle.

FIG. 26F shows the pivotable body clamp or pair of clampable trousers (230) as illustrated in FIGS. 26A-E, worn by a horseman and seen from the side.

Figure 27B:
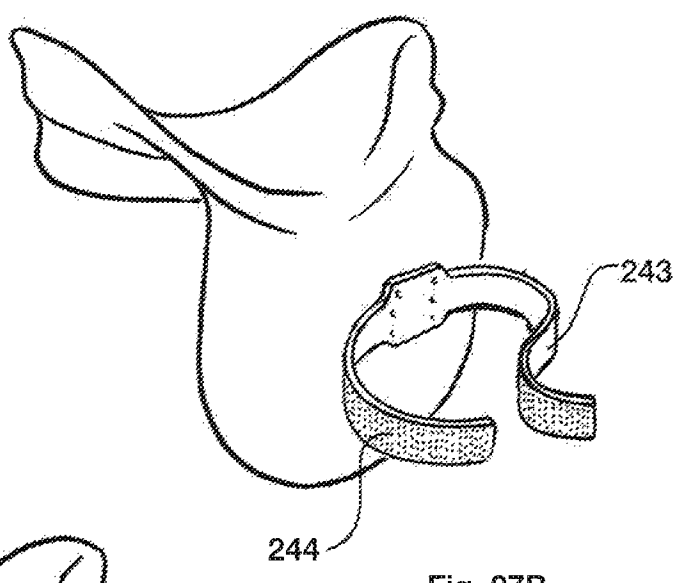
FIG. 27B is a right-hand side view of a saddle equipped with a horseman securing device as illustrated in FIG. 27A where the strips as shown in FIG. 27A may also form a single part, i.e. a single strip, with a front and a rear end.
Figure 27A:
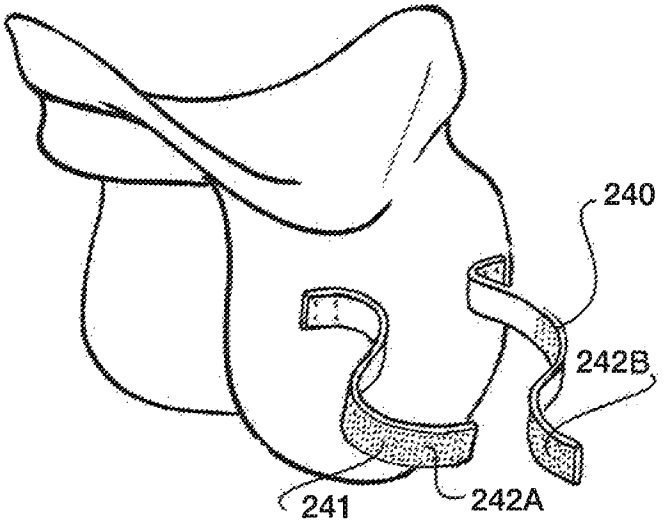
FIG. 27A is a perspective right-hand side and rear view of a saddle equipped with another embodiment of horseman securing device by means of a relatively narrow front strip and a relatively narrow rear strip, which strips are each separately attached to the saddle, or at least the flaps thereof.
Figure 27C:
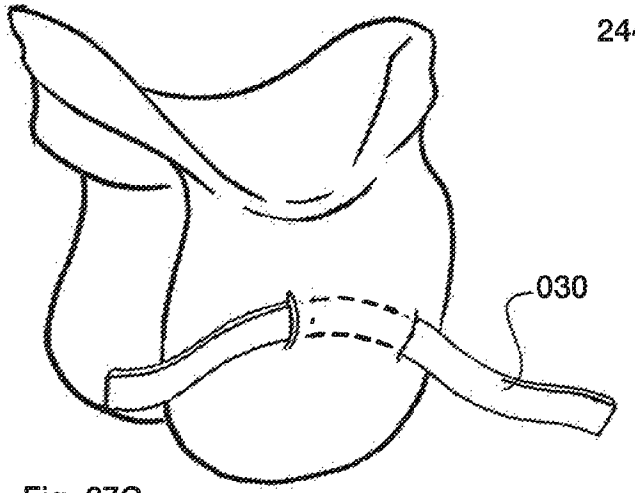
FIG. 27C is a perspective right-hand side and rear view of a saddle equipped with a horseman securing device as illustrated in FIG. 27B where the strip runs partly on the medial side of the saddle or the flap.

FIGS. 27A-27C show how a hook and loop fastener of the hook-and-eyelet type in combination with strip-shaped elements (030) can be used as horseman-securing device at the location of the knee, at least if these strip-shaped elements are configured in such a way that they do not impede the pivoting movement of the knee, but continue to make it possible.

FIG. 27A shows a relatively narrow front strip (240) and a relatively narrow rear strip (241), for example having a width of only a few centimetres, which strips are each separately attached to the saddle, or at least the flaps thereof. On the outer side of one of the strips a hook and loop fastener of the one type (242A) is provided, while a hook and loop fastener of the other type (242B) is provided on the other strip, on the inner side.

FIG. 27B shows that the strips as shown in FIG. 27A may also form a single part, i.e. a single strip, with a front (243) and a rear (244) end. Such a strip may then be arranged approximately in the centre thereof on the outer side of the saddle or at least the flap thereof, but the strip may also be passed through various vertical passages in the saddle or the flap thereof (FIG. 27C), so that the strip runs partly on the medial side of the saddle or the flap (illustrated with dashed lines).

FIGS. 28A-28D show a horseman-securing device which is an assembly comprising a hook and loop fastener of the hook-and-eyelet type, in which a rotatable (arrows) connecting element (250) is provided between a touch-and-close-fastener-side on the saddle and a touch-and-close-fastener-side on the horseman, allowing a mutual movement between the saddle and the horseman at the respective securing location.

Figure 28C:
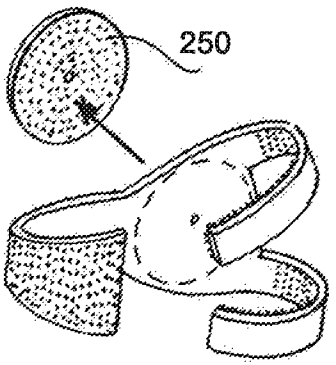
FIG. 28C is a right-hand side view of the hook and loop fastener parts as illustrated in FIGS. 28A and 28B that may also be fitted on the horseman as a temporary securing means by means of strips instead of a stocking, optionally with a hook and loop fastener.
Figure 28D:
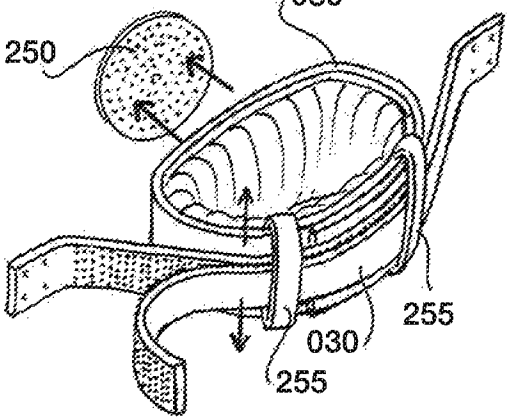
FIG. 28D is a perspective right-hand side and upper rear view of the assembly of a connecting element with a hook and loop fastener of the one type and a hook and loop fastener on the medial side of the knee of the horseman of the other type, with the latter hook and loop fastener forming part of a clamping structure around the knee which is attached to the saddle by means of one or more strip-shaped elements on the outer side of the clamping structure, as shown, inter alia, in FIG. 15.
Figure 28B:
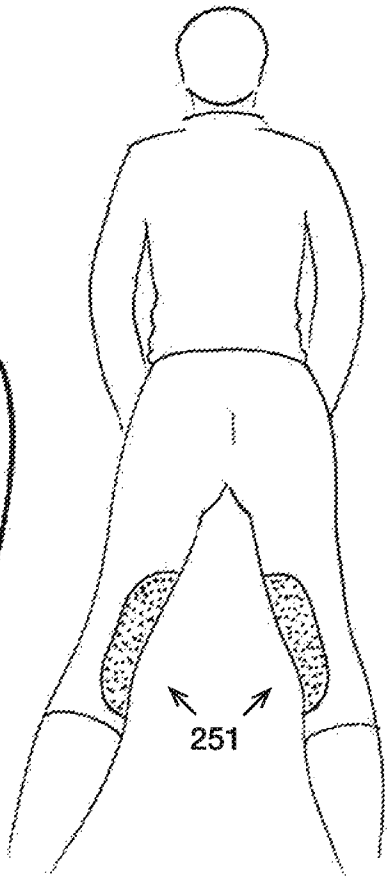
FIG. 28B is a rear view of a horseman with a hook and loop fastener of the hook-and-eyelet type at his trousers on the side facing inwards—towards the saddle, but of the other type than that which is present on the connecting element as illustrated in FIG. 28A.
Figure 28A:
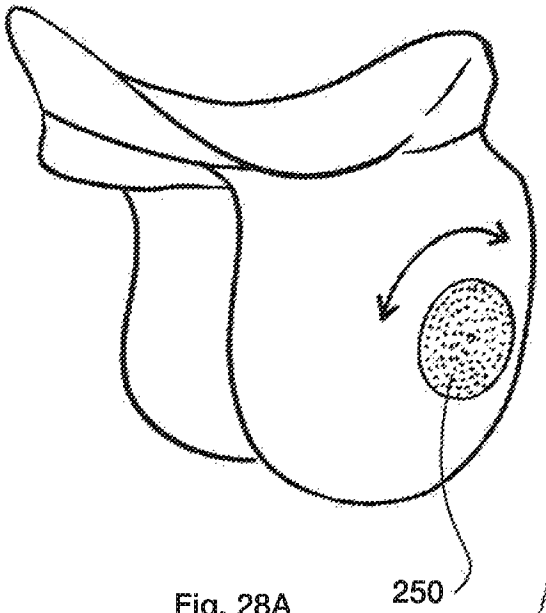
FIG. 28A is a perspective right-hand side and rear view of a saddle equipped with another embodiment of horseman securing device by means of rotatable connecting element fitted on the saddle, or at least the flap thereof, at the location of the knee of the horseman, with a hook and loop fastener of the hook-and-eyelet type on the side facing the horseman.

FIG. 28A shows the rotatable (arrows) connecting element (250) fitted on the saddle or at least the flap thereof at the location of the knee of the horseman, with a hook and loop fastener of the hook-and-eyelet type on the side facing the horseman.

FIG. 28B shows the horseman with a hook and loop fastener of the hook-and-eyelet type (251) on the side facing inwards—towards the saddle, but of the other type than that which is present on the connecting element (250). This hook and loop fastener may be provided on the clothing of the horseman, preferably his pair of riding breeches, but the hook and loop fastener may also be worn as a stocking around the knee.

FIG. 28C shows that the hook and loop fastener may also be fitted on the horseman as a temporary securing device by means of strips instead of a stocking, optionally with a hook and loop fastener (250).

FIG. 28D shows the assembly of a connecting element with a hook and loop fastener of the one type (250) and a hook and loop fastener on the medial side of the knee of the horseman of the other type (251), with the latter hook and loop fastener forming part of a clamping structure (080) around the knee which is attached to the saddle by means of one or more strip-shaped elements (030) on the outer side of the clamping structure, as shown, inter alia, in FIG. 15, with the difference that the clamping structure in this case is not only situated on the outer side of the knee, but completely around the knee, i.e. also on the medial side of the knee. According to a preferred embodiment of the invention, the freedom of movement of the knee of the horseman can be improved by making the vertical guides (255) of the clamping structure (080), through which the strip-shaped elements (030) are passed, longer than the width of the strip-shaped elements (030), so that these strip-shaped elements (030) can move up and down within these vertical guides (255) while the knee of the horseman and the clamping structure (080) rotates as a result of the hook and loop fastener connection with the rotatable connecting element with hook and loop fastener (250).

Figure 29B:
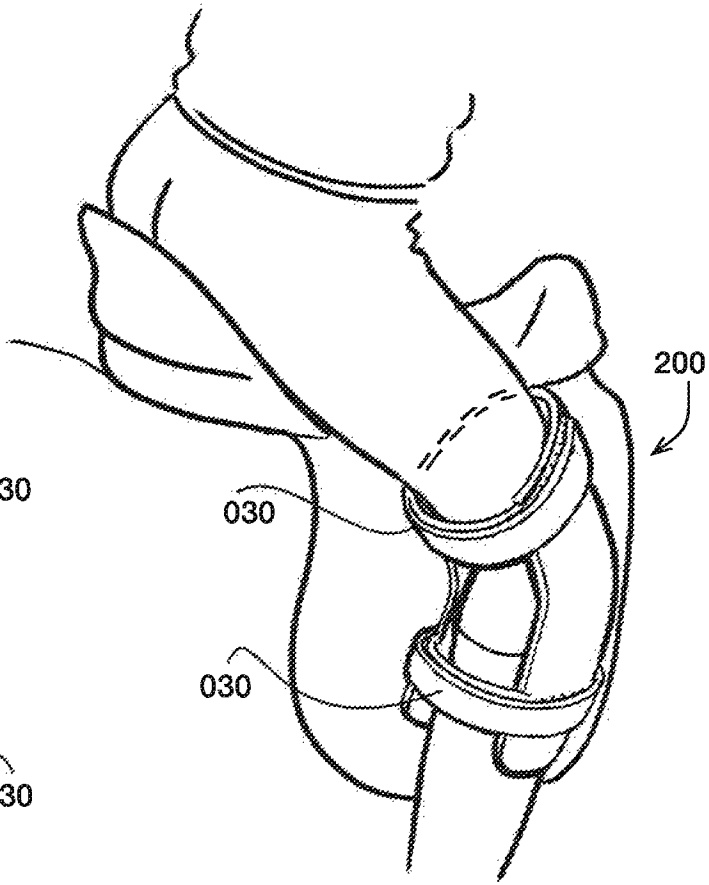
FIG. 29B is an enlarged partial right-hand side view of a horse carrying a saddle equipped with a horseman securing device by means of an assembly of the same parts as in FIG. 29A, but in this case after the horseman has mounted the saddle and the tubular element has been temporarily closed, by means of optionally strip-shaped elements.
Figure 29A:
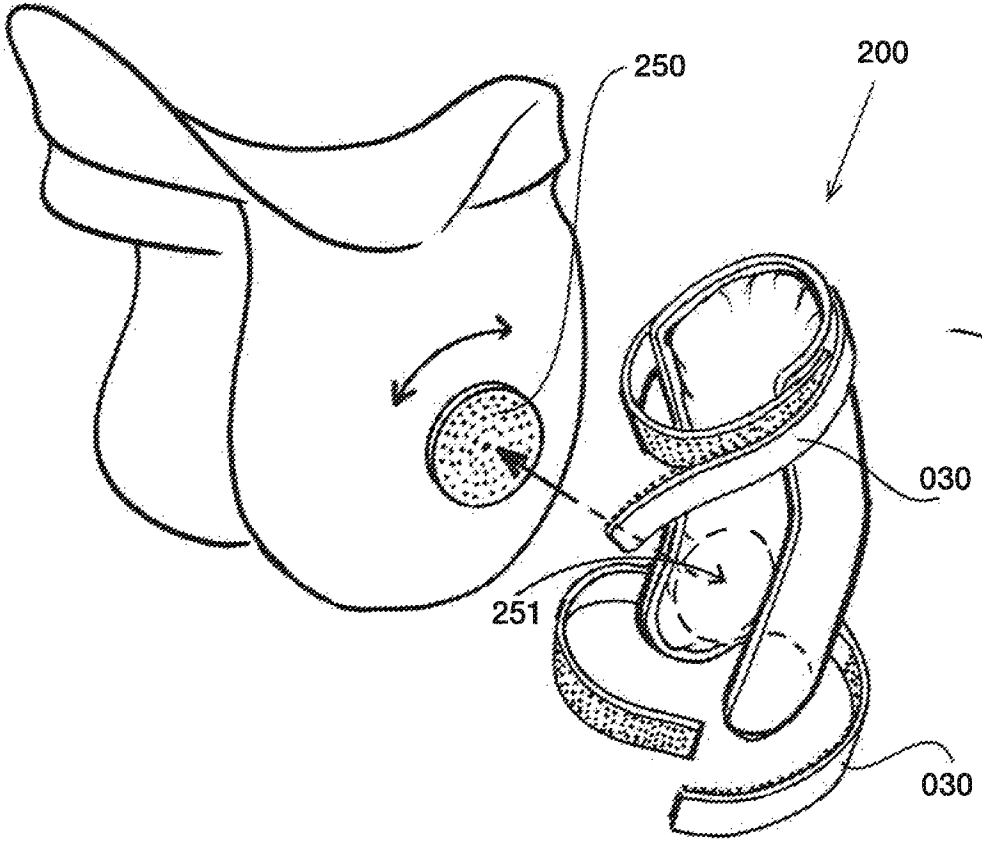
FIG. 29A is a perspective right-hand side and rear view of an assembly of a saddle equipped with another embodiment of horseman securing device by means of a rotatable connecting element fitted on the saddle, or at least the flap thereof, at the location of the knee of the horseman, with a hook and loop fastener of the hook-and-eyelet type on the side facing the horseman, and a tubular securing element which can be worn separately by the horseman.

FIGS. 29A, B show a horseman-securing device which is an assembly comprising a hook and loop fastener of the hook-and-eyelet type, in which a rotatable (arrows) connecting element (250) is provided between a touch-and-close-fastener-side on the saddle and a touch-and-close-fastener-side on the horseman, allowing a mutual movement between the saddle and the horseman at the respective securing location, corresponding to that shown in FIG. 28, but with the difference that here the hook and loop fastener is not provided directly on or around the clothing of the horseman, nor by means of a clamping structure with strip-shaped elements, but that the hook and loop fastener is provided on the medial side of a tubular securing element, as is shown, inter alia, FIGS. 22 to 25, with the difference that the tubular securing element here is not connected directly to the saddle by means of a hinge, but by means of the rotatable connecting element (250).

FIG. 29A shows the rotatable (double arrows) connecting element (250) fitted on the saddle or at least the flap thereof at the location of the knee of the horseman, with a hook and loop fastener of the hook-and-eyelet type on the side facing the horseman and a tubular securing element (200) which can be worn separately by the horseman. On the medial side, preferably at the location of the knee, the tubular securing element (200) has a hook and loop fastener of the hook-and-eyelet type (251) on the side facing the saddle, but of the other type than is provided on the connecting element (250). If desired, the vertical opening in the tubular securing element may be closed in a releasable manner using one or more strip-shaped elements (030).

FIG. 29B shows the same parts as in FIG. 29A, but in this case after the horseman has mounted the saddle and the tubular element (200) has been temporarily closed, by means of optionally strip-shaped elements (030).

Figure 30C:
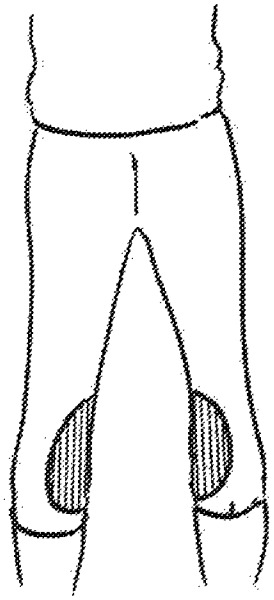
FIG. 30C is a partial front view of the bottom half of the horseman, in which metal parts, or small metal parts, or magnetic textile is arranged at the location of the medial side of his knees and/or thighs in such a way that a magnetic force is created by the magnetic field at the location of the saddle.
Figure 30B:
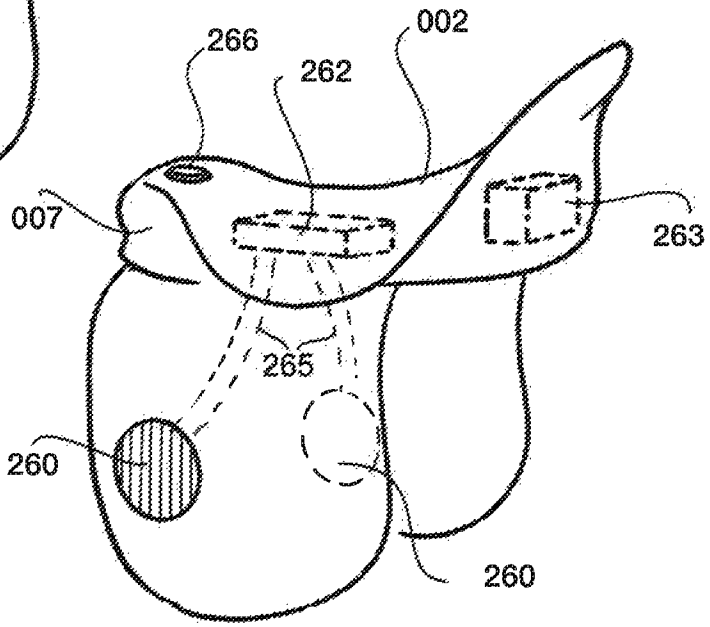
FIG. 30B is a perspective left-hand side and rear view of a saddle as shown in FIG. 30A, but here other positions for the battery are shown, for example on the sides of the saddle seat or on the rear side thereof.
Figure 30A:
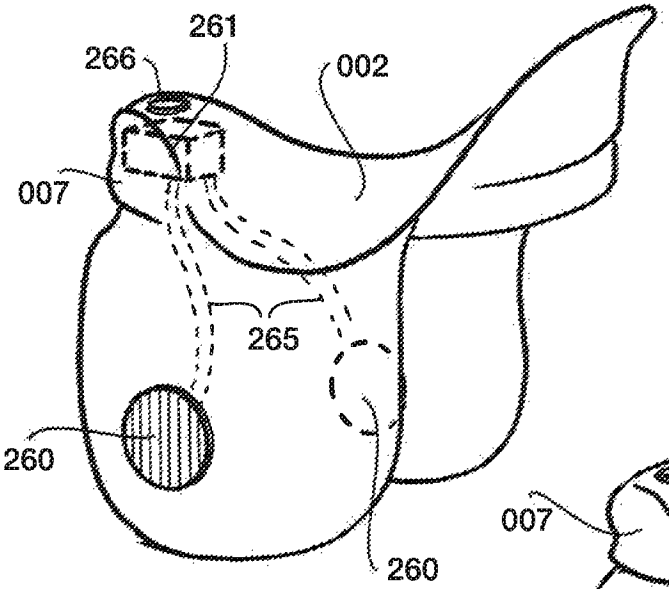
FIG. 30A is a perspective left-hand side and rear view of a saddle equipped with another embodiment of horseman securing device by means of a magnetic field that is present at the location of the knee of the horseman as part of the saddle or at least the flap thereof.

FIGS. 30A-30C show a horseman-securing device in which the securing device contains magnetic securing elements which, in use, form a magnetic connection between the horseman and the saddle.

FIG. 30A shows a saddle, seen from rear left-hand side, in which a magnetic field (260) is present at the location of the knee of the horseman as part of the saddle or at least the flap thereof. This magnetic field is generated by an electrical power source, such as a battery (261), illustrated here at the location of the pommel (007) of the saddle (002). Such a battery may, for example, be a rechargeable lithium/cadmium battery which is of a thin and small design. Such batteries may be arranged in a fixed position in or on the saddle with a charging point for charging the battery, but may also be removable, so that the battery can be charged at another location, away from the saddle.

The magnetic field (260) may also be located at other locations on or in the saddle, such as e.g. opposite the inner side of the thighs of the horseman or opposite his backside.

The magnetic field is connected to the battery (261) by means of electric wires (265).

By means of a regulator button (266), arranged, for example, at the front in the centre of the saddle, the horseman can regulate and switch the magnetic force on and off.

FIG. 30B shows the same as FIG. 30A, but here other positions for the battery (261) are shown, for example on the sides (262) of the saddle seat or on the rear side thereof (263). It is also possible for there to be more than one battery.

FIG. 30C shows the bottom half of the horseman from the front, in which metal parts or small metal parts or magnetic textile is arranged at the location of the medial side of his knees and/or thighs in such a way that a magnetic force is created by the magnetic field (260) at the location of the saddle. The magnetic field on the side of the horseman may be a fixed part of his clothing, such as e.g. his pair of riding breeches, but may also be fitted to his body or clothing temporarily, for example in combination with an optionally elastic stocking.

Figure 31B:
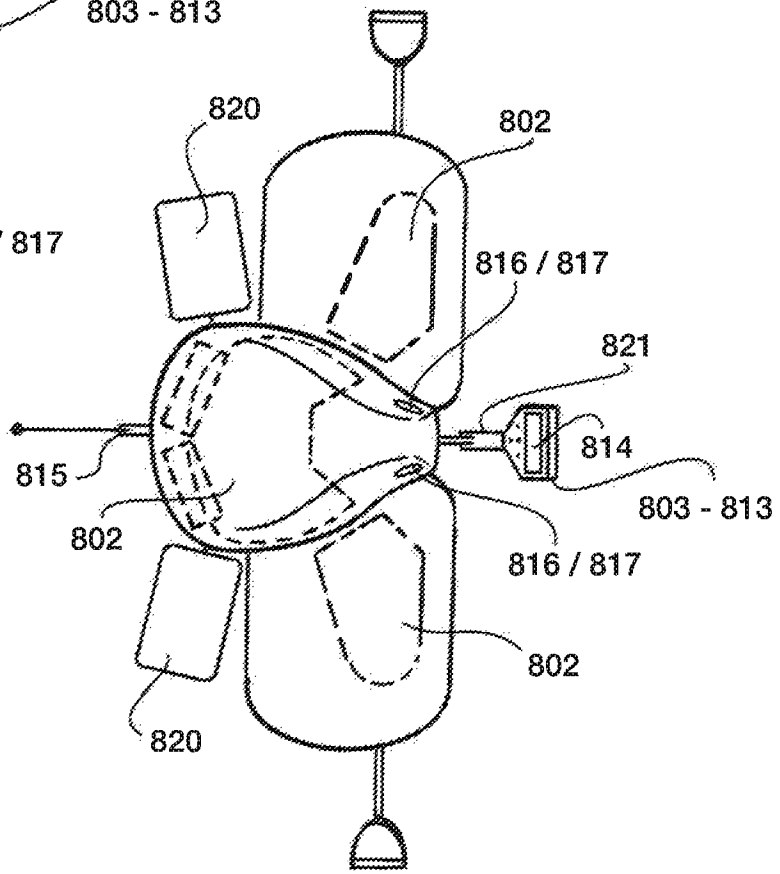
FIG. 31B is an upper view of a so-called "High-Tech" saddle.
Figure 31A:
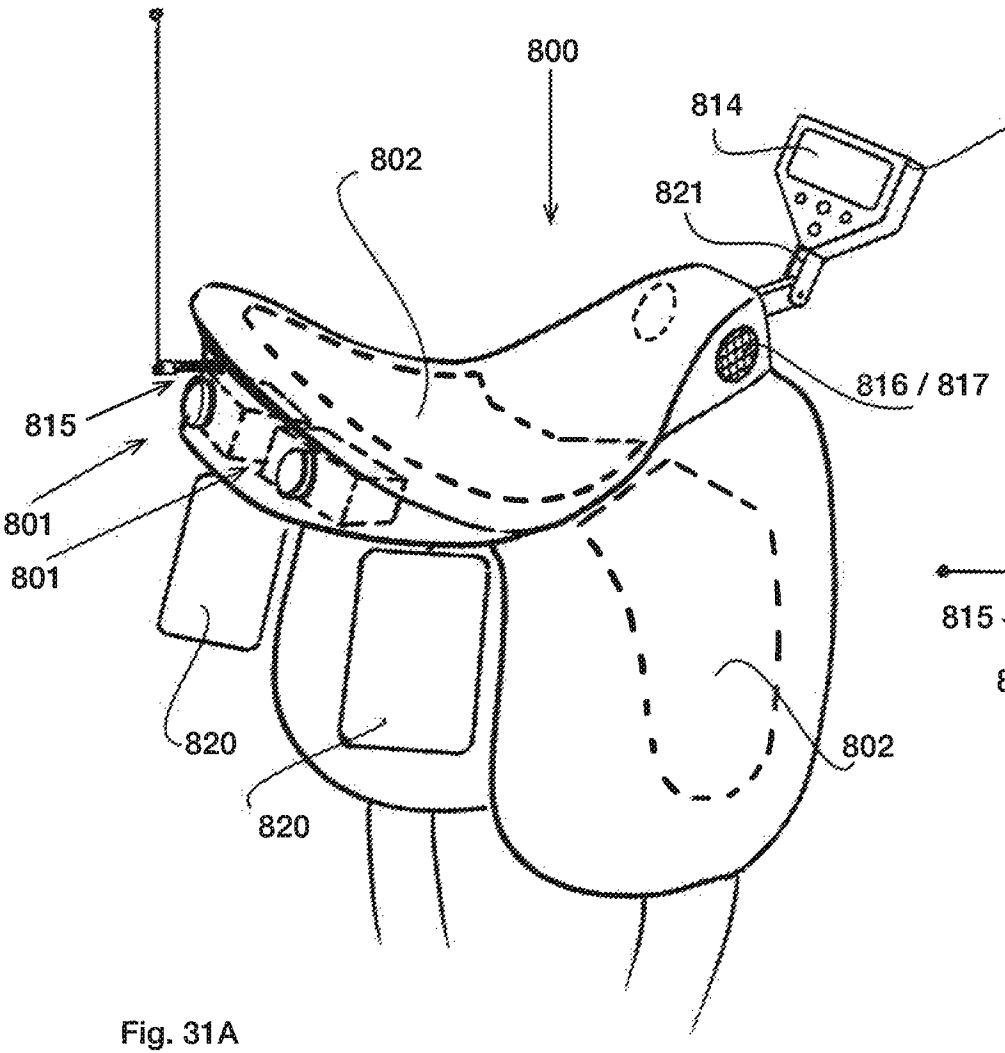
FIG. 31A is a perspective right-hand side and rear view of a so-called "High-Tech" saddle.

FIGS. 31A and 31B show a so-called "High-Tech" saddle, FIG. 31A from the rear right-hand side and FIG. 31B from above.

It will be clear that if a saddle is provided with electric power by means of one or more batteries (820), other power-consuming applications are also possible as a result of which a "high-tech" saddle (800) is produced with features such as, for example, lighting (801), heating or cooling (802) for a saddle and/or horseman or food or drinks, telephone (803), radio (804), TV (805), GPS (806), computer (807), internet (808), data reader and carrier (809), DVD player (810), CD player (811), gyrometer (812), weather station (813), monitor (814), transmitter (815), loudspeaker (816), alarm (817), pressure pump (818), air blower (819), etc.

It would be advantageous with such a "high-tech" saddle if the saddle were preferably be provided with a small display (814), preferably comprising a touchscreen suitable for outdoor use, which is preferably connected to the saddle by means of a movable and flexible arm (821) which preferably does not hinder the limbs, including the hands of the horseman.

Figure 32:
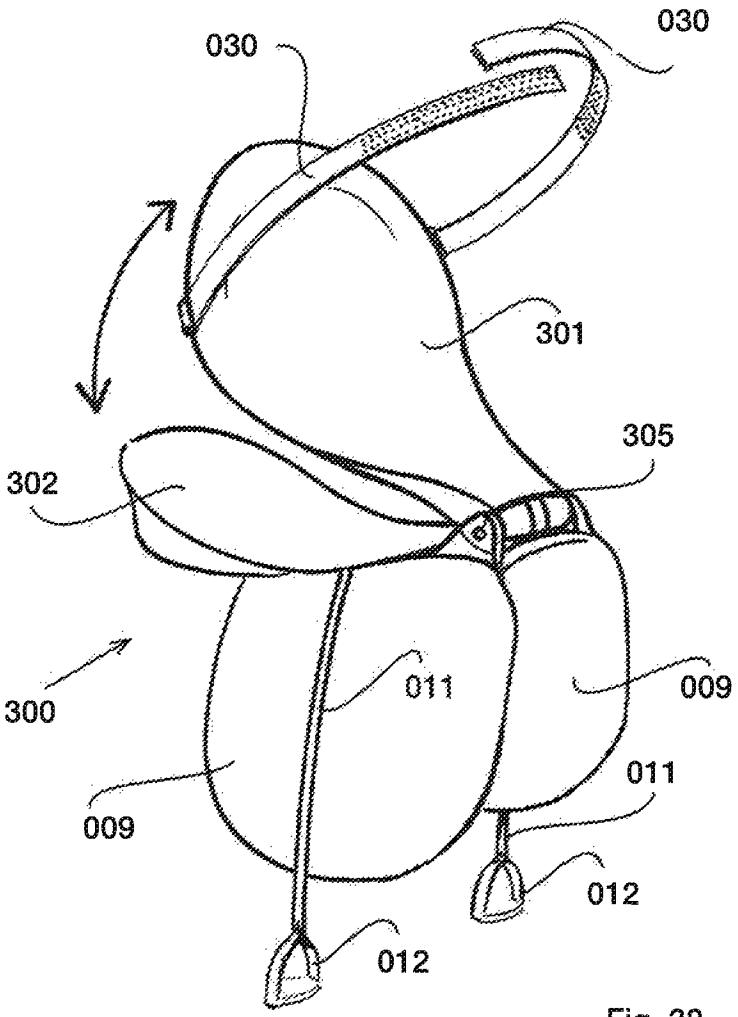

FIG. 32 shows a tiltable or pivotable saddle (300), in which the saddle consists of a movable saddle part (301) that is movably connected to a fixed saddle part (302) by means of a single hinge (305) at the front and top side of the saddle, and in which the horseman is or can be secured to the one or more movable saddle parts (301).

The movable saddle part may also be connected to the fixed saddle part by means of one or more springs or resilient elements instead of by means of such a hinge (not shown).

The securing devices themselves, which connect the horseman to the one or more movable saddle parts (301), may be of many different kinds. In this figure, the securing devices are shown as strip-shaped securing devices which may be connected to each other by means of a hook and loop fastener. In this example, the flaps (009) with stirrups (012) and stirrup leathers (011) form part of the one or more fixed saddle parts (302).

Figure 33:
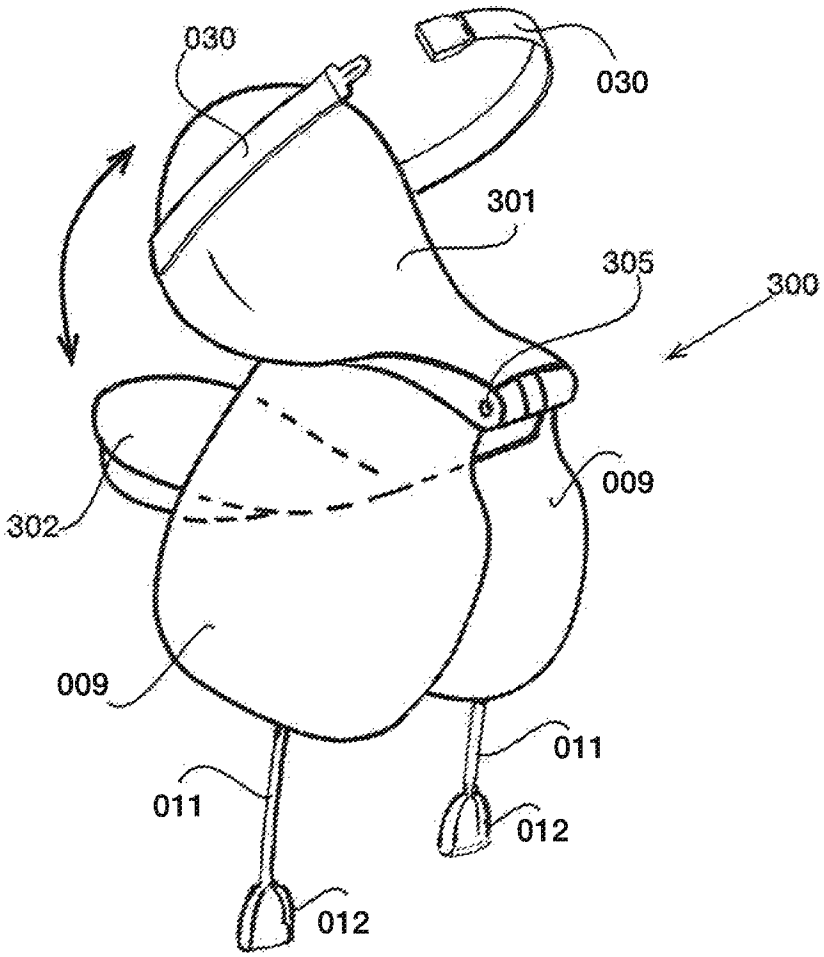
FIG. 32 and FIG. 33 are perspective right-hand side and front views of a saddle equipped with another embodiment of horseman securing device by means of a tiltable or pivotable saddle, in which the saddle consists of a movable saddle part that is movably connected to a fixed saddle part by means of a single hinge at the front and top side of the saddle, and in which the horseman is or can be secured to the one or more movable saddle parts.

FIG. 33 shows a tiltable or pivotable saddle (300), in which the saddle consists of a movable saddle part (301) that is movably connected to the one or more fixed saddle parts (302) by means of a single hinge (305) on the front and top side of the saddle, and in which the horseman is or can be secured to the one or more movable saddle parts (301). The securing devices themselves, which connect the horseman to the one or more movable saddle parts (301), may be of many different kinds. In this figure, the securing devices are shown as strip-shaped securing devices which may be connected to each other by means of a quick-action connection. In this example, the flaps (009) form part of the one or more movable saddle parts (301), while the stirrups (012) and stirrup leathers (011) form part of the one or more fixed saddle parts (302).

Figure 34C:
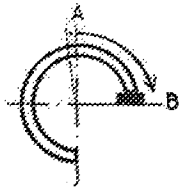
Figure 34B:
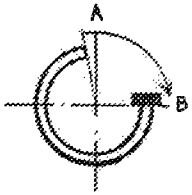
Figure 34A:
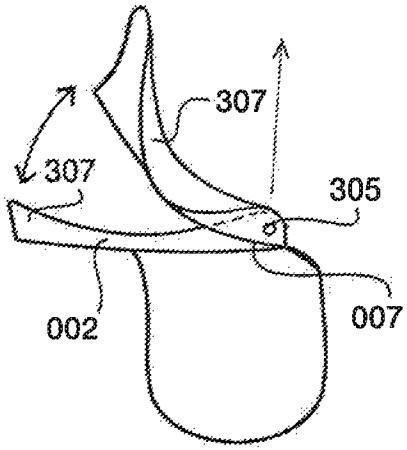
FIG. 34A is a right-hand side view of the saddle as illustrated in FIGS. 32 and 33, wherein some details of the single hinge at the location of the pommel of the saddle is shown.

FIGS. 34A-34C show some details of the single hinge (305) at the location of the pommel (007) of the saddle (002). By means of this hinge (305), the moving saddle part (301) is able to pivot with respect to the fixed saddle part (302). In this case, the moving saddle part (301) consists of a movable upper saddle seat and the fixed saddle part (302) of a fixed, immovable, lower saddle seat.

Figure 35A:
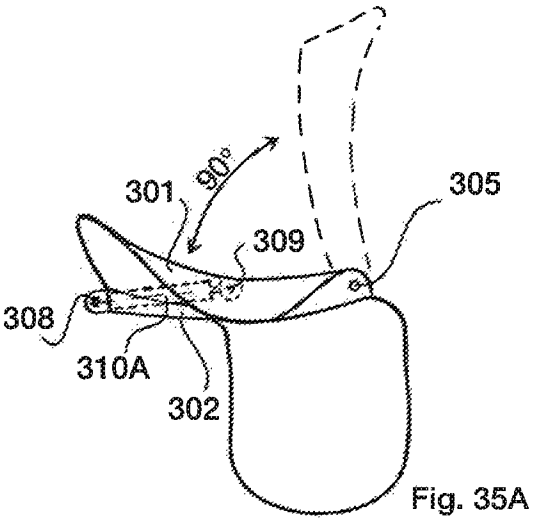
FIG. 35A is a right-hand side view of a tiltable or pivotable saddle as in FIGS. 32-34, in which a mechanical connecting and/or guide element is situated between the movable saddle part and the fixed saddle part, with both these saddle parts bearing against each other in the closed rest position.

FIGS. 34B and 34C show a detail of the rotating movement in hinge (305) of the saddle, as is shown in FIG. 34A, in which the maximum number of degrees is limited to 90 degrees, and this in such a way that the movable saddle part can pivot from a horizontal position (FIG. 35A) to a vertical position at most (illustrated by dashed lines in FIG. 35A). Limiting the movable saddle part to a vertical position at most, prevents the horseman from coming forward further than a body position in which his thighs are vertical. This maximum vertical position is only required when jumping over an obstacle. It may thus be advantageous if the maximum number of pivotable degrees for horsemen who do not jump over obstacles is limited still further, e.g. to 45 or even 30 degrees, in order to secure the horseman even more stably to the horse and saddle. It is advantageous in this case if the maximum number of degrees of rotation is adjustable, for example by means of an adjusting button or screw.

For the sake of simplicity, further securing devices of the horseman on the movable saddle part (301) have been omitted in FIG. 34.

FIGS. 35A, B show a tiltable or pivotable saddle (300), as shown in FIGS. 32 to 34, in which a mechanical connecting and/or guide element (310) is situated between the movable saddle part (301) and the fixed saddle part (302).

FIG. 35A shows a tiltable or pivotable saddle (300), in which a mechanical connecting and/or guide element (310) is situated between the movable saddle part (301) and the fixed saddle part (302), with both these saddle parts bearing against each other in the closed rest position. By means of hinges (308) and (309) at the location of both its ends, the connecting and/or guide element (310A) is connected to both saddle parts, preferably, seen from above, in the centre between both saddle parts, and illustrated here by means of dashed lines. Such an element (310A) may be of hydraulic and/or sprung telescopic design, and is shown here in a starting position with shortened length. This may also be several connecting and/or guide elements.

Figure 35B:
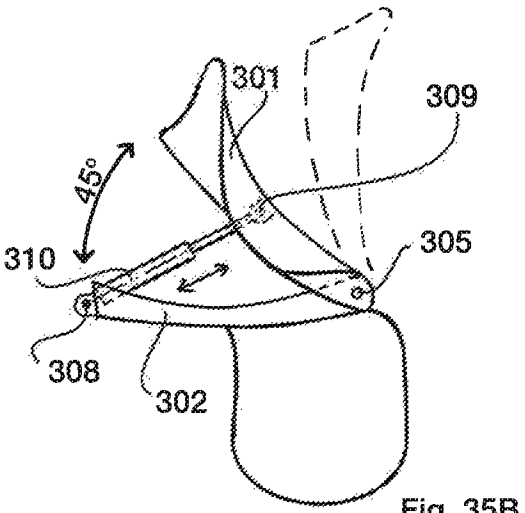
FIG. 35B is a right-hand side view of a tiltable or pivotable saddle, in which a mechanical connecting and/or guide element is situated between the movable saddle part and the fixed saddle part, according to FIG. 35A, in which case both these saddle parts are now a distance apart, in an open active position, in which the length of the element has increased.

FIG. 35B shows a tiltable or pivotable saddle (300), in which a mechanical connecting and/or guide element (310B) is situated between the movable saddle part (301) and the fixed saddle part (302), according to FIG. 35A, in which case both these saddle parts are now a distance apart, in an open active position, in which the length of the element (310B) has increased.

For the sake of simplicity, further securing devices of the horseman on the movable saddle part (301) have been omitted in FIG. 35.

FIGS. 36A, 36B, 36E, and 36F show a tiltable or pivotable saddle (300), in which the saddle consists of a movable saddle part (301) which is movably connected to the fixed saddle part (302) by means of a double hinge (306) and (307) at the location of the saddle, and in which the horseman is or can be secured to the movable saddle part (301).

Figure 36A:
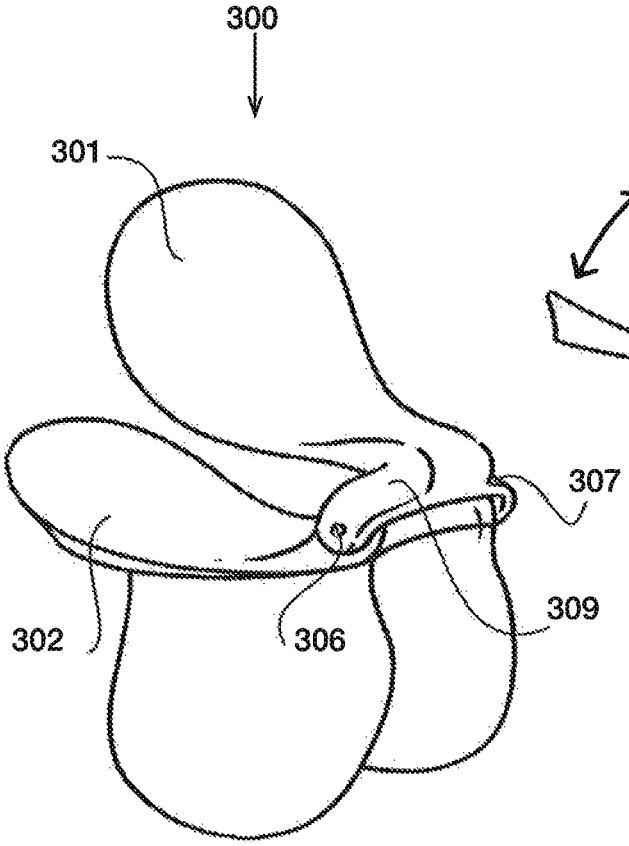
FIG. 36A is a perspective right-hand side and front view of a tiltable or pivotable saddle, in which the saddle consists of a movable saddle part which is movably connected to the fixed saddle part by means of double hinges at the location of the saddle, and in which the horseman is or can be secured to the movable saddle part.

FIG. 36A shows a tiltable or pivotable saddle (300), seen from the front right-hand side at an angle, in which the saddle consists of a movable saddle part (301) which is movably connected to the fixed saddle part (302) by means of a double hinge (306) and (307) at the location of the saddle, and in which the horseman is or can be secured to the movable saddle part (301). The double hinges (306) and (307) are situated at the top and at the front and on either side of the saddle, and are connected to each other by means of a hinge bridge (309).

Figure 36B:
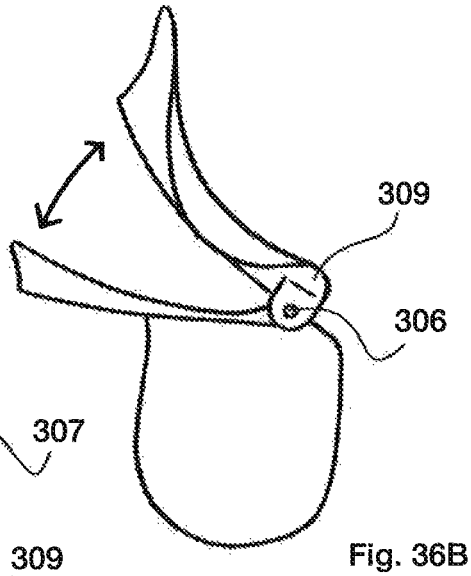
FIG. 36B is a right-hand side view of an identical saddle to FIG. 36A.

FIG. 36B shows an identical saddle to FIG. 36A, but here seen from the right-hand side.

Figure 36C:
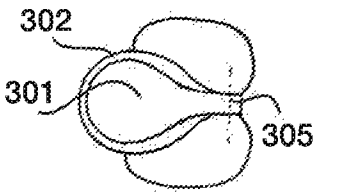
FIG. 36C are a perspective right-hand side and front view (larger drawing) and upper view (smaller drawing) of a tiltable or pivotable saddle, in which the saddle consists of a movable saddle part which is movably connected to a fixed saddle part by means of a single hinge at the front and top side of the saddle, and in which the horseman is or can be secured to the one or more movable saddle parts.

FIG. 36C shows a tiltable or pivotable saddle (300), in which the saddle consists of a movable saddle part (301) which is movably connected to a fixed saddle part (302) by means of a single hinge (305) at the front and top side of the saddle, and in which the horseman is or can be secured to the one or more movable saddle parts (301). This figure shows that the hinge (305) as such may be relatively narrow and may be concealed on or in the fixed saddle part (302). The movable saddle part (301) may be situated on top of the fixed saddle part (302) or may be recessed into the fixed saddle part (302) or surround it. The movable saddle part (301) may be virtually as large as the fixed saddle part (302), but may also be relatively small.

Figure 36D:
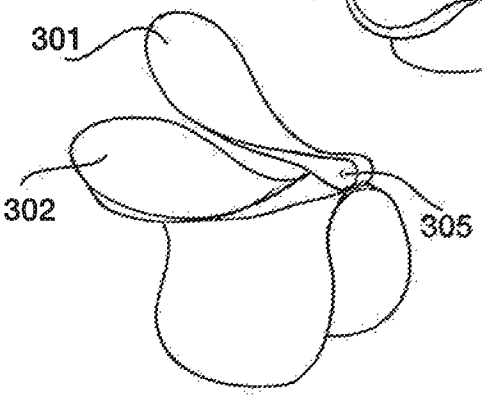
FIG. 36D are a perspective right-hand side and front view (larger drawing) and upper view (smaller drawing) of a tiltable or pivotable saddle, in which the saddle consists of a movable saddle part which is movably connected to a fixed saddle part by means of a single hinge at the front and top side of the saddle, and in which the horseman is or can be secured to the one or more movable saddle parts.
Figure 36D:
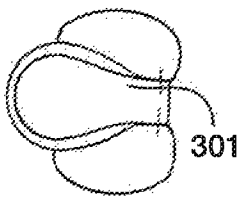

FIG. 36D shows a tiltable or pivotable saddle (300), in which the saddle consists of a movable saddle part (301) which is movably connected to a fixed saddle part (302) by means of a single hinge (305) at the front and top side of the saddle, and in which the horseman is or can be secured to the one or more movable saddle parts (301). The hinge (305) is relatively wide, compared to FIG. 36C.

Figure 36E:
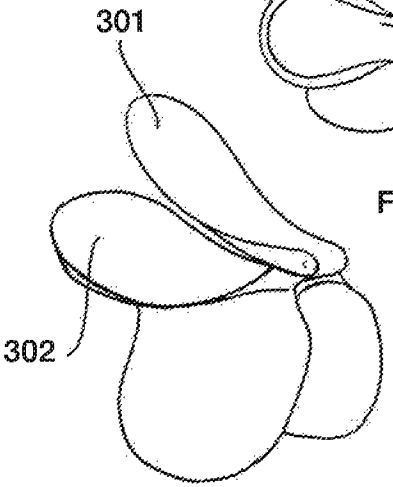
FIG. 36E is a perspective right-hand side and front view of an identical saddle to that in FIGS. 36A and 36B, comprising double hinges, but here these are now in a lower position on the saddle, with the hinge bridge being longer and higher.
Figure 36E:
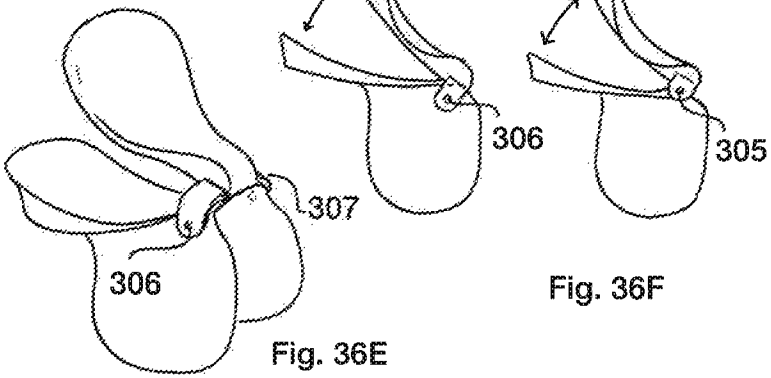
Figure 36F:
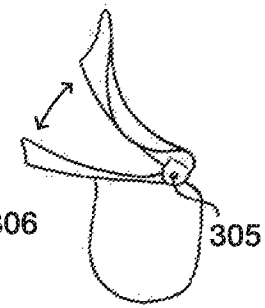
FIG. 36F are right-hand side views of an identical saddle to that in FIGS. 36A and 36B, comprising double hinges, but here these are now in a lower position on the saddle, with the hinge bridge being longer and higher.

FIGS. 36E and 36F show an identical saddle to that in FIGS. 36A and 36B, comprising double hinges (306) and (307), but here these are now in a lower position on the saddle, with the hinge bridge (309) being longer and higher.

For the sake of simplicity, further securing devices of the horseman on the movable saddle part (301) have been omitted in FIG. 36.

FIGS. 37A-37E all show a tiltable or pivotable saddle (300), in which the saddle consists of a movable saddle part (301) which is movably connected to the fixed saddle part (302) by means of double hinges (306 and 307) at the location of the saddle, and in which the horseman is or can be secured to the movable saddle part (301), wherein the movable saddle part (301) has been extended downwards on either side using movable extension parts (311) which can make contact with the inner side of the thighs and optionally the knees of the horseman.

Figures 37A, 37B, 37C, 37D, 37E:
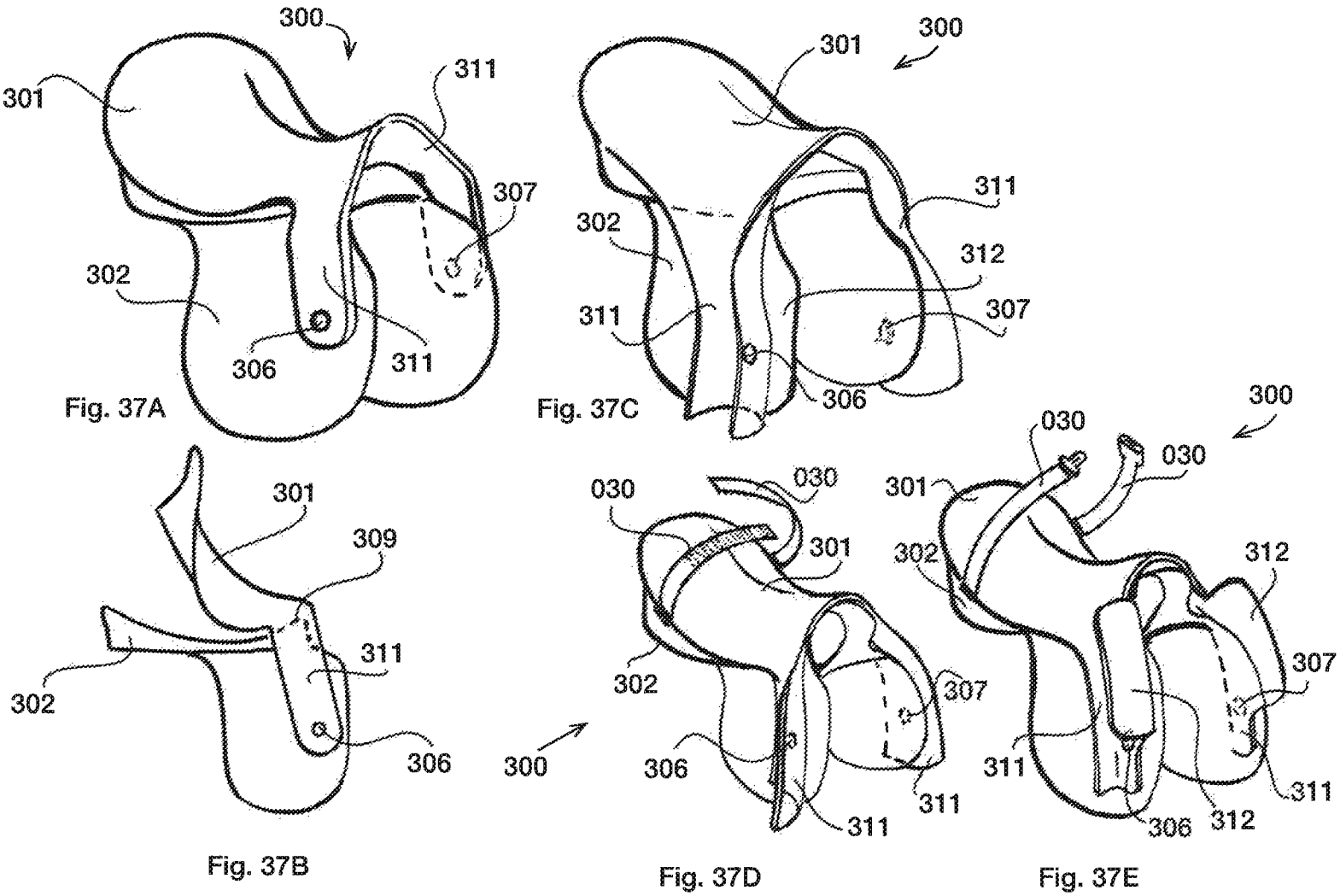
FIG. 37A is a perspective right-hand side and front view of a tiltable or pivotable saddle, in which the movable saddle part has been extended downwards on both sides using movable extension parts which can make contact with the inner side of the thighs and knees of the horseman, in rest position.
FIG. 37B is a right-hand side view of the same saddle as FIG. 37A, in raised position.
FIG. 37C is a perspective right-hand side and front upper view of a tiltable or pivotable saddle, in which the movable saddle part has been extended downwards on both sides using movable extension parts which can make contact with the inner side of the thighs and knees of the horseman, in which the extension parts on the front side of the thighs and knees of the horseman have been widened laterally, like wings, which, in addition to having a supporting function, may serve as passive protection for the horseman.
FIG. 37D is a perspective right-hand side and front upper view of a tiltable or pivotable saddle as shown in FIG. 37C, in which two strip-shaped elements are now also shown which are attached to the moving saddle part and which may be connected to each other, for example by means of a hook and loop fastener.
FIG. 37E is a perspective right-hand side and front upper view of a tiltable or pivotable saddle as shown in FIG. 37C, seen from the side at an angle, in which two strip-shaped elements are now also shown which are attached to the moving saddle part and which may be connected to each other, for example by means of a safety lock, as are used in car safety or aeroplane safety belts.

For the sake of simplicity, further securing devices of the horseman on the movable saddle part (301) have been omitted in FIGS. 37A to 37C.

FIG. 37A shows a tiltable or pivotable saddle (300) seen from the front at an angle, in which the movable saddle part (301) has been extended downwards on both sides using movable extension parts (311) which can make contact with the inner side of the thighs and knees of the horseman. In this case, the double hinges (306) and (307) are at the location of the knees of the horseman, but it could equally well have been a tiltable saddle with only one hinge, as illustrated in FIGS. 33 to 35.

FIG. 37B shows the same saddle as FIG. 37A, but now seen from the right-hand side. The hinge bow (309) corresponds to the hinge bow (309) as shown in FIG. 37A, but the movable extension parts (311) and the hinges (306 and 307) have been extended and moved further downwards, respectively.

FIG. 37C shows a tiltable or pivotable saddle (300), seen from the front at an angle, in which the movable saddle part (301) has been extended downwards on both sides using movable extension parts (311) which can make contact with the inner side of the thighs and knees of the horseman, in which the extension parts (311) on the front side of the thighs and knees of the horseman have been widened laterally, like wings (312), which, in addition to having a supporting function, may serve as passive protection for the horseman.

FIG. 37D shows a tiltable or pivotable saddle (300) as shown in FIG. 37C, seen from the side at an angle, in which two strip-shaped elements (030) are now also shown which are attached to the moving saddle part (301) and which may be connected to each other, for example by means of a hook and loop fastener. The belt is shown in a(n) (temporarily) open position.

FIG. 37E shows a tiltable or pivotable saddle (300) as shown in FIG. 37C, seen from the side at an angle, in which two strip-shaped elements (030) are now also shown which are attached to the moving saddle part (301) and which may be connected to each other, for example by means of a safety lock, as are used in car safety or aeroplane safety belts. Here, the belt is shown in a(n) (temporarily) open position. In addition, the wings (312) are now only provided at the location of the front side of the thighs of the horseman. This embodiment has been widened further and the purpose of the wings is more to mechanically detain the thighs (and the horseman), to prevent the horseman from moving too far in the forward direction.

Figure 38B:
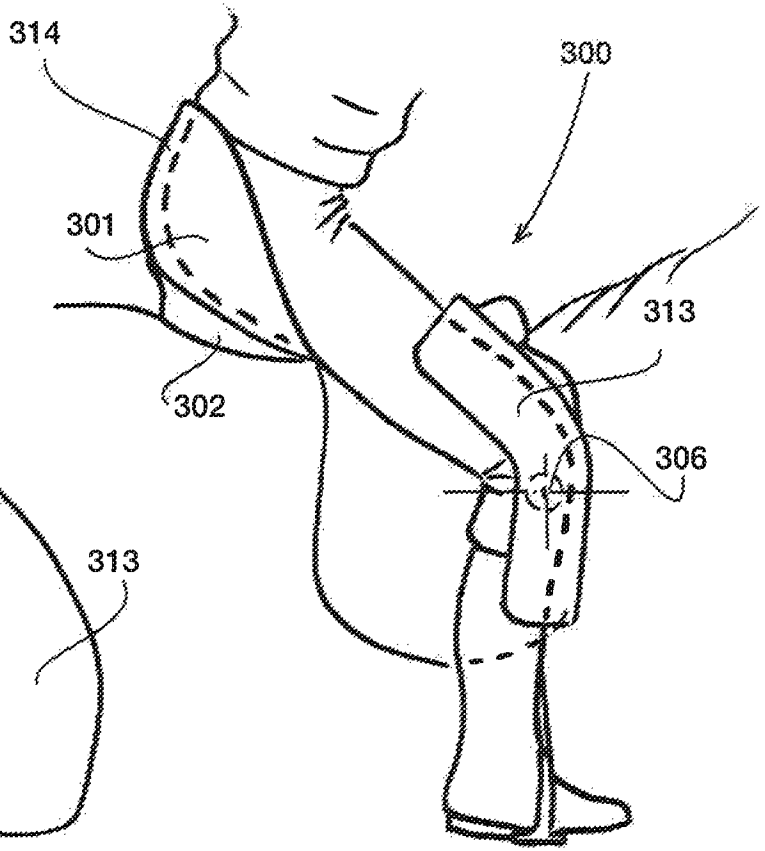
FIG. 38B is an enlarged partial right-hand side view of a horse carrying a saddle equipped with a horseman securing device by means of a tiltable or pivotable saddle with double hinges at knee level, in which the backrest and the leg supports are shown in a larger size in order to make it clear in which way a horseman may be secured between these supports, in the rest position.
Figure 38A:
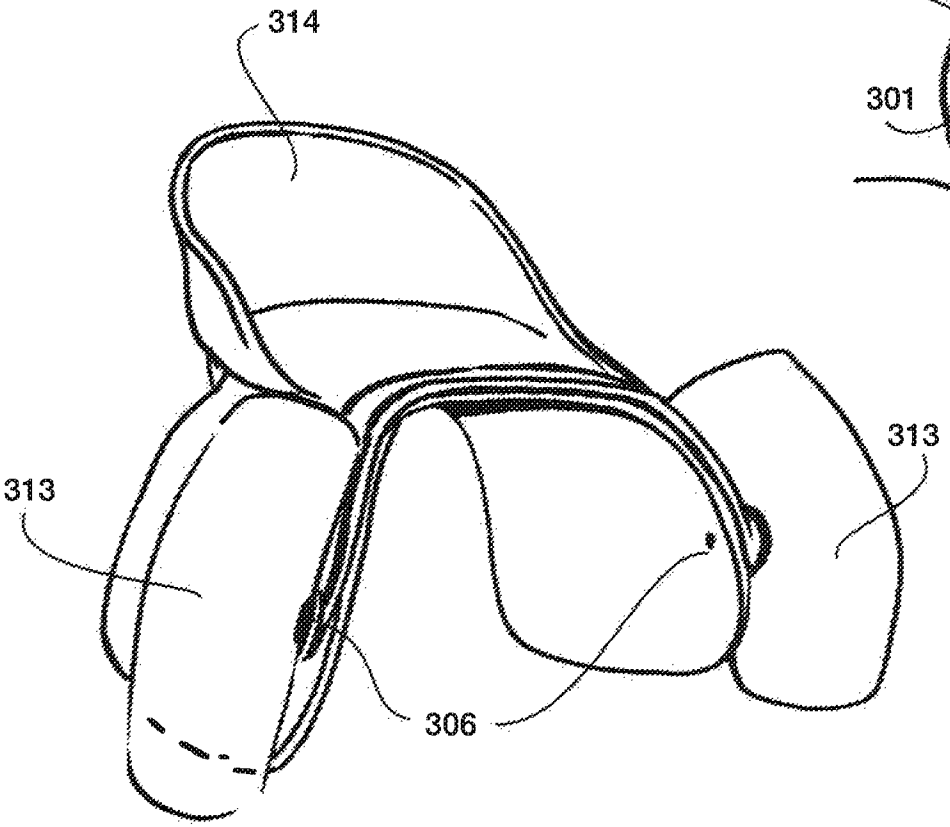
FIG. 38A is a perspective right-hand side and front upper view of a tiltable or pivotable saddle with double hinges such as that shown in FIGS. 36 and 37.

FIG. 38A shows a tiltable or pivotable saddle (300) with double hinges (306) such as that shown in FIGS. 36 and 37, seen from the front at an angle. The wings or retaining or protecting parts (313) on both sides at the location of the front side of the thighs and/or knees of the horseman are now both connected to the hinges (306), so that these can move concomitantly with the movement of the horseman and of the movable saddle part (301). In addition, the rear part of the movable saddle part (301) has been extended upwards, as a result of which a low backrest (314) is created around his buttocks and/or lower back, which obviously also moves concomitantly with the movements of the movable saddle part (301). In this way, the horseman is clamped, as it were, between the low backrest (314) at his rear side and the leg supports (313) at his front side. These leg supports (313) at the front side of the horseman may be long, in which case they cover the knees and thighs up to the lower body of the horseman on the front side, or short, in which case they, for example, only cover the knees and possibly a short section of the distal thigh of the horseman. Also, telescopic leg supports (313) consisting of several parts, also including different materials or compositions, are possible.

FIG. 38B shows a tiltable or pivotable saddle (300) with double hinges (306) at knee level, seen from the side, in which the backrest (314) and the leg supports (313) are shown in a larger size in order to make it clear in which way a horseman may be secured between these supports, in the rest position.

Figure 38C:
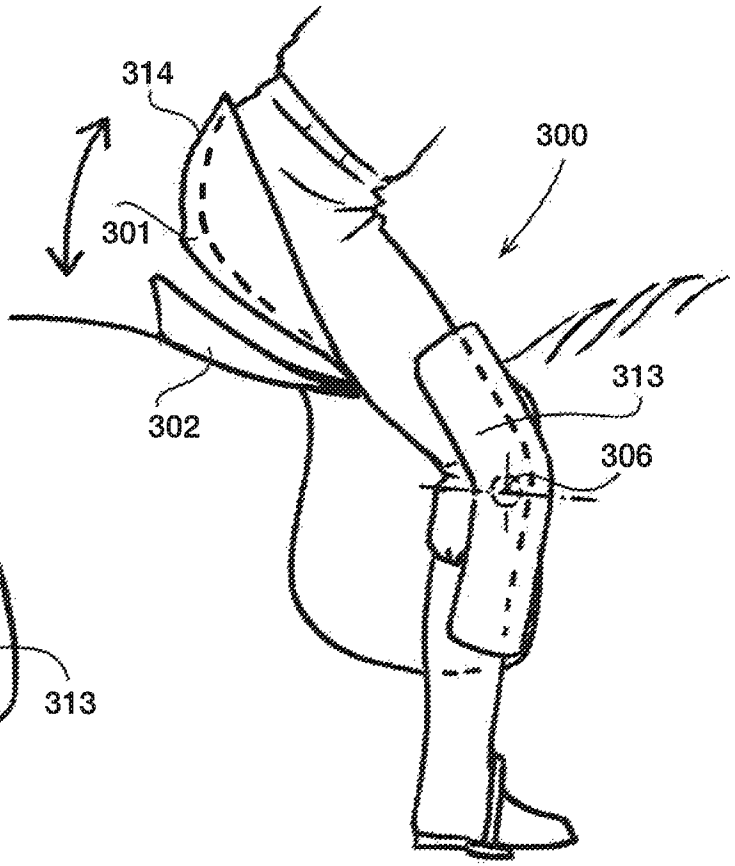
FIG. 38C is an enlarged partial right-hand side view of a horse carrying a saddle equipped with a horseman securing device by means of a tiltable or pivotable saddle with double hinges at knee level, seen from the side, corresponding to FIG. 38B, but here in a raised position.

FIG. 38C shows a tiltable or pivotable saddle (300) with double hinges (306) at knee level, seen from the side, corresponding to FIG. 38B, but here in a raised position.

FIGS. 38D-38G show a corresponding tiltable or pivotable saddle (300), in which 1 hinge (305) is used instead of 2 hinges.

Figure 38D:
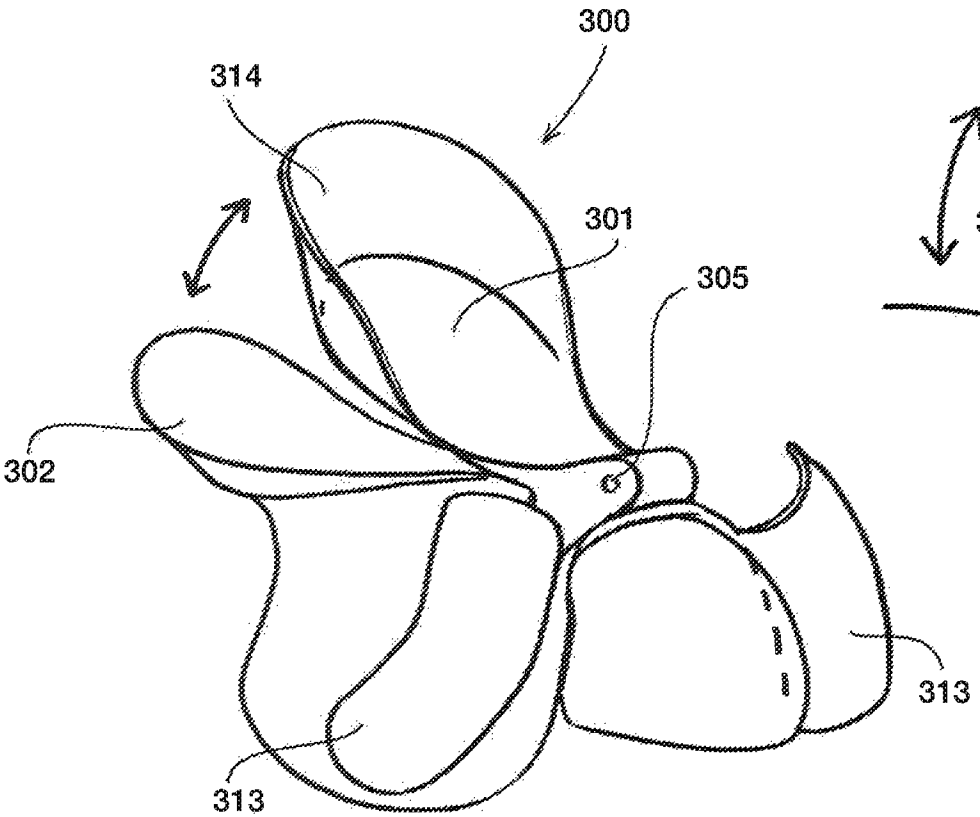
FIG. 38D is a perspective right-hand side and front upper view of a tiltable or pivotable saddle, in which 1 hinge is used instead of 2 hinges, in raised position.
Figure 38F:
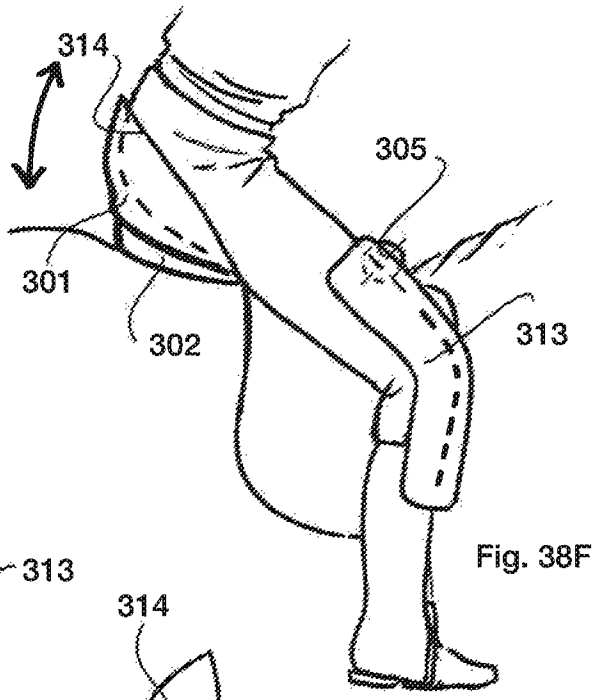
FIG. 38F is an enlarged partial right-hand side view of a horse carrying a saddle equipped with a horseman securing device by means of a tiltable or pivotable saddle, with 1 hinge and backrest, in rest position.
Figure 38G:
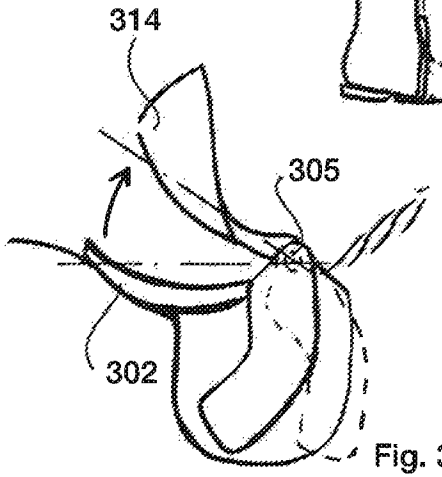
FIG. 38G is a right-hand side view of a tiltable or pivotable saddle, with 1 hinge and backrest, in raised position.
Figure 38E:
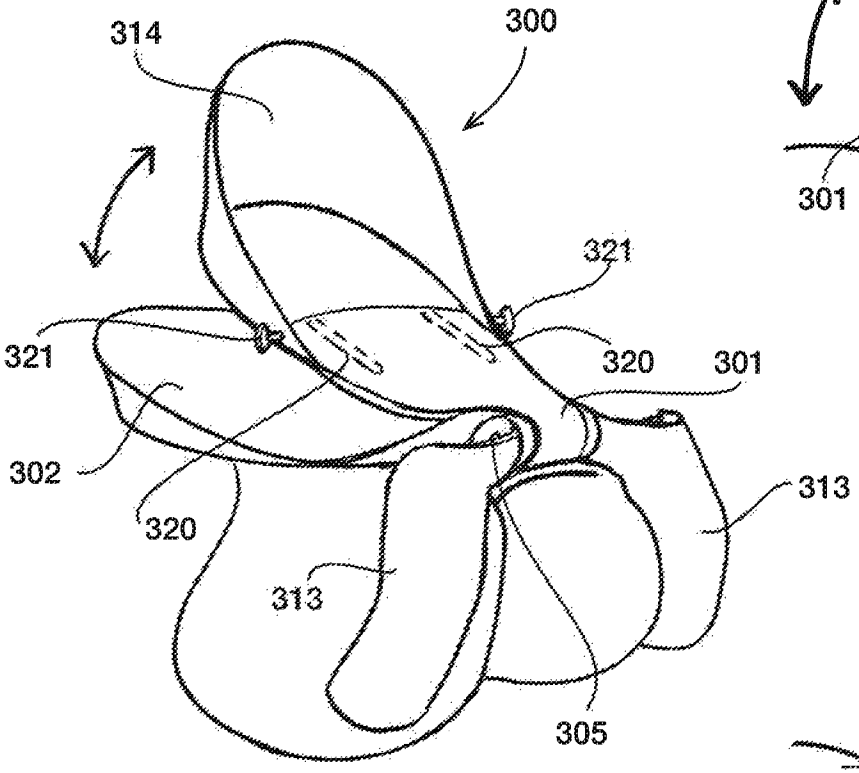
FIG. 38E is a perspective right-hand side and front upper view of a tiltable or pivotable saddle, in which 1 hinge is used instead of 2 hinges, in raised position, and shows in addition that the movable saddle part may also consist of 2 parts a front part which is connected to hinge, and a rear part with a backrest, in which case the rear part is positioned in the front part, for example by means of one or more (shown here as 2) sliding pins in the front part.

FIGS. 38D and 38E show a tiltable or pivotable saddle (300), with 1 hinge (305) in a raised position, in which the backrest (314) and the wings (313) tilt or pivot simultaneously with the movable saddle part (301).

FIG. 38E shows in addition that the movable saddle part (301) may also consist of 2 parts: a front part (301) which is connected to hinge (305), and a rear part with a backrest (314), in which case the rear part (314) is positioned in the front part, for example by means of one or more (shown here as 2) sliding pins in the front part (301). In this case, the position of the two parts with respect to each other may be temporarily ensured by means of, for example, 2 adjusting turning knobs, for example on either side of the movable saddle part (301). In this way, the back part (314) of the movable saddle part (301) may be adjusted to the size and build of the horseman.

FIG. 38F shows a tiltable or pivotable saddle (300), with 1 hinge (305) in rest position, seen from the side.

FIG. 38G shows a tiltable or pivotable saddle (300), with 1 hinge (305) in raised position, seen from the side.

For the sake of simplicity, further securing techniques of the horseman on the movable saddle part (301) have been omitted in FIG. 38.

Figure 39B:
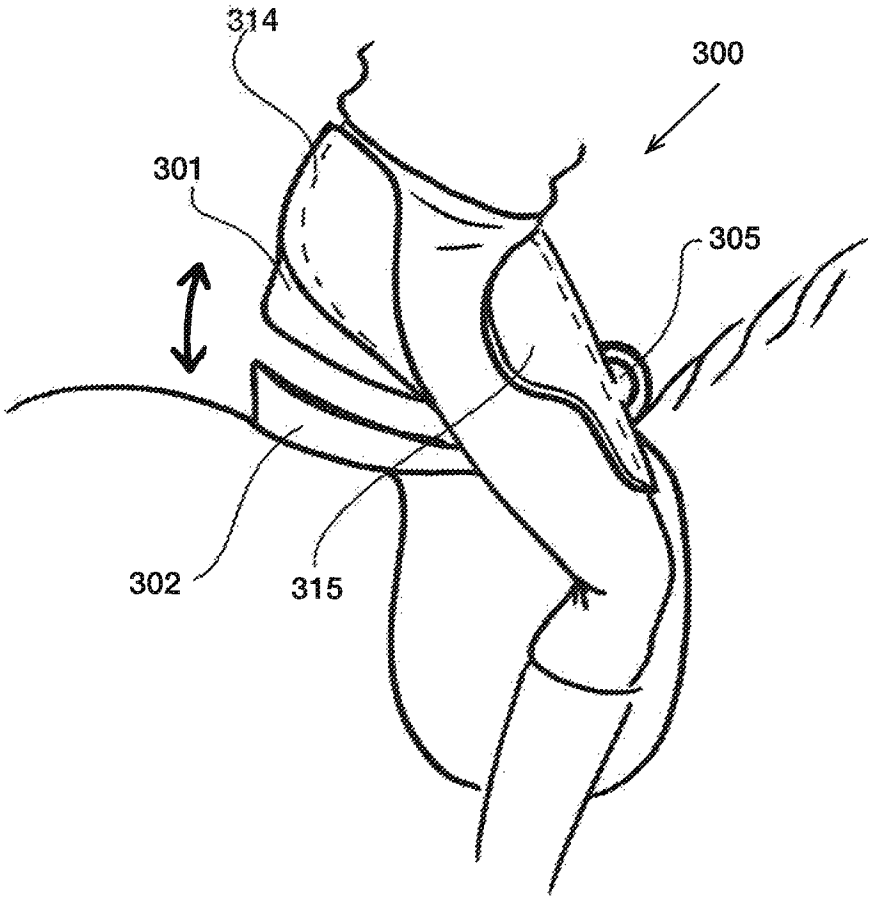
FIG. 39B is an enlarged partial right-hand side view of a horse carrying a saddle equipped with a horseman securing device by means of a tiltable or pivotable saddle with a single hinge, such as that shown in FIG. 39A, but now in raised position.
Figure 39A:
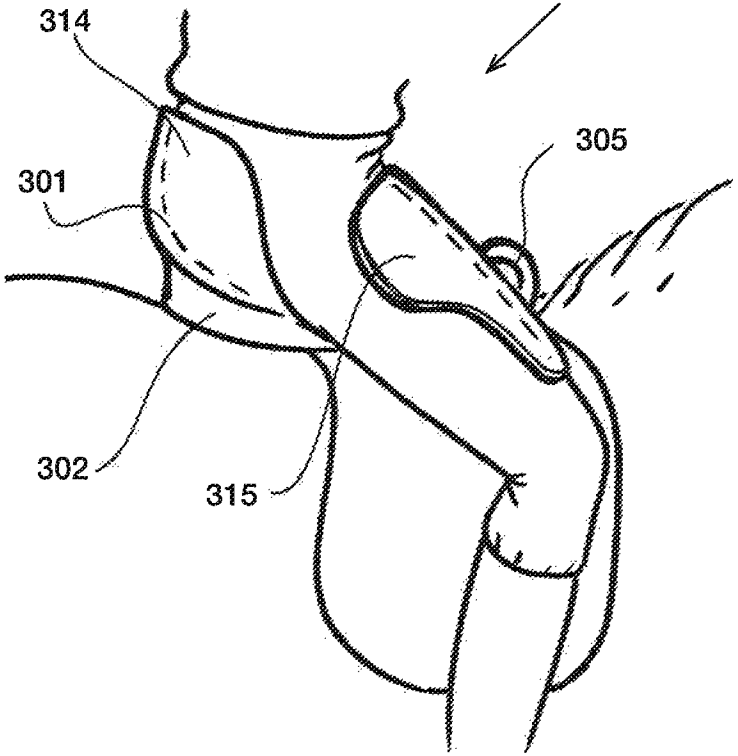
FIG. 39A is an enlarged partial right-hand side view of a horse carrying a saddle equipped with a horseman securing device by means of a tiltable or pivotable saddle with a single hinge, but otherwise as shown in FIGS. 38A and 38B, in which the leg support is limited to only a limited thigh clamp which is also situated more around the lateral side of the thigh, in which this thigh clamp is connected to the moving saddle part and/or the single hinge or the double hinges, in rest position.

FIG. 39A shows a tiltable or pivotable saddle (300) with a single hinge (305), but otherwise as shown in FIGS. 38A and B, seen from the side, in which the leg support (313) is limited to only a limited thigh clamp (315) which is also situated more around the lateral side of the thigh, in which this thigh clamp (315) is connected to the moving saddle part (301) and/or the single hinge (305) or the double hinges (206 and 207, respectively). The tiltable or pivotable saddle (300) is shown here in the rest position, in which the movable saddle part lies on top of the fixed saddle part. If such a thigh clamp is made of clamping and bendable material, the clamping action between the backrest (314) and thigh clamp (315) may be such that no additional securing techniques, such as e.g. strip-shaped elements, are required to releasably secure the horseman to the moving saddle part (301) in a reliable manner. But obviously, combinations with other securing techniques are also possible (not shown here).

FIG. 39B shows a tiltable or pivotable saddle (300) with a single hinge (305), such as that shown in FIG. 39A. The tiltable or pivotable saddle (300) is shown here in the active open position, in which the movable saddle part (301) is situated above the fixed saddle part (302). It can clearly be seen that the thigh clamp (315) moves simultaneously with the movable saddle part (301).

The following figures show examples of horseman-securing devices which secure the horseman to the horse or the saddle, mainly intended in combination with the tiltable or pivotable saddle shown and described above, and thus satisfies the starting points of the invention with regard to enabling the required equestrian movements to be made despite the temporary horseman-securing arrangement. This is due to the fact that, if these securing devices were to be applied separately from the tiltable or pivotable saddle, then the required equestrian movements, in which the horseman raises himself up and returns to the starting position, would no longer be possible, as the horseman would then be fixed to the (non-movable) saddle seat.

Figure 40B:
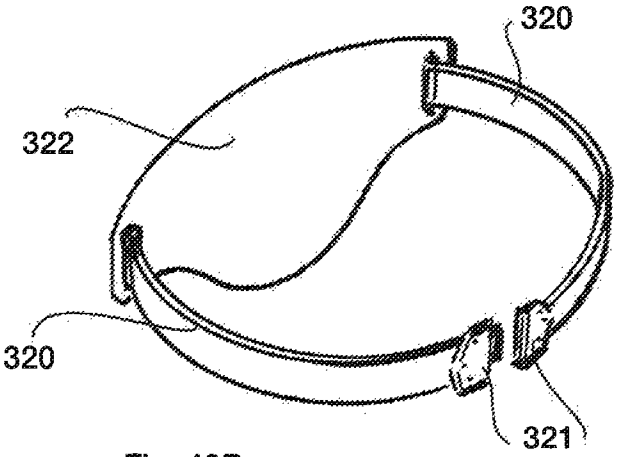
FIG. 40B is a perspective right-hand side and front upper view of a detail of a safety belt from FIG. 40A, in which the safety lock is in the open position. In addition, it shows that, on the rear side of the horseman, the safety belt is a continuous structure or forms part of a continuous structure.
Figure 40C:
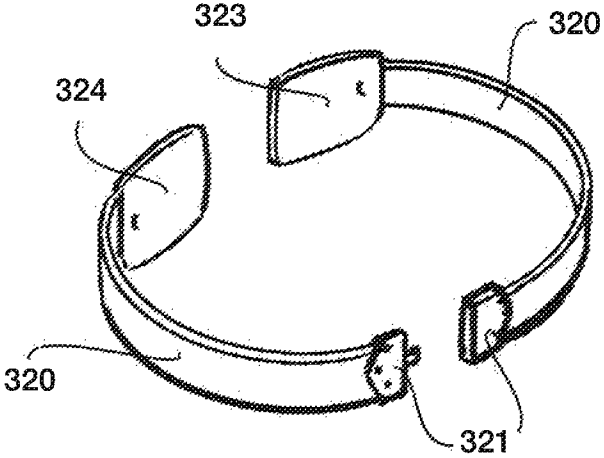
FIG. 40C is a perspective right-hand side and front upper view of a detail of a safety belt from FIG. 40A, in which the safety lock is in the closed position. In addition, it shows that, on the rear side of the horseman, the safety belt is a non-continuous structure or forms part of a non-continuous structure.
Figure 40A:
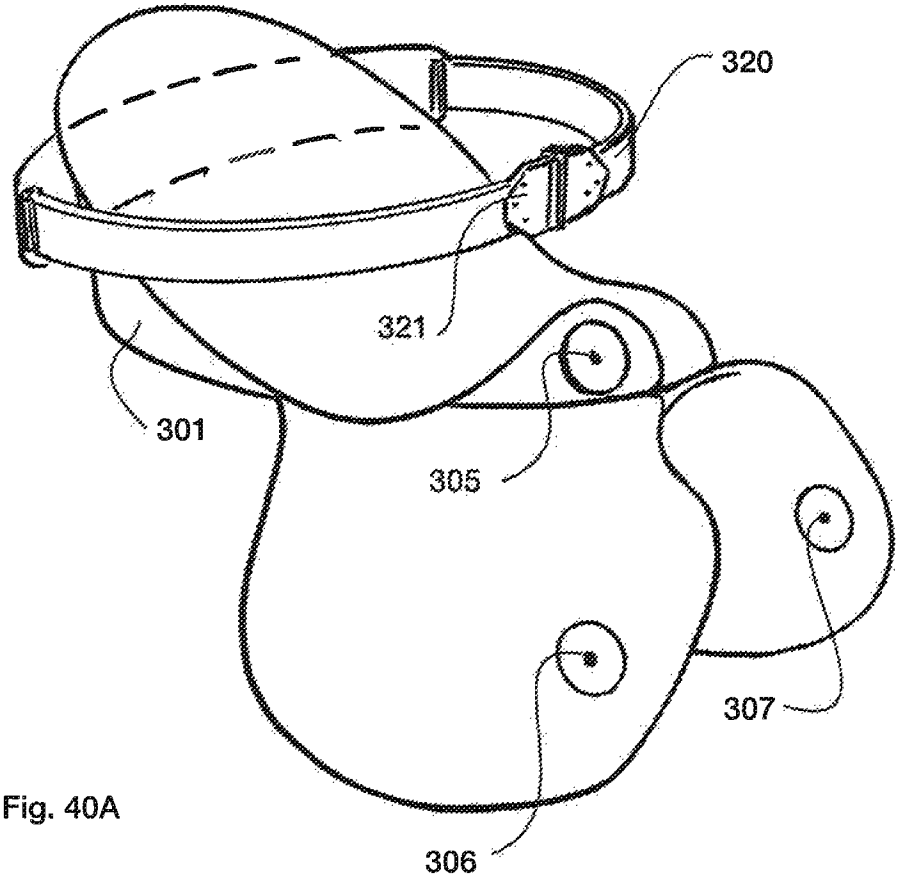
FIG. 40A is a perspective right-hand side and front upper view of only the movable saddle part as the upper saddle seat of a tiltable or pivotable saddle. For the sake of simplicity, the remainder of the saddle has been omitted.

FIG. 40A shows only the movable saddle part (301) as the upper saddle seat of a tiltable or pivotable saddle (300), seen from the front at an angle. For the sake of simplicity, the remainder of the saddle has been omitted. The movable part (301) may in this case have one (305) or several (306) and (307) hinges in common with the fixed saddle part (302, not shown here). A strip-shaped securing element, in this case illustrated as a safety belt (320) with a safety lock (321), which can readily be opened by the push of a button, similar to the lock on a car safety or aeroplane safety belt, is connected to this movable saddle part (301). Here, this safety belt (320) is shown as being in contact with the rear part of the movable saddle part (301), but this safety belt (320) may also engage with the movable saddle part (301) at other locations, such as for example on the sides thereof, on the front thereof, or of the flaps (007), at least if those form part of the movable saddle part (301), or it may be several safety straps (320) or combinations of said securing options. Ways of temporarily connecting strip-shaped elements to each other and opening them again in other ways than by means of a safety lock (321) are also possible.

FIG. 40B shows a detail of a safety belt (320) from FIG. 40A, in which the safety lock (321) is in the open position. In addition, it shows that, on the rear side of the horseman, the safety belt is a continuous structure or forms part of a continuous structure (322).

FIG. 40C shows a detail of a safety belt (320) from FIG. 40A, in which the safety lock (321) is in the open position. In addition, it shows that, on the rear side of the horseman, the safety belt is a non-continuous structure or forms part of a non-continuous structure (323 and 324).

Figure 41C:
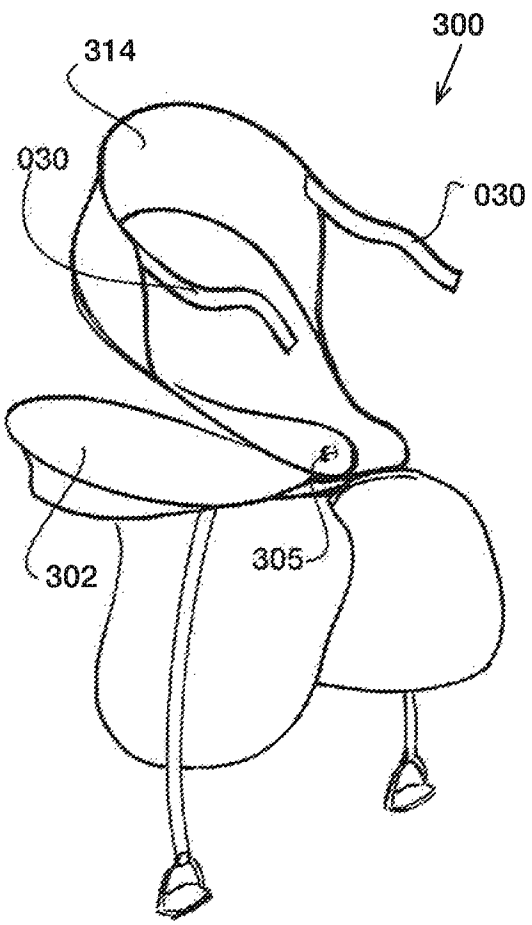
FIG. 41C is a perspective right-hand side and front upper view of a tiltable or pivotable saddle with a single hinge, in which the horseman can be secured by means of the backrest which has already been shown, starting from the back of the movable saddle part, in raised position.
Figure 41B:
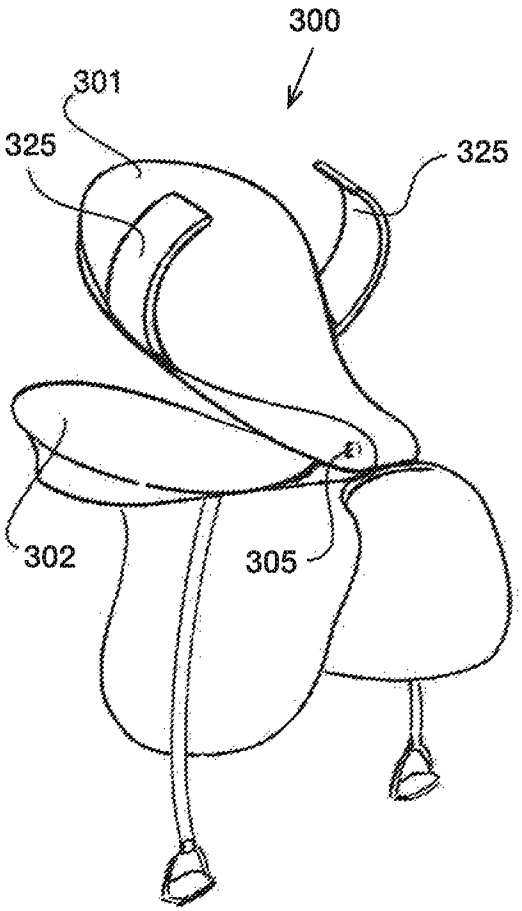
FIG. 41B is a perspective right-hand side and front upper view of a tiltable or pivotable saddle with a single hinge, in which the horseman can be secured by means of lateral clamping widened sections, starting from the sides of the movable saddle part, in raised position.
Figure 41A:
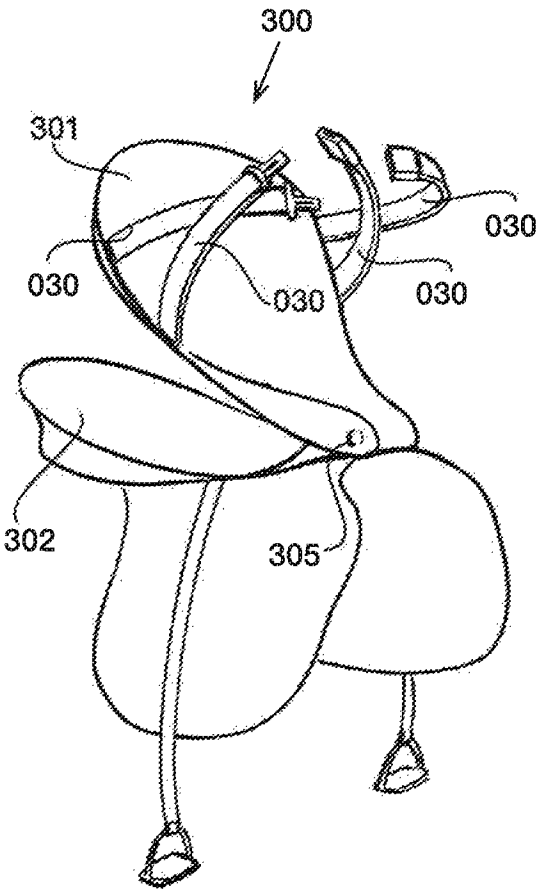
FIG. 41A is a perspective right-hand side and front upper view of a tiltable or pivotable saddle with a single hinge, in which the horseman can be secured by means of several strip-shaped elements or safety straps which in this case start from the sides of the movable saddle part, in raised position.

FIGS. 41A-41C all show a tiltable or pivotable saddle (300), in which the saddle consists of a movable saddle part (301) which is movably connected to a fixed saddle part (302) by means of a single hinge (305) at the front and top side of the saddle, and in which the horseman is or can be secured to the movable saddle part (301) in such a way that he can be released in different ways.

FIG. 41A shows a tiltable or pivotable saddle (300) with a single hinge (305), in which the horseman can be secured by means of several strip-shaped elements (030) or safety straps which in this case start from the sides of the movable saddle part (301).

FIG. 41B shows a tiltable or pivotable saddle (300) with a single hinge (305), in which the horseman can be secured by means of lateral clamping widened sections (325), starting from the sides of the movable saddle part (301). Such widened sections (325) may be made, for example, of bendable clamping material which clamp the thighs of the horseman laterally after having been bent inwards.

FIG. 41C shows a tiltable or pivotable saddle (300) with a single hinge (305), in which the horseman can be secured by means of the backrest (314) which has already been shown, starting from the back of the movable saddle part (301).

FIGS. 42-47 show various horseman-securing elements (400) which are intended to be used in combination with a tiltable or pivotable saddle (300), as shown, inter alia, in FIGS. 32 to 41. This is due to the fact that, if these horseman-securing elements were to be used with a non-tiltable or a non-pivotable saddle, the horseman would be secured in a satisfactory manner to such a saddle, but the aim of the invention, which is that the horseman also has to be free to perform the equestrian movements he needs to make and which involve him raising himself from and returning to the saddle, has not been achieved.

For the sake of simplicity, the tiltable or pivotable saddle (300) is not shown as such in FIGS. 42 to 47. Where the upper saddle part (301) is illustrated, it has been shown without the hinge (305). For the sake of simplicity, the fixed saddle part (302) has been omitted in these drawings.

Figure 42:
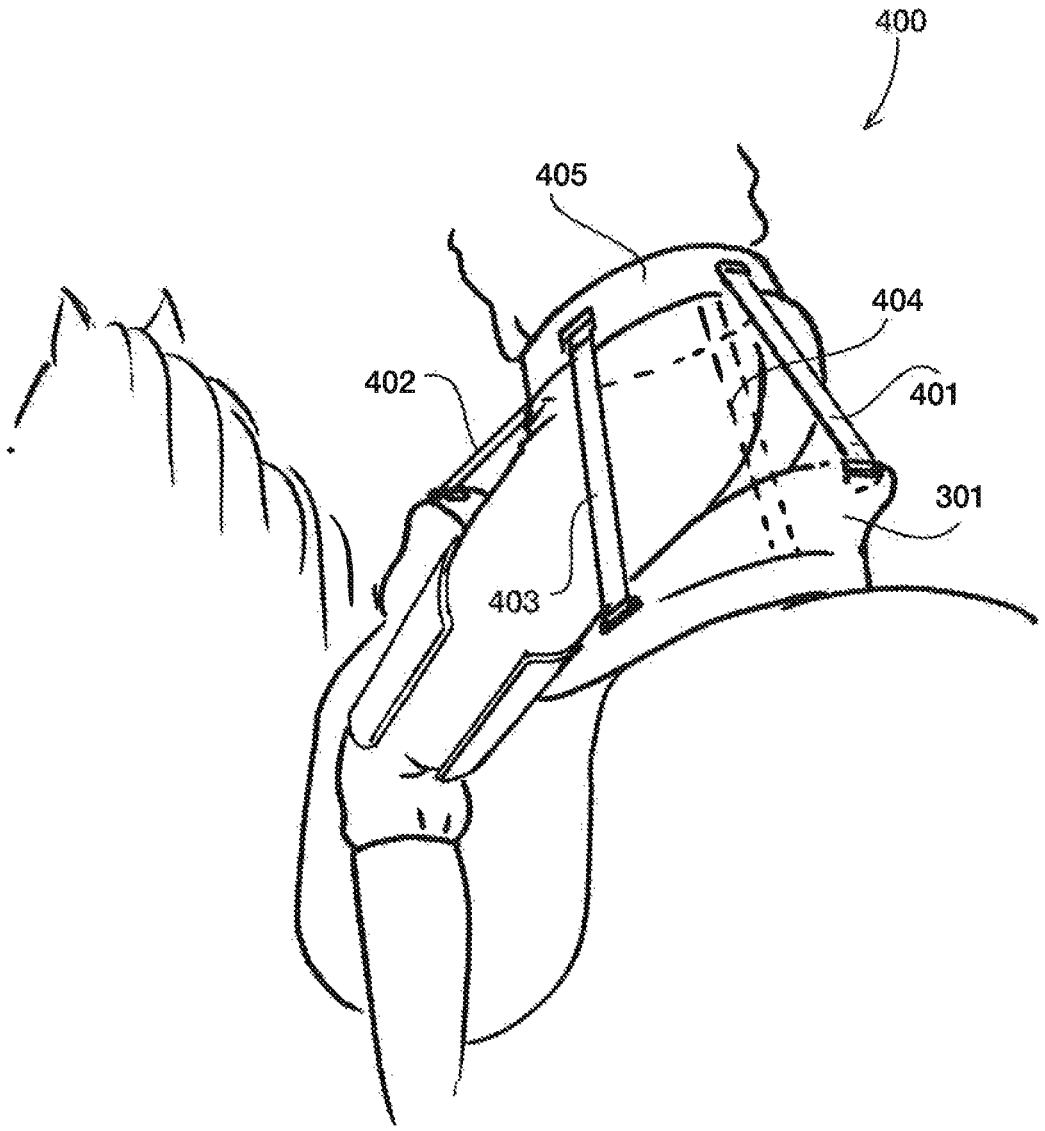
FIG. 42 is an enlarged partial perspective right-hand side and rear view of a horse carrying a saddle equipped with a horseman securing device by means of a horseman-securing element consisting of one or more strip-shaped elements which, on one side, are connected to the saddle and, on the other side, to the horseman, in this case by means of a belt around his waist.

FIG. 42 shows a horseman-securing element (400) consisting of one or more strip-shaped elements (401-404) which, on one side, are connected to the saddle (002) and, on the other side, to the horseman (015), in this case by means of a belt (405) around his waist. In this example, a strip (401) is shown on the rear side of the horseman, a strip (402) on the front side of the horseman, a strip (403) on the left-hand side of the horseman and a strip (404) on the right-hand side of the horseman. These strips may be used separately or in combination and may be temporarily closed and opened by means of a lock, such as for example a safety lock, separately for each strip, or collectively, for example if this lock is situated on the belt, for example on the front side thereof. Of course, these strips may be used without a tiltable or pivotable saddle (300) if they are elastic and preferably resilient, but the freedom of movement may then be so great that it is no longer possible to be sure the horseman will return to his starting position, as is possible in combination with the tiltable or pivotable saddle (300) according to the invention.

Figure 43B:
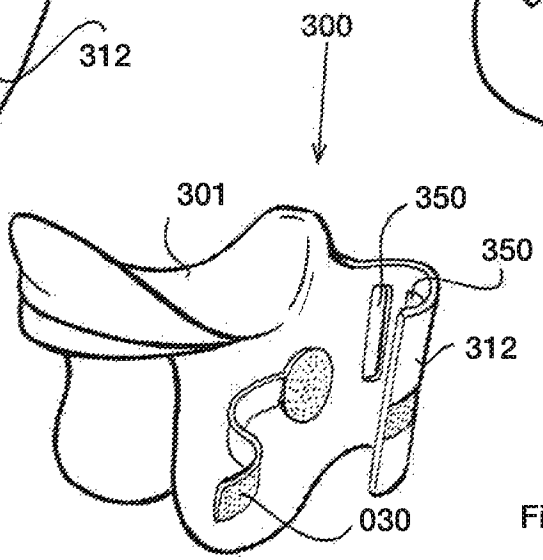
FIG. 43B is a perspective right-hand side and rear view of an upper saddle part of a tiltable or pivotable saddle, in which a kind of wing is provided at the front on either side, in which a strip-shaped element is shown on the inner side which can be attached to the wing on the lateral side, in such a way that the thigh of the horseman is clamped between the wing and the rest of the upper saddle part.
Figure 43A:
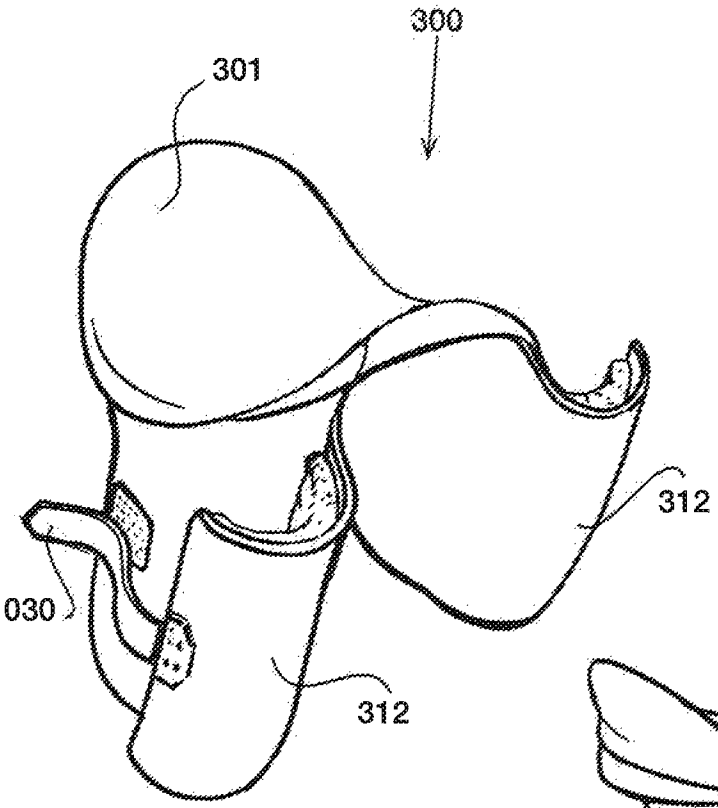
FIG. 43A is a perspective right-hand side and front upper view of an upper saddle part of a tiltable or pivotable saddle, in which a kind of wing is provided at the front on either side, in which a strip-shaped element is shown on the outer side which can be attached to the same saddle part on the medial side in such a way that the thigh of the horseman is clamped between the wing and the rest of the upper saddle part.

FIGS. 43A and 43B show the upper saddle part of a tiltable or pivotable saddle (300), in which a kind of wing (312) is formed at the front, on either side, corresponding to, e.g., the wings (312) from FIGS. 37C to 37E.

FIG. 43A shows an upper saddle part (301) of a tiltable or pivotable saddle (300), seen from the front and above at an angle, in which a kind of wing (312) is provided at the front on either side, in which a strip-shaped element (030) is shown on the outer side which can be attached to the same saddle part on the medial side in such a way that the thigh of the horseman (015) is clamped between the wing (312) and the rest of the upper saddle part (301).

FIG. 43B shows an upper saddle part (301) of a tiltable or pivotable saddle (300), seen from the side and behind at an angle, in which a kind of wing (312) is provided at the front on either side, in which a strip-shaped element (030) is shown on the inner side which can be attached to the wing on the lateral side, in such a way that the thigh of the horseman (015) is clamped between the wing (312) and the rest of the upper saddle part (301).

Some openings (350) are shown on the front side of wing (312) which serve to aerate the space surrounded by the wing (312).

Figure 44:
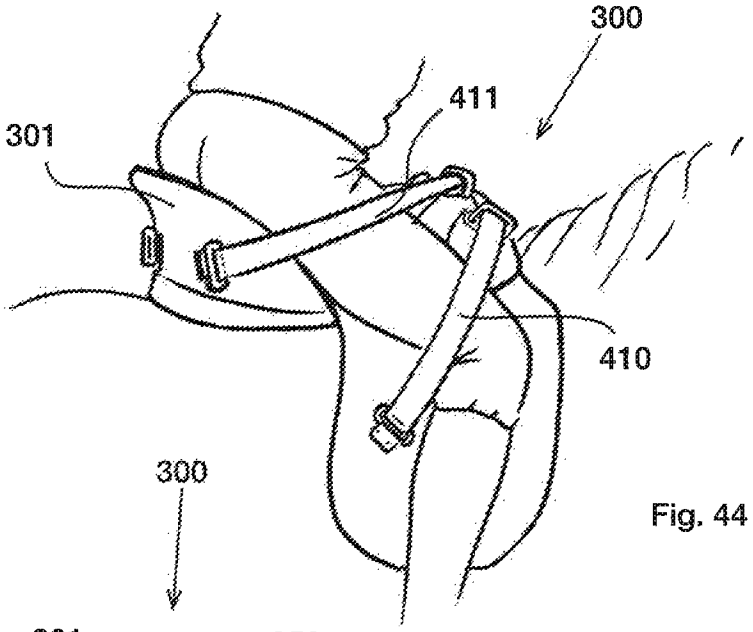
FIG. 44 is an enlarged partial perspective right-hand side and rear view of a horse carrying a saddle equipped with a horseman securing device by means of an upper saddle part of a tiltable or pivotable saddle, with strip-shaped elements over the distal thighs and proximal thighs of the horseman.

FIG. 44 shows an upper saddle part (301) of a tiltable or pivotable saddle (300), seen from the side, with strip-shaped elements over the distal thighs (410) and proximal thighs (411) of the horseman. In this case, these strip-shaped elements are attached on one side to the rear side of the saddle and rear side of the flap, and on the other side to the front and top side of the saddle, where they may be opened and closed, e.g. by means of a single pushbutton or safety button.

Figure 45B:
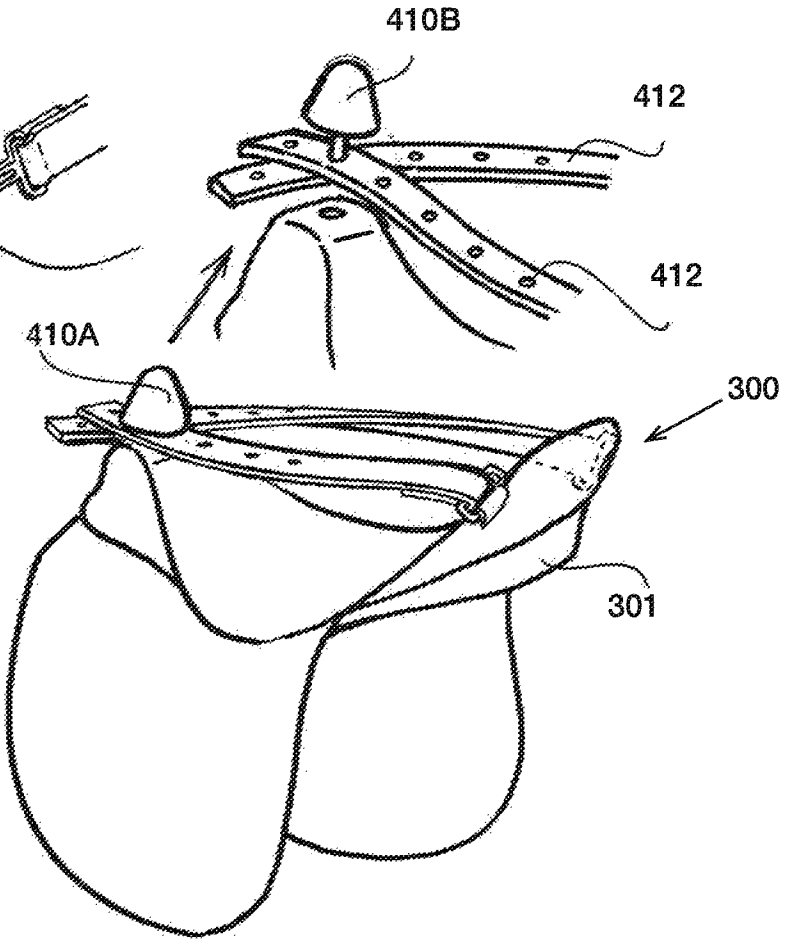
FIG. 45B is a perspective left-hand side view of a similar way of fixing the horseman to the upper saddle part (larger drawing) as in FIG. 45A, but here, the temporary lock and release are illustrated in detail (small drawings).
Figure 45A:
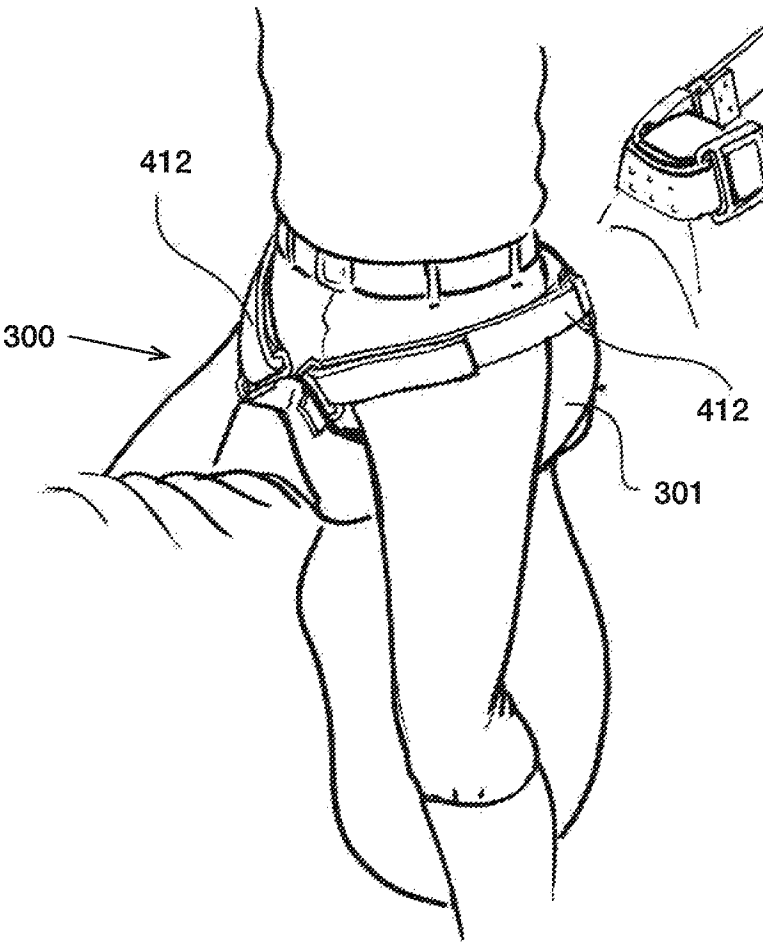
FIG. 45A is an perspective enlarged partial left-hand side and front view of a horse carrying a saddle equipped with a horseman securing device by means of an upper saddle part of a tiltable or pivotable saddle, in which strip-shaped elements are present to fix the horseman to the upper saddle part. The lower part of the horseman is depicted, but not the fixed part of the tiltable or pivotable saddle.

FIG. 45A shows an upper saddle part (301) of a tiltable or pivotable saddle (300), in which strip-shaped elements are present to fix the horseman to the upper saddle part (301). A strip or strips (412) are arranged around the thighs and/or abdomen of the horseman and are attached to the rear side of the saddle and can temporarily be attached to the front and top side of the saddle.

FIG. 45B shows a similar way of fixing the horseman to the upper saddle part (301) as in FIG. 45A, but here, the temporary lock and release (410) are illustrated in detail. Pin 410 can be passed through holes in both strips (412) and be inserted into a cylindrical hole at the top of the front side of the saddle. This pin may be in a closed position (410A) or open position (410B). Obviously, other ways of effecting a temporary securing arrangement are possible, such as for example a double press slot, such as that of a safety belt used in a car or aeroplane.

Figure 46:
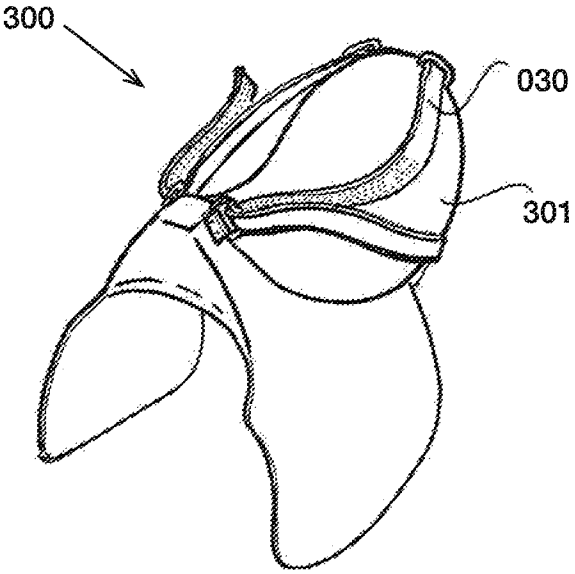
FIG. 46 is a perspective left-hand side and front and upper view of an upper saddle part of a tiltable or pivotable saddle, which make use of strip-shaped elements, which use a hook and loop fastener.

FIG. 46 shows an example of the use of strip-shaped elements, which use a hook and loop fastener. This may be a single strip which is passed through an eyelet and is turned back, or 2 different strips (e.g. 416 and 417) comprising different types of hook and loop fastener on the sides facing each other.

FIGS. 47A and 47B show how a hook and loop fastener may also be used to fix the horseman (015) to an upper saddle part (301) of a tiltable or pivotable saddle (300), in the form of an assembly between widened strip-shaped elements with a touch and a close fastener of the one type on the inner side (420) and a hook and loop fastener of the other type (421) provided around the thighs of the horseman or his clothing. Of course, the hook and loop fastener may also be fitted more extensively or less extensively. Again, in FIGS. 42-47, the fixed saddle part (302) has been omitted for the sake of simplicity.

FIGS. 48A-48F show a horseman-securing device comprising one (or more) optionally flexible, bent or bendable bar (500), extending from the rear side of the saddle (002) in which case the horseman (015) is connected in a movable and releasable way to bar (500) by means of one or more ancillary means (501), in such a way that the horseman attached to the animal can move in the longitudinal direction of the bar (see arrows) over a limited distance in order to raise himself between a position in which the backside of the horseman is completely in contact with the back of the animal, or indirectly via the saddle, to a position in which the backside of the horseman is not, or not completely, in contact with the back of the animal, or indirectly via the saddle, and back again to the starting position, in which the horseman retains the freedom to pivot his knees and move his lower legs.

FIG. 48A shows the bendable bar (500) which is attached to the rear side of the saddle by means of a hinge (502). By means of the hinge (502), bar (500) can pivot in the forward and backward direction, but if the connection is provided, in addition to or instead of the hinge (502), with a spherical and hollow socket (503), bar (500) can move in all directions, as a result of which the horseman (015) can also move in all directions.

The horseman (015) is connected to bar (500) by means of an aid (501), namely in such a manner that the aid can move along bar (500, vertical arrow). In FIG. 48A, the aid is shown as a kind of waistcoat (504), in FIG. 48B as a pair of trousers, but it may preferably also be waistcoat-trousers (505), as illustrated in FIG. 48C. The advantage of waistcoat-trousers (505) is that a waistcoat (504) can move in an upward direction, while waistcoat-trousers (505) cannot move in an upward or downward direction. Also, the combination of a waistcoat and a pair of trousers reduces the rotation possibilities of these garments. These garments may be incorporated in standard horseman's outfit, such as a pair of riding breeches, but may equally well be worn over the standard horseman's outfit as separate clothing.

If a separate clothing passage or coupling pieces (506) or otherwise is or are added on the back side of the waistcoat part, such as illustrated, inter alia, in FIG. 48F, then the horseman does not have to feel bar (500) directly.

If bar (500) is provided with an optionally adjustable stopper (510) is provided which is fitted e.g. 20 cm above the top edge of the waistcoat or waistcoat part of the garment, the upward or, when bending forwards or swinging of the bar (500), forward movement of the horseman (015) is limited, while the horseman retains the freedom to raise his body by in this case at most 20 cm.

Bar (500) may end upwards at a certain distance, e.g. 20 cm, above the top edge of the coupling piece (504). But according to a preferred embodiment of the invention, it is advantageous if the upper part of bar (500) extends over the head of the horseman (015), for example at 25-30 cm over his head and one or more bends are formed according to the contour of neck and head of the horseman, in such a way that the horseman is able to raise his body, but also in such a way that the bend of bar (500) bends forward over the head of the horseman in such a way that bar (500) protects the head of the horseman passively (507).

FIGS. 48C and E shows the forward and backward pivoting or tilting movement of bar (500), in which the backward position (511) is approximately 45 degrees removed from the forward position (512) in this case. Depending on the desired use by the horseman, the number of degrees may in this case be chosen to be smaller or larger by means of an adjusting knob (513) at the location of hinge (502).

FIG. 48F shows the lateral freedom of movement of bar (500), in this case a freedom of movement towards the right-hand side of horse and horseman. As stated, such a freedom of movement is possible if the bar is configured to be bendable or has a certain flexibility or by configuring the connection as a sphere in a hollow socket (503) at the location of the pivoting point (502).

FIGS. 49A-49E show a variant to the single bar, as illustrated in the other FIG. 48, consisting of a several bars or backrest (510).

FIGS. 50A-50C show a bar (600) which extends from the centre and rear side of the saddle (002) up to the centre and front side of the saddle (002), thus forming a continuous ring which may contribute to the passive protection of the horseman. It is advantageous in this case if the ring is formed in such a way that the horseman retains his freedom to perform the raising movement which is necessary in horse riding, as well as the forward movement which is necessary when jumping with the horse. This means that the ring does not have to have the same curvature and shape everywhere. Incidentally, the connection between the horseman (015) and the bar (600) or bars (601) is identical to the connection shown in FIG. 48. FIGS. 49, 50 and 51 show a basic construction (600) which consists of several tubes rather than a bar. With several tubes, the lateral freedom of movement of the bars will be limited.

FIG. 50A shows the situation in rest or during walking, in which the backside of the horseman is completely in contact with the back of the horse, or indirectly via the saddle. The coupling piece (604) is in a bottom position.

FIG. 50B shows the situation in which the horseman has raised his backside, e.g. in light trot, in which coupling piece (604) is in an elevated position.

FIG. 50C shows a bar (600) which consists of a single bar on the rear side and branches in such a way that there are two bars (601) on the front side of the horseman, which are connected to the front side of the saddle. It is advantageous if there is not a single bar (600) in the centre in front of the horseman, so that the view and the movements of the horseman are not impeded. Alternatively, the two bars on the front side may be joined again at some distance from the saddle in order to be attached to the saddle by means of a single securing point at the front and top side of the saddle. This has the advantage that the horseman's view is clear, while the hands of the horseman and the reins can move freely past the single securing point at the top centre on the front of the saddle. Conversely, the horseman-securing device may be configured in such a way that only one bar is present on the front side of the horseman and several bars on the rear side of the horseman, or a single bar on the front side which has a window frame at eye level.

FIGS. 51A, B and FIGS. 52A-C show variations of FIG. 50, in which a kind of cage structure (700) is produced by using several bars, which contributes to the passive safety of the horseman (015). In this case, it may be advantageous if the bars are configured to be slightly movable at the location of the securing points with the saddle, e.g. by means of hinges with limited freedom of movement.

FIGS. 53 and 54 show a saddle which consists of a movable saddle part (801,901) which is movably connected to a fixed saddle part (802, 902) by means of a single hinge (805, 905) at the front and top side of the saddle, and in which the horseman is or can be secured to the one or more movable saddle parts (801, 901), for example by means of the strip-shaped securing elements (030), in which one or more resilient connecting elements (810, 910), preferably of different lengths, are provided between the movable saddle part (801, 901) and the fixed saddle part (802, 902). It is also possible to design this variant without any hinges. In this case, the one or more resilient connecting elements (810 and 910) then act as a kind of free hinge between the one or more fixed (802 and 902) and one or more movable saddle parts (801 and 901).

The invention claimed is:

1. A saddle configured in order to inhibit a horseman sitting on a back of a four-legged animal from falling off the animal, the saddle attached to a girth that is securable to the animal, the girth configured to fasten the saddle to the animal, the saddle comprising:

a saddle seat;

stirrups joined to the saddle seat on both sides; and a securing device configured to releasably secure the horseman to the saddle in such a way that the horseman retains a pivot function of each of his knee joints in such a way that:

a) with weight of the horseman transferred to the stirrups, the horseman rises from a first backside position on the saddle seat in which a backside of the horseman is in complete contact with the back of the animal via the saddle and in which thighs of the horseman pivot at the knee joint at a first backside position angle with respect to lower legs of the horseman, to a second backside position in which the horseman has moved his backside upwards and forwards with respect to the first backside position, and in which the backside of the horseman is no longer in complete contact with the back of the animal via the saddle and the thighs are in a straighter position with respect to the lower legs, such that the thighs and lower legs pivot into a straighter line with respect to each other forming a corresponding angle larger than the first backside position angle, in order to move back to the first backside position, and b) the horseman moves his lower legs from a first lower leg position in which his lower legs hang perpendicularly downwards with resect to a horizontal baseline to a second lower leg position in which his legs are directed rearward compared to the first lower leg position, in order to move his lower legs back again to the first lower leg position; and wherein the securing device comprises at least one securing element on each side of the saddle configured with surfaces arranged to contact a leg of the horseman and to at least partly grip around the leg only along a length of the leg proximate the knee joint with the surfaces arranged at only a limited height on an outer side of the knee joint of the horseman in order to retain the pivot function of the knee joint of the horseman.

2. The saddle according to claim 1, wherein the at least one securing element comprises at least one bondable bar-shaped clamping structure.

3. The saddle according to claim 2, wherein the at least one bondable bar-shaped clamping structure comprises at least one deformable bar, which can be fitted around the knee joint of the horseman by being deformable into an open position and a closed position.

4. The saddle according to claim 3, wherein the bar-shaped clamping structure is provided with semi-stiff clamping aids arranged around the at least one deformable bar to function as a clamping structure.

5. The saddle according to claim 2, wherein the at least one bondable bar-shaped clamping structure comprises separate elements which are connected with each other in such a way that they are movable with respect to each other to bend the at least one bendable bar-shaped clamping structure, but in which the separate elements can be fixed with respect to each other in a certain position to grip around the leg of the horseman.

6. The saddle according to claim 5, wherein the separate elements can be fixed with respect to each other by tightening a steel wire which has been passed through these elements and locking it.

7. The saddle according to claim 2, wherein the at least one bondable bar-shaped clamping structure is made of bondable material.

8. The saddle according to claim 7, wherein the bondable bar-shaped clamping structure is made of a material of a group comprising bondable metal alloys, memory metal, and bondable plastics.

9. The saddle according to claim 2, wherein the bondable bar-shaped clamping structure includes a single bar attached to the saddle to fit an outer side of the knee of the horseman.

10. The saddle according to claim 9, wherein the single bar has extensions made of another material than that of the single bar, which extensions cover a larger part of the leg of the horseman than a diameter of the bar.

11. The saddle according to claim 2, wherein the bondable bar-shaped clamping structure includes a plurality of bars to cover the limited height of the outer side of the knee joint of the horseman in order to retain the pivot function of the knee joint of the horseman.

12. The saddle according to claim 2, further comprising clothing for the horseman for use with the saddle, wherein the horseman wears one or more thickenings externally on his clothing and such thickening is provided with at least one of a cavity, groove, recess and a closed ring to be present on the clothing of the horseman into which the bar-shaped clamping structure fits.

13. The saddle according to claim 12, wherein the clothing includes a knee sock which comprises one or more thickenings to be positioned on an outer side of the knee of the horseman, between which the bar-shaped clamping structure fits.

14. The saddle according to claim 2, wherein the bendable bar-shaped clamping structure is configured with deformable bars, tubes, thick wires or pipes configured to be fitted around or on an outer side of a body part of the horseman.

15. The saddle according to claim 1, wherein the surfaces of the at least one securing element comprise a first surface of the securing element that faces to the rear of the saddle and is configured to contact a first portion of the leg that is proximate the knee joint and that is facing forward when the leg of the horseman is in the first lower leg position.

16. The saddle according to claim 15, wherein the surfaces of the at least one securing element comprise a second surface of the securing element that faces an outwardly facing surface of the saddle and is configured to contact a second portion of the leg that is proximate the knee joint and that is facing laterally when the leg of the horseman is in the first lower leg position, such that the leg proximate the knee joint is gripped between the second surface and the outwardly facing surface of the saddle.

17. The saddle according to claim 16, wherein the first surface is connected to the second surface.

18. The saddle according to claim 15, wherein the first surface is configured to contact a portion of the leg that is above a patella of the knee joint.

19. The saddle according to claim 1, wherein the at least one securing element on each side of the saddle is provided permanently on the saddle.

20. The saddle according to claim 1, wherein the at least one securing element on each side of the saddle is provided semi-permanently on the saddle.

21. A saddle configured in order to inhibit a horseman sitting on a back of a four-legged animal from falling off the animal, the saddle attached to a girth that is securable to the animal, the girth configured to fasten the saddle to the animal, the saddle comprising:

a saddle seat;

stirrups joined to the saddle seat on both sides; and a securing device configured to releasably secure the horseman to the saddle, the securing device comprising at least one securing element on each side of the saddle configured with surfaces arranged to contact a leg of the horseman and to at least partly grip around the leg only along a length of the leg proximate a knee joint with the surfaces arranged at only a limited height on an outer side of the knee joint of the horseman in order to retain a pivot function of the knee joint of the horseman to and from positions of the horseman on the saddle including:

a first backside position on the saddle seat in which a backside of the horseman is in complete contact with the back of the animal via the saddle and in which thighs of the horseman pivot at the knee joint at a first backside position angle with respect to lower legs of the horseman; and a second backside position in which the horseman has moved his backside upwards and forwards with respect to the first backside position, and in which the backside of the horseman is no longer in complete contact with the back of the animal via the saddle and the thighs are in a straighter position with respect to the lower legs, such that the thighs and lower legs pivot into a straighter line with respect to each other forming a corresponding angle larger than the first backside position angle.

22. The saddle according to claim 21, wherein the at least one securing element comprises at least one bendable bar-shaped clamping structure.

23. The saddle according to claim 22, wherein the at least one bendable bar-shaped clamping structure comprises at least one deformable bar, which is configured to fit around the knee joint of the horseman in a closed position by being deformable into an open position and the closed position.

24. The saddle according to claim 22, wherein the at least one bendable bar-shaped clamping structure comprises separate movably connected elements configurable to a position to grip around the leg of the horseman.

25. The saddle according to claim 24, wherein a wire extends through each of the separate elements.

26. The saddle according to claim 22, wherein the at least one bendable bar-shaped clamping structure is made of bendable material.

27. The saddle according to claim 26, wherein the bendable bar-shaped clamping structure is made of a material of a group comprising bendable metal alloys, memory metal, and bendable plastics.

28. The saddle according to claim 22, further comprising clothing for the horseman, the clothing having one or more thickenings with at least one of a cavity, groove, recess and a closed ring into which the bar-shaped clamping structure fits.

29. The saddle according to claim 28, wherein the clothing includes a knee sock which comprises the one or more thickenings to be positioned on an outer side of the knee of the horseman, between which the bar-shaped clamping structure fits.

30. The saddle according to claim 22, wherein the bendable bar-shaped clamping structure is configured with deformable bars, tubes, thick wires or pipes configured to be fitted around or on an outer side of a body part of the horseman.

* * * * *